US007798630B2

(12) United States Patent
Nakazawa

(10) Patent No.: US 7,798,630 B2
(45) Date of Patent: Sep. 21, 2010

(54) INK-JET RECORDING DEVICE AND INK-JET RECORDING METHOD

(75) Inventor: Yusuke Nakazawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 599 days.

(21) Appl. No.: 11/475,905

(22) Filed: Jun. 28, 2006

(65) Prior Publication Data

US 2007/0002115 A1 Jan. 4, 2007

(30) Foreign Application Priority Data

Jun. 29, 2005 (JP) ..... P.2005-190061

(51) Int. Cl.
*B41J 2/01* (2006.01)

(52) U.S. Cl. ..... 347/102

(58) Field of Classification Search ..... 347/101, 347/102, 103

See application file for complete search history.

(56) References Cited

U.S. PATENT DOCUMENTS 6,158,844 A * 12/2000 Murakami et al. ..... 347/55
6,292,277 B1 9/2001 Kikinis
6,305,787 B1 10/2001 Nakazawa et al.
6,575,564 B1 6/2003 Tsuchiya et al.
7,137,696 B2 * 11/2006 Siegel ..... 347/102
2004/0183879 A1 * 9/2004 Nakazawa ..... 347/101
2004/0257419 A1 12/2004 Iinuma et al.
2006/0290760 A1 * 12/2006 German et al. ..... 347/102

FOREIGN PATENT DOCUMENTS

EP 1 442 886 A1 8/2004
EP 1 652 686 A1 5/2006
JP 2004-009487 1/2004
JP 2004-181643 7/2004
JP 02004291578 A * 10/2004

* cited by examiner

*Primary Examiner*—Stephen D Meier
*Assistant Examiner*—Alexander C Witkowski
(74) *Attorney, Agent, or Firm*—Sughrue Mion, PLLC

(57) ABSTRACT

According to an ink-jet recording device and an ink-jet recording method by discharging and impacting an ink containing a charged fine particle as a small droplet due to an electrostatic force onto a recording medium and curing the ink by irradiation with an actinic energy ray immediately after the image formation by ink discharge, a fixing step by heating becomes unnecessary; a situation that the ink is volatilized by heat does not take place so that it becomes gentle against the set-up environment; and it becomes possible to realize high-speed recording with high definition and easy handling by electrostatic discharge and impacting of a small ink droplet.

5 Claims, 17 Drawing Sheets

STRUCTURE OF DISCHARGE ELECTRODE : CIRCULAR ELECTRODE HAVING INSIDE DIAMETER OF 200μm
DISCHARGE ELECTRODE : +400V, OPPOSING ELECTRODE: -1500V

——: AMOUNT OF PROTRUSION 250μm
- - -: AMOUNT OF PROTRUSION 200μm
-------: AMOUNT OF PROTRUSION 150μm
—·—: AMOUNT OF PROTRUSION 100μm
—··—: AMOUNT OF PROTRUSION 75μm

INK-JET RECORDING DEVICE AND INK-JET RECORDING METHOD

BACKGROUND OF THE INVENTION

1. Field of the Invention

The present invention relates to an ink-jet recording device for achieving image formation on a recording medium by ink-jetting using an ink which is curable by actinic energy such as ultraviolet rays and electron beams and to a recording method.

2. Background Art

In general, an ink-jet recording device for achieving image formation by discharging a non-curing type ink onto a recording medium using an ink-jet head is widely utilized. In this recording device, the ink on the recording medium on which the ink image has been formed by the ink-jet head is dried or fixed, thereby obtaining a final recorded material.

In such an ink-jet recording device, in many cases, heating is carried out at the time of drying or fixing operation for reasons such as an enhancement of the productivity. For example, there have been disclosed a device in which after discharging an oily ink onto a recording medium to form an image, a fixing operation by heating or pressurization is carried out by heat rolls and so on. However, in the case of carrying out heating at the time of the drying or fixing operation in such a way, it is feared that the recording medium causes heat deformation. Also, volatilization of the solvent from the ink is unavoidable so that a problem remains in view of the environment, too.

Also, in general, a piezoelectric system is utilized for an inkjet head as described in JP-A-2004-181643 (the term "JP-A" as used herein means an "unexamined published Japanese patent application). However, if it is intended to make a dot size small for the purpose of obtaining a high-definition image, an ink discharge nozzle must be made small. For that reason, there are frequently encountered such problems that the ink discharge nozzle is plugged and that the amount of discharge is not stable. In general, a lower limit of the dot size is approximately 20 μm in dedicated paper and approximately 40 μm in plain paper, respectively.

Also, as another hindrance, in the case of making the dot size small, as described previously, not only the amount of discharge of the ink is unstable, but also a possibility that a flying route is curved because of a small droplet increases, resulting in causing a problem in precision of the impacting position. However, image quality with higher definition and realization of high speed are always required.

Also, JP-A-2004-090487 discloses a photocuring type ink-jet recording device for recording an image by discharging a photocuring type ink onto a recording medium on a platen provided with suction holes communicating with the supporting surface of a web-like recording medium by an ink-jet head.

In the case of this photocuring type ink-jet recording device, especially as characteristics of the ink, it does not require heating and has characteristic features so as to meet requirements such as realization of high-speed recording on various recording media, formation of a high-definition image which hardly causes oozing, and less influence against the environment. However, the problems of a piezoelectric type inkjet head still remains, and higher definition and higher speed are required. Furthermore, in the case of using such a photocuring type ink and achieving recording especially on paper in which the ink is not absorbed (for example, resin films), dots are cured in a state that they are built up thick. Accordingly, in dots of a large size by a piezoelectric type ink-jet head, smoothness of an image on the recording medium becomes low. In particular, in color images, the buildup is conspicuous so that the image quality is deteriorated.

SUMMARY OF THE INVENTION

An object of the invention is to provide ink-jet recording device (hereinafter as referred to "an actinic energy curing type ink-jet recording device") which is gentle against the environment and which is able to realize high speed in a higher definition or higher image quality with easy handling and a recording method.

The object of the invention has been attained by the following constructions.

(1) An ink-jet recording device, which comprises: a storing section that stores the ink curable by irradiation with an actinic energy ray to form an image on a recording medium; an image recording section that comprises an ink-jet head and is discharged the ink as a droplet, the ink being fed from the storing section, onto the recording medium by an electrostatic force generated between the ink-jet head and the recording medium; a transporting and supporting section that comprises a placing surface, the transporting and supporting section transporting the recording medium and supporting the recording medium at a discharge position of the ink on the placing surface; and an irradiating section disposed at a position that can irradiate the recording medium with the actinic energy ray immediately after the ink is impacted on the recording medium.

(2) The ink-jet recording device described in item (1), which comprises: an electrostatic charge section disposed at a side of the upstream in a transporting direction of the recording medium with respect to the discharge position of the ink and electrostatically charges the recording medium on the placing surface of the transporting and supporting section; and a static eliminating section that carries out a static elimination after the actinic energy ray is irradiated by the irradiating section, wherein the ink contains a charge adjusting agent.

(3) The ink-jet recording device described in item (1) or (2), wherein the image recording section comprises: an insulating substrate that has discharge nozzles; an ink guide that is disposed so that a tip of the ink guide is protruded toward a side of the recording medium from each of the discharge nozzles; an ink passage that is a gap between a head substrate for fixing and holding the ink guide and the insulating substrate, a discharge electrode that is disposed surrounding the periphery of the ink guide at each of the discharge nozzles, each of the discharge nozzles being separated from one another; and a guard electrode that blocks an electric field between the discharge electrodes adjacent one another so that the guard electrode is electrically insulated from the discharge electrode between the discharge nozzles adjacent one another.

(4) The ink-jet recording device described in item (3), wherein a ratio of an effective inside diameter of the discharge electrode to a distance in a protrusion direction of the ink guide between the tip of the ink guide and the discharge electrode is 1:0.5 to 1:2.

Here, a ratio of an effective inside diameter of the discharge electrode to a distance from the surface of the discharge electrode to the tip of the ink guide is preferably from 1/0.7 to 1/1.7. Furthermore, the discharge electrode may be a substantially circular electrode, and its effective inside diameter may be an average inside diameter. It is more preferable that the discharge electrode is a circular electrode and that the inside diameter is an effective inside diameter.

(5) The inkjet recording device described in item (1) or (2), wherein the image recording section comprises: an insulating substrate that has discharge nozzles; an ink guide that is disposed so that a tip of the ink guide is protruded toward a side of recording medium from each of the discharge nozzles; an ink passage that is a gap between a head substrate for fixing and holding the ink guide and the insulating substrate; a discharge electrode that is disposed in parallel interposing the ink guide therebetween at each of the discharge nozzles and is separated from the ink guide; and a guard electrode that blocks an electric field between the discharge electrodes adjacent one another so that the guard electrode is electrically insulated from the discharge electrode between the discharge nozzles adjacent one another.

(6) The ink-jet recording device described in item (5), wherein a ratio of a gap in parallel disposition of the discharge electrodes to a distance in a protrusion direction of the ink guide between the tip of the ink guide and the discharge electrode is from 1:0.7 to 1:2.8.

Here, a ratio of an effective gap in parallel disposition of the discharge electrodes to a distance in the ink guide protrusion direction between the tip of the ink guide and the discharge electrode is preferably from 1/1.0 to 1/2.4. Furthermore, with respect to the parallel disposition of the discharge electrodes, the discharge electrodes may be substantially parallel electrodes, and its effective gap is an average gap. It is more preferable that the discharge electrodes are completely parallel electrodes and that the effective gap is a distance between these electrodes,.

(7) The ink-jet recording device described in any one of items (1) to (6), wherein the transporting and supporting section comprises: a transporting belt that supports and transports the recording medium; and rolls that tense and drive the transporting belt.

In the transporting and supporting section, when the surface on which the recording medium is placed is a transporting belt, the recording medium and the transporting belt move together. Accordingly, by keeping the planarity of the transporting belt, a planar uniformity of the recording medium can be kept high, thereby obtaining an image with high image quality. Furthermore, it is preferable that an electrostatic charge section for electrostatically charging the recording medium on the placing surface of the transporting belt and a static eliminating section for achieving static elimination after irradiating the irradiating section (hereinafter as referred to "actinic energy irradiating section") are disposed in the upstream side in the transporting direction of the recording medium with respect to the ink discharge position. The recording medium is transported while being brought into intimate contact with the upper surface of the transporting belt by a corona electrostatic charge section and transported by easily ensuring the planarity of the recording medium.

(8) The ink-jet recording device described in any one of items (1) to (6), wherein the transporting and supporting section comprises a platen that supports the recording medium at least in the vicinity of front and rear of the discharge position of the ink; and transporting rolls that gives a transporting power to the recording medium at least in a side of the upstream of the platen.

In this case, the transporting is achieved by a transporting roll pair. Though the disposition of the transporting roll pair is at least in the upstream side of the ink discharge position, it is preferred to dispose it in the more upstream side of the corona electrostatic charge section in a sense of avoiding electrostatic charge of the roll pair. The recording medium is transported while sliding in a state that it is brought into intimate contact with the upper surface of the platen by the corona electrostatic charge section. In the case of a platen, security of the planarity can be easily achieved, and the recording medium is smoothly transported above the platen.

(9) An inkjet recording method, which comprises: a feeding the ink into an ink-jet head from a storing section, the storing section storing an ink curable by irradiation with an actinic energy ray to form an image on a recording medium; a first applying a bias voltage between discharge electrodes provided in discharge nozzles, the discharge nozzles recording the image, in an image recording section including the ink-jet head; a second applying a prescribed discharge voltage to the discharge electrodes in synchronism with a transporting and supporting section corresponding to the image to be recorded and discharging the ink as a droplet onto the recording medium to form an image in the image recording section; and an irradiating actinic energy ray by an irradiating section immediately after the ink is impacted on the recording medium so that the image is recorded on the recording medium.

Incidentally, in each of the foregoing embodiments, it is preferable that the ink guide is disposed on a head substrate; that the ink passage is formed between an insulating substrate as disposed while being separated from the head substrate in a prescribed gap and the head substrate; that the insulating substrate is bored with plural through-holes, and that the ink guide is disposed such that a tip portion thereof is protruded toward the recording medium side from each of the through-holes as bored on the insulating substrate and guides the ink passing through the ink passage from the ink passage to the tip portion.

Furthermore, it is preferable that the ink guide is supported by partition walls as disposed opposite to each other while being separated from each other in a prescribed gap so as to cross the ink passage; that the discharge electrode is disposed on each of insulating supporting substrates as disposed opposite to each other while being separated from each other in a prescribed gap; that the ink passage is formed between each of the partition walls as disposed opposite to each other and each of the insulating supporting substrates as disposed opposite to each other; that the ink guide is disposed such that a tip portion thereof is protruded from an open end part of the ink passage toward the recording medium side and guides the ink passing through the ink passage from the ink passage to the tip portion.

Furthermore, it is preferable that the discharge electrode is provided with a first drive electrode as disposed in the insulating substrate side than the ink passage and a second drive electrode as disposed in the head substrate side than the first drive electrode. Moreover, it is preferable that the first drive electrode is disposed on the surface in the recording medium side of the insulating substrate side and that the second drive electrode is disposed on the surface in the head substrate side of the insulating substrate side. In addition, it is preferable that the second drive electrode is a common electrode which is common to a plural number of the first drive electrodes.

Furthermore, a plural number of individual electrodes each including the ink guide, the through-holes, the first drive electrode and the second drive electrode are two-dimensionally disposed along a first direction and a second direction orthogonal to the first direction; and it is preferable that the first drive electrodes of the plural individual electrodes are wired and connected to each other along the first direction and that the second drive electrodes of the plural individual electrodes are wired and connected to each other along the second direction.

Furthermore, it is preferable that the foregoing electrostatic ink-jet head is provided with a guard electrode as provided between the adjacent discharge electrodes and capable of controlling interference of an electric field between the adjacent discharge electrodes. (In addition, the electrostatic ink-jet head may be provided with a shield electrode which is provided in an insulated state and commonly against all of the discharge electrodes and which is disposed in the ink passage side than the discharge electrodes.)

Furthermore, in addition to the foregoing effects, the construction in which the recording medium is electrostatically charged in the electrostatic charge section and the ink is impacted by ink-jetting brings the following effects. That is, by enhancing a holding power or degree of adhesion of the recording medium on the placing surface and transporting the recording medium to the ink discharge position in the state that the holding power is high, the surface of the recording medium can be made substantially uniform at the ink discharge position as a result; a distance between the ink discharge tip of the image recording section and the recording medium can be made always uniform; an image having high image quality is obtained; and the possibility that the ink attaches to the ink discharge tip portion of the image recording section can be made lower.

In particular, an electrostatic charge potential of the recording medium in the electrostatic charge section is preferably set up at from 1,000 to 3,000 V in terms of its absolute value.

Furthermore, the transporting belt can be subjected to antireflection processing.

In particular, in the case where the transporting belt is used and light irradiation is performed, in order to ensure the ink curing, even when the recording medium is positioned just before the ink discharge position, a considerable amount of light radiation is already performed in the light irradiating section. In such a state, there is some possibility that the amount of reflected light from the transporting belt reaches a non-negligible amount such that the ink is cured in the ink discharge tip portion of the image recording section. Even when the recording medium is a transparent material, such a possibility of ink curing is caused. Then, by subjecting the transporting belt to antireflection processing, it is possible to prevent ink curing in the ink discharge tip portion of such an image recording section.

In the transporting belt, it is possible to provide a cleaning section for cleaning the surface with which the recording medium comes into contact in the downstream side of the foregoing static eliminating section.

It is difficult to exclude any possibility of attachment of dusts or ink splashes to the electrostatically charged transporting belt due to some influence of the electrostatic charge of the electrostatic charge section. By providing such a cleaning section in the downstream side of the static eliminating section, it is possible to make the degree of adhesion between the recording medium and the transporting belt surer.

According to the image recording device and method using an ink-jet head having the foregoing construction, the ink is cured by irradiation with actinic energy ray (hereinafter as referred to "actinic energy") immediately after the image formation by ink discharge of stable and small droplets (approximately sub p1, which is a size such that dots of approximately 10 μm can be formed on plain paper). Thus, first of all, a fixing step by heating which when using other inks, was required becomes unnecessary. Accordingly, a situation that the ink solvent is volatilized by heat does not take place so that it becomes gentle against the environment in the surroundings of the device to be set up; and the recording medium is in a completely dry state even before and after recording so that its handling is easy. Also, it becomes possible to realize high-speed ink-jet recording with high definition and high image quality by ink discharge of stable and small droplets due to electrostatic ink-jetting.

In consequence, according to the invention, it is possible to provide an actinic energy curing type ink-jet recording device which is gentle against the environment and which is able to realize high speed in a higher definition or higher image quality with easy handling and a recording method.

BRIEF DESCRIPTION OF THE DRAWINGS

The invention disclosed herein will be understood better with reference to the following drawings of which.

DETAILED DESCRIPTION OF THE INVENTION

Exemplary embodiments of the invention will be hereunder described with reference to the accompanying drawings.

Figure 1:
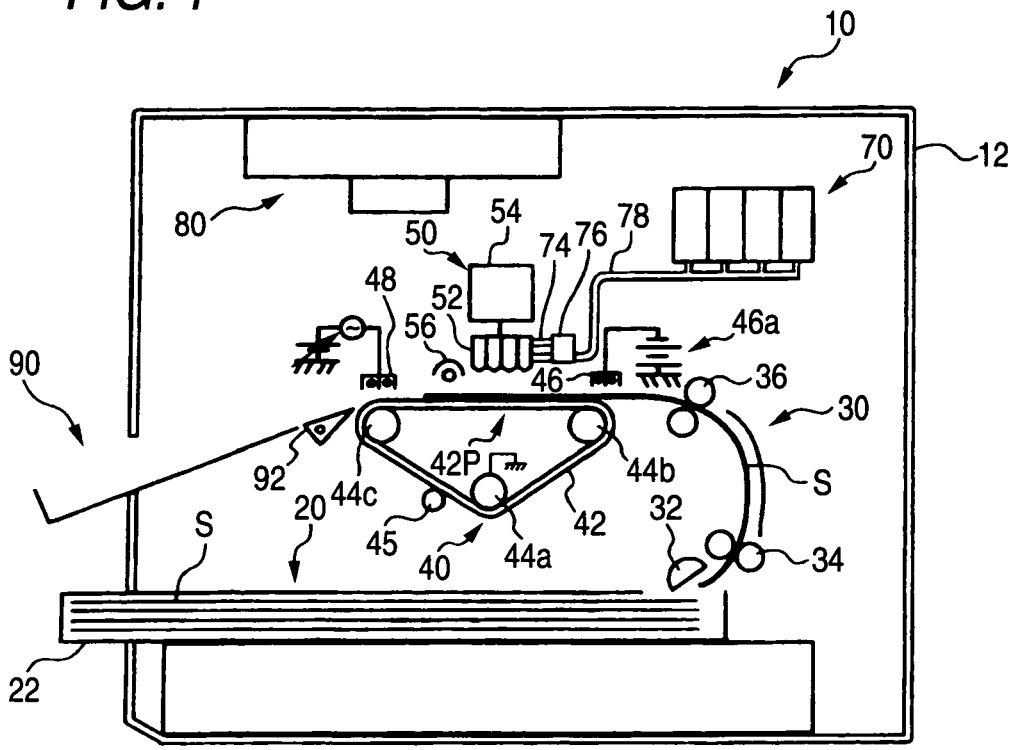
FIG. 1 is a constructive schematic view of an ink-jet recording device according to an embodiment of the invention.

FIG. 1 is a constructive schematic view of an actinic energy curing type ink-jet recording device according to an embodiment of the invention.

In FIG. 1, in a casing 12 of an actinic energy curing type ink-jet recording device 10, there are provided a recording medium accommodating section 20 for accommodating plural sheets of a sheet-like recording medium S of the sane size as piled up; a transporting and supporting section 30 for taking out the recording medium S from this accommodating section 20, a transporting and supporting section 40 for achieving transporting while keeping the recording medium S as transported thereinto by the transporting section 30 within the recording position range; and an image recording section 50 for subjecting the recording medium S which is kept, transported and supported in the transporting and supporting section 40 to ink-jet image recording and irradiation with ultraviolet rays and fixation (in this embodiment, though ultraviolet rays are used, any actinic energy is employable). In the image recording section 50, an ink feed section 70 is connected for the purpose of feeding an ink.

A tray 90 in which the recording medium S which has been recorded in the image recording section 50 is sent out is provided.

In the recording medium accommodating section 20, an accommodating cassette 22 for accommodating the recording medium S is disposed in a freely detachable manner in a lower part of the casing 12 of the actinic energy curing type ink-jet recording device 10, and by exchanging the cassette, it is possible to feed a seconding medium S having a different size. This recording medium accommodating section 20 can also be constructed so as to accommodate plural cassettes therein. The transporting section 30 is provided with a feed roll 32 coming into contact with the tip of an insertion direction of the recording medium S within the accommodating cassette 22 as set in the casing 12. In addition, the transporting section 30 is provided with transporting roll pairs 34, 36 for transporting the recording medium S as drawn out by the feed roll 32 into the transporting and supporting section 40.

The transporting and supporting section 40 is provided with a transporting belt 42 which is tensioned and driven by three belt rolls 44*a*, 44*b* and 44*c*. The transporting belt 42 is driven in a direction from the upstream belt roll 44*b* to the downstream belt roll 44*c*; and the recording medium S is transported on an upper surface of the transporting belt 42, that is a placing surface, between the upstream belt roll 44*b* and the downstream belt roll 44*c*. At the position with which the tip of the recording medium S as transported from the transporting roll pair 36 of the transporting section 30 first comes into contact (the position of the upstream belt roll 44*b* in this embodiment), a corona electrostatic charger 46 is provided for the purpose of feeding a bias voltage between the recording medium S and a head unit 52. Furthermore, the corona electrostatic charger 46 is disposed to a degree that it does not come into contact with the recording medium S on the transporting belt 42 and in close vicinity to the transporting belt 42.

In addition, at the position at which the recording medium S is separated from the transporting belt 42 (the position of the downstream belt roll 44*c* in this embodiment), a static eliminator 48 is provided and disposed to a degree that it does not come into contact with the recording medium S on the transporting belt 42 and in close vicinity to the transporting belt 42. Incidentally, a substantially middle position between the upstream belt roll 44*b* and the downstream belt roll 44*c* is defined as an image recording position 42P.

In the image recording section 50, an electrostatic discharge type head unit 52 (its detailed construction and operation will be described later) is provided in such a manner that the tip of an ink injecting section thereof is located toward the transporting belt 42 at the image recording position 42P. A head driver 54 is connected to this head unit 52, controls a positive voltage on the basis of the foregoing bias voltage and controls the amount of discharge of the ink of each color. In the head unit 52, the ink feed section 70 is connected via an ink feed route 78, a head section ink circulating section 76 and a circulating route 74 for the purpose of circulating and feeding the ink. Incidentally, this ink feed section 70 may be constructed such that an ink cartridge is provided in a freely detachable manner.

Furthermore, an ultraviolet ray irradiating section 56 is disposed just behind the image recording position 42P and in the downstream side of the head unit 52, thereby giving strong energy necessary for putting the ink on the recording medium S and curing it immediately thereafter.

A separating claw 92 is disposed in the downstream side at the position at which the recording medium S is separated from the transporting belt 42 (the position of the downstream belt roll 44*c* in this embodiment), and the tip of the separating claw 92 facilitates the separation of the recording medium S from the transporting belt 42 in the vicinity of the downstream belt roll 44*c*. The tray 90 accommodates the recording medium S which has been separated from the transporting belt 42.

In the ultraviolet ray irradiating section 56, since as described previously, strong light for curing the ink is used, an exhaust cooling section 80 is disposed in an upper part within the casing 12 for the purpose of suppressing an increase of the temperature within the casing 12. As other constructions, the recording medium accommodating section 20 can be constructed as a cassette for feeding a recording material as wound around a roll. In this case, a cutter capable of cutting the recording material into a desired length is disposed in place of the feed roll 32 of the transporting section 30.

Next, this embodiment will be described along a series of operations.

Figure 2:
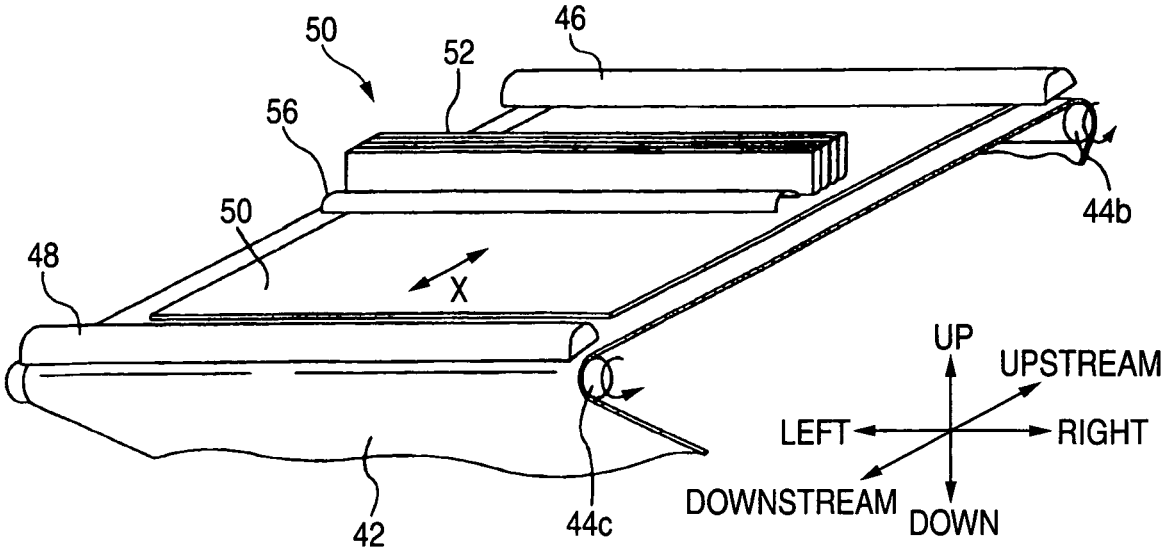
FIG. 2 is a partially enlarged schematic view that illustrates a transporting and supporting section of FIG. 1.

FIG. 2 is an enlarged oblique view of the image recording section 50 and the transporting and supporting section 40 of this embodiment.

The recording medium S which is fed from the recording medium accommodating section 20 is transported into the position of the upstream belt roll 44*b* in the transporting and supporting section 40. On the other hand, a high-voltage power source 46*a* (its polarity is properly set up depending upon the recording medium, the ink characteristics or the shape of the head) is connected to the corona electrostatic charger 46, and the recording medium S is electrostatically charged at this position of the upstream belt roll 44*b*. At this time, the conductive transporting belt 42 is earthed by the lower belt roll 44*a*, thereby acting as a bias voltage between the recording medium S and the head unit 52. In addition, at the image recording position 42P between the upstream belt roll 44*b* and the downstream belt roll 44*c*, the transporting belt 42 and the recording medium S are accompanied by electrostatic adsorption, and transporting is achieved in this intimate adhesion state at the image recording position 42P.

The recording medium S which is held on the transporting belt 42 by a uniform force by the action including electrostatic adsorption is provided for image drawing by the image recording section 50 at the point of time when its tip has reached the image recording position 42P. The head unit 52 of the image recording section 50 has discharge nozzles (hereinafter as referred to "ink discharge nozzles") over the widthwise direction of the transporting belt 42 and undergoes image recording adaptive to the transporting timing of the transporting belt 42. On this occasion, an ink is introduced into the head unit 52 from the ink feed section 70, and an image data is inputted in the head driver 54, thereby controlling the amount of discharge of the ink from the head unit 52. The ink which is fed from the ink feed section 70 via the ink feed route 78 is circulated during image recording via the head section ink circulating section 76 and the circulating route 74. As described later, the head unit 52 undergoes discharge control of the ink to be circulated within the head unit 52 by the control of an electrostatic force, thereby forming an image.

For the purpose of rapidly curing the ink as discharged on the recording medium and in an image formed state, the ultraviolet ray irradiating section 56 is disposed in the downstream side just behind the head unit 52 as describe previously. Its disposition is constructed such that only the ink which had been put on the recording medium S is irradiated and that the ink discharge nozzles of the head unit 52 are not irradiated. According to this construction, ink curing in the discharge nozzles is prevented from occurring. In particular, though it is effective to subject the transporting belt 42 to an antireflection treatment (for example, frosting and blackening treatments), it is also effective to subject other portions than the transporting belt 42 to such an antireflection treatment.

In this embodiment, a metal halide lamp is used as a light source of the ultraviolet ray irradiating section 56. Besides, any light source capable of generating actinic energy (specifically, ultraviolet region light and electron beams) may be employed. Also, ultraviolet region LED and ultraviolet region laser are enumerated.

As described previously, the static eliminator 48 is provided at the position at which the recording medium S is separated from the transporting belt 42 (in this embodiment, at the position of the downstream belt roll 44*c*) in the vicinity of the downstream belt roll 44*c* as disposed in the downstream side of the ultraviolet ray irradiating section 56. Furthermore, the static eliminator 48 separates the recording medium S from the transporting belt 42 in cooperation with the separating claw 92 which is also provided, and the recording medium S is sent out onto the tray 90.

A cleaning roll 45 comes into contact with the transporting belt 42 which has passed through the position of the downstream belt roll 44*c* and is rotated. This cleaning roll 45 has a viscous surface so as to eliminate dusts, ink scum and so on from the transporting belt 42 and is prepared for next image recording. Besides the cleaning roll 45, cleaning measures are proposed. Also, wiping up by non-woven fabrics or other measures may be employed.

With respect to the material quality of the transporting belt 42, since the transporting belt 42 is grounded via the downstream belt roll 44*c*, a conductive belt constructed of a steel belt or the like is applied. Besides, for the purpose of giving a degree of freedom to the material quality of the placing surface, an insulating material such as resins, for example, polyimides can be utilized in the placing surface side. In that case, there can be employed a construction that a conductive layer is provided on the back surface of the belt.

Next, the construction and operation of the electrostatic type ink-jet head which is used in this embodiment will be described.

Figure 3:
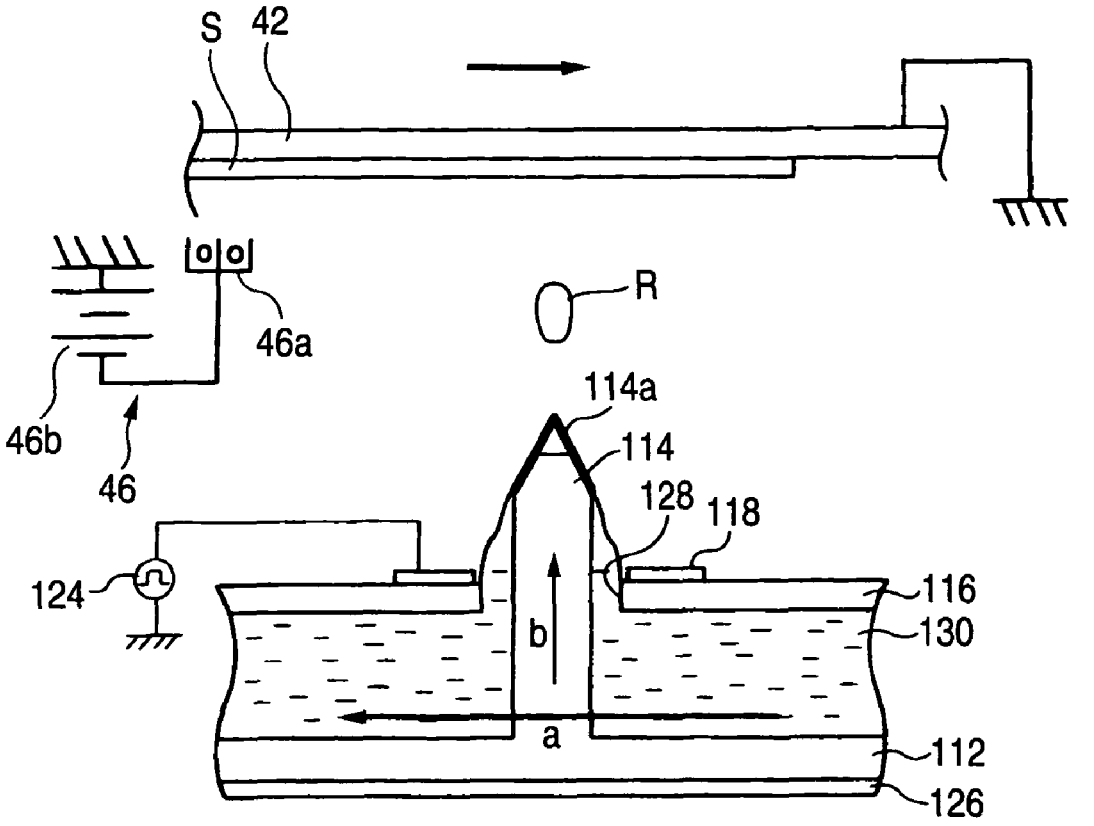
FIG. 3 is a typical cross-sectional view that illustrates a schematic construction of one example of an electrostatic ink-jet head according to the invention.

FIG. 3 is a typical cross-sectional view to show a schematic construction of one example of the electrostatic inkjet head of this embodiment.

Incidentally, in order to facilitate one to understand the explanation of a head portion, inversely to FIGS. 1 and 2, the discharge direction of the ink is shown in an upper part of the drawing in FIG. 3. In the case of this example, the ink is actually discharged downward the gravity direction.

An electrostatic ink-jet head 110 as shown in FIG. 3 discharges an ink due to an electrostatic force, thereby recording an image on the recording medium S corresponding to an image data. The electrostatic ink-jet head 110 is provided with a head substrate 112, an ink guide 114, an insulating substrate 116, a discharge electrode 118 and a signal voltage source 124. Furthermore, at an opposing position to which the ink is impacted, the transporting belt 42 which supports the recording medium S and becomes an opposing electrode and an electrostatic charge unit 46 of the recording medium S are disposed.

Incidentally, in the example as shown in FIG. 3, only the individual electrode which becomes one discharge measure constructing the ink-jet head 110 is conceptually shown. The number of the individual electrode may be one or more. Also, the individual electrode is not limited at all with respect to the physical disposition and so on. For example, it is possible to construct a line head by one-dimensionally or two-dimensionally disposing plural individual electrodes. Furthermore, the ink-jet head which is applied in the invention is adaptive to any of a monochromic mode or a color mode.

In the illustrated ink-jet head 110, the ink-jet guide 114 is made of an insulating resin-made flat plate with a prescribed thickness having a protrusive tip portion 114*a* and is disposed above the head substrate 112 for every individual electrode. Furthermore, the insulating substrate 116 is bored with a through-hole 128 at a position corresponding to the disposition of the ink guide 114. The ink guide 114 passes through the through-hole 128 as bored on the insulating substrate 116, and its tip portion 114*a* is protruded on the surface in the upper side of the insulating substrate 116 in the drawing, namely an upper part than the surface in the side of the recording medium S. Incidentally, a notch which becomes an ink guide groove for gathering the ink in the tip portion 114*a* due to a capillary phenomenon in the vertical direction in the drawing may be formed in the central portion of the ink guide 114.

The side of the tip portion 114*a* of the ink guide 114 is molded in a substantial triangle (or a trapezoid) such that it becomes gradually thin toward the side of the transporting belt 42 as an opposing electrode. Incidentally, it is preferable that a metal is vapor deposited in the tip portion (the most tip portion) 114*a* of the ink guide 114 from which the ink is discharged. The metal vapor deposition in the tip portion 114*a* of the ink guide 114 is not essential. However, the metal vapor deposition is preferable because there is brought an effect that the dielectric constant of the tip portion 114*a* of the ink guide 114 becomes substantially indefinite due to this metal vapor deposition, thereby likely generating a strong electric field. Incidentally, the shape of the ink guide 114 is not particularly limited so far as the ink can be fed into the tip portion 114*a* through the through-hole 128 of the insulating substrate 116. The tip portion 114*a* may be properly changed and, for example, it is not protrusive. Also, the tip portion 114*a* may be formed into a conventionally known shape as disclosed in the foregoing Patent Document 1 or the like.

The head substrate 112 and the insulating substrate 116 are disposed while being separated from each other in a prescribed gap, and an ink passage 130 which functions as an ink reservoir (ink chamber) for feeding an ink into the ink guide 114 is formed between the both. Incidentally, the ink which is used in the invention will be described later. At the time of recording, the ink is circulated in a prescribed direction (in the illustrated example, the ink goes from the right side to the left side within the ink passage 130) at a prescribed rate (for example, an ink flow of 200 mm/s) by an ink circulation mechanism as shown in FIG. 1 (the head section ink circulating section 76 and the circulating route 74). However, this ink circulation is not essential, and a structure from which the circulating route 74 is eliminated may be employed.

Incidentally, the dot side of the ink on the recording medium S is from approximately 6 μm to 10 μm.

Figure 4A:
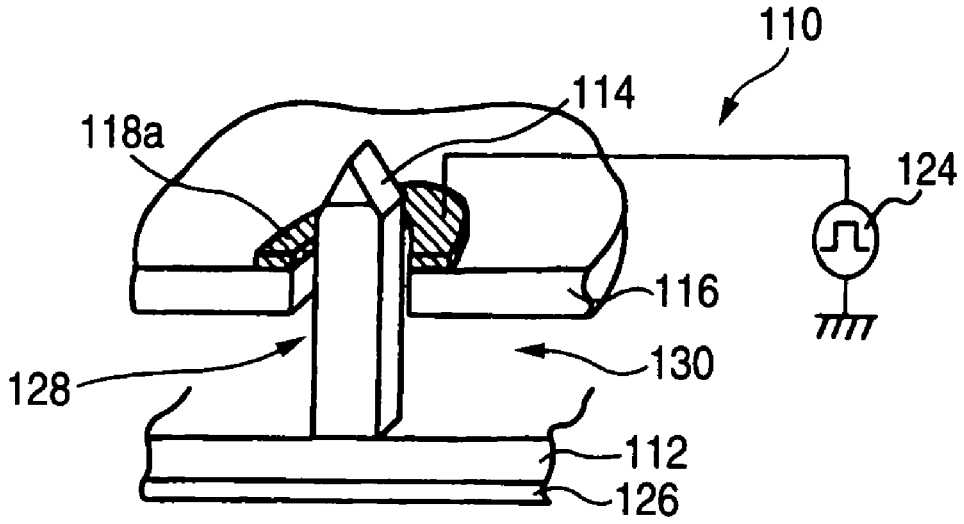
FIG. 4A is a typical oblique view that illustrates a schematic construction of one example of an individual electrode of an electrostatic ink-jet head according to the invention.

Furthermore, as shown in FIG. 4A, the discharge electrode 118 is disposed in a ring-like form, namely as a circular electrode 118*a* for every individual through-hole in the upper side of the insulating substrate 116 in the drawing, namely on the surface in the side of the recording medium S so as to surround the periphery of the through-hole 128 as bored on the insulating substrate 116. The discharge electrode 118 is connected to the single voltage source 124 capable of generating a pulse signal (a prescribed pulse signal, for example, 0 V of a low voltage level or +400 to 600 V of a high voltage level) corresponding to a discharge data (discharge signal) such as image data and printing data.

Figure 5A:
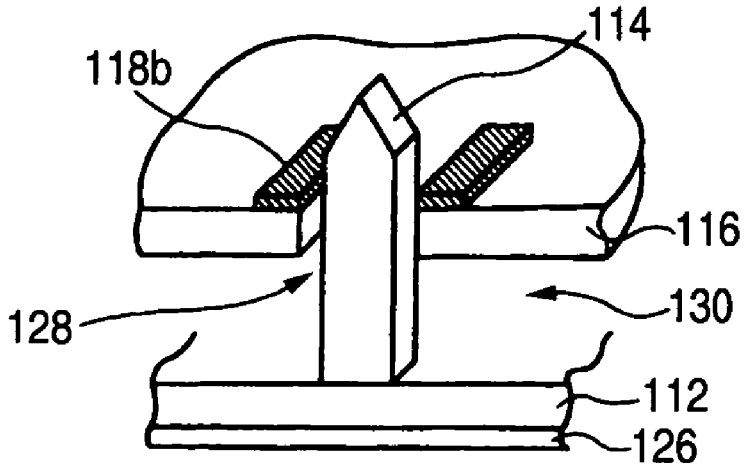
FIG. 5A is a typical oblique view that illustrates a schematic construction of another example of an individual electrode of an electrostatic ink-jet head according to the invention.
Figure 5B:
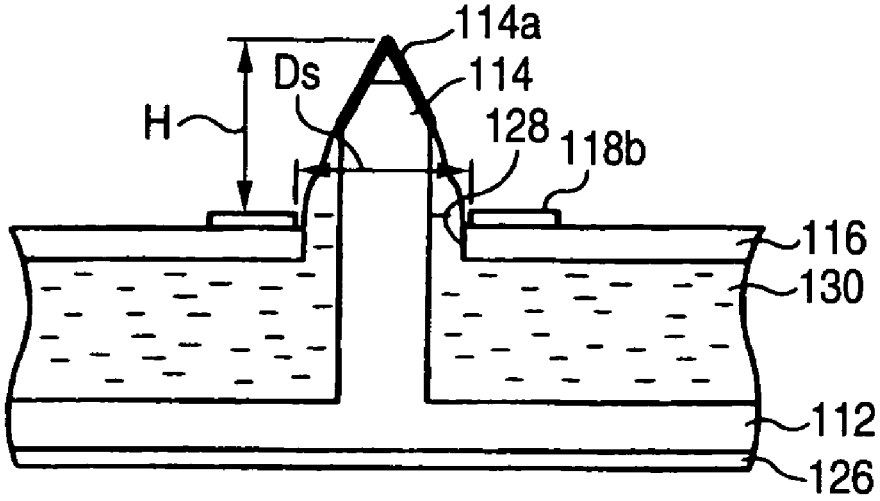
FIG. 5B is a typical cross-sectional view of FIG. 5A.

Incidentally, the discharge electrode 118 is not limited to the circular electrode 118*a* as shown in FIG. 4A but may be any shape including surrounding electrodes having various shapes to be disposed while being separated from each other so as to surround the periphery of the ink guide 114 and electrodes in parallel to be disposed on the both sides of the ink guide whole being separated from each other in an opposing manner. Furthermore, in the case of electrodes in parallel, it is preferable that the discharge electrode 118 is a substantially parallel electrode and can be formed as a parallel electrode 118*b* as shown in FIG. 5A. Incidentally, a parallel electrode and a substantially parallel electrode as shown in FIG. 5C and FIG. 5D as described later may be used as the electrode in parallel.

Figure 5C:
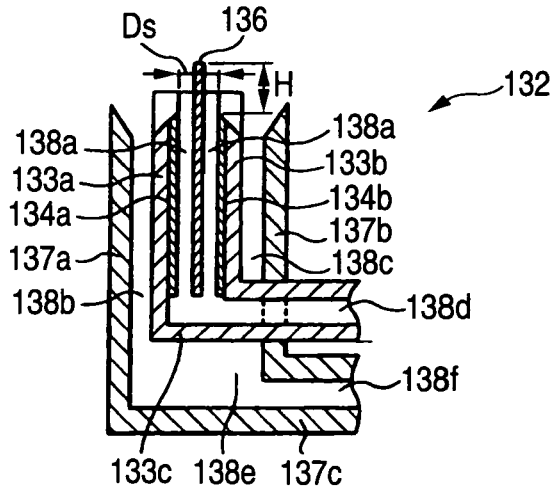
FIG. 5C is a typical oblique view that illustrates a schematic construction of a still other example of an individual electrode of an electrostatic ink-jet head according to the invention.
Figure 5D:
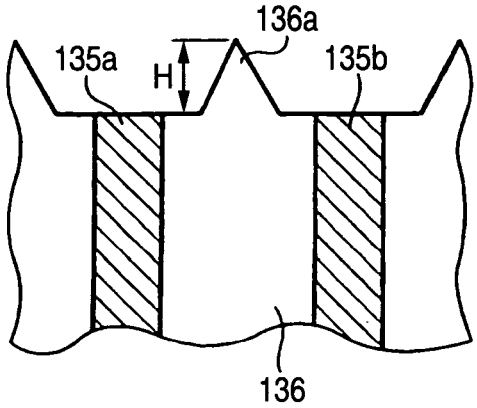
FIG. 5D is a typical partial longitudinal cross-sectional view of FIG. 5C.

The discharge electrode will be hereunder described while referring to the circular electrode 118*a* as shown in FIG. 4A as a representative example of the surrounding electrode and the parallel electrode 118*b* as shown in FIG. 5A and that as shown in FIG. 5C as a representative example of the electrode in parallel.

Furthermore, the transporting belt 42 as an opposing electrode is disposed at a position opposing to the tip portion 114*a* of the ink guide 114 and is constructed of an insulating sheet on the surface in the side of the ink guide 114 and an electrode substrate on the back surface thereof, both of which are not illustrated, with the electrode substrate being grounded. Moreover, the recording medium S is supported on the surface in the lower side of the transporting belt 42 in the drawing, namely the surface in the side of the ink guide 114, namely the surface of the insulating sheet and electrostatically adsorbed.

Here, at least at the time of recording, the recording medium S as held by the transporting belt 42 is kept in an electrostatically charged state of a prescribed negative high voltage having a reverse polarity to a high voltage (pulse voltage) to be applied to the discharge electrode 118, for example, −1.5 kV, by the electrostatic charge unit 46. As a result, the recording medium S is negatively electrostatically charged by the electrostatic charge unit 46 and is not only always biased with a negative high voltage against the discharge electrode 118 but also electrostatically adsorbed on the insulating sheet of the transporting belt 42.

Here, the electrostatic charge unit 46 has a scorotron electrostatic charger 46*a* for electrostatically charging the recording medium S with a negative high voltage and a bias voltage source 46*b* for feeding a negative high voltage to the scorotron electrostatic charger 46*a* (an electrostatic charge potential of the recording medium is controlled by adjusting a grid voltage). Incidentally, the electrostatic charge measure of the electrostatic charge unit 46 which is used in the invention is not limited to the scorotron electrostatic charger 46*a*, and various discharging measures such as a scorotron electrostatic charger, a solid charger, and a discharge needle can be employed.

Incidentally, in this description, though the transporting belt 42 as an opposing electrode is constructed of an electrode substrate and an insulating sheet and the recording medium S is electrostatically adsorbed on the surface of the insulating sheet by electrostatically charging it with a negative high voltage by the electrostatic charge unit 46, it should not be construed that the invention is limited to this example. There may be employed an example in which the transporting belt 42 is constructed of only an electrode substrate, the transporting belt 42 is connected to a bias voltage source of a negative high voltage, the negative high voltage is always biased, and the recording medium S is electrostatically adsorbed on the surface of the transporting belt 42.

Furthermore, electrostatic adsorption of the recording medium S on the transporting belt 42 and electrostatic charge of the recording medium S with a negative high voltage or application of a negative bias high voltage to the transporting belt 42 may be carried out by separate negative high voltage sources. Supporting of the recording medium S by the transporting belt 42 is not limited to the electrostatic adsorption of the recording medium S, and other supporting methods or supporting measures may be employed.

Next, another example of the electrostatic ink-jet head using an electrode in parallel represented by a parallel electrode will be described.

An electrostatic ink-jet head 132 as shown in FIG. 5C and FIG. 5D is provided with insulating supporting substrates 133*a* and 133*b* as disposed opposite to each other while being separate from each other in a prescribed gap; parallel electrodes 134*a* and 134*b* which are supported by the inner surfaces of the insulating supporting substrates 133*a* and 133*b*, respectively, partition walls 135*a* and 135*b* which are disposed on the both sides in a direction orthogonal to the opposing direction of the respective insulating supporting substrates 133*a* and 133*b*; an ink guide 136 which is supported by the partition walls 135*a* and 135*b* and is disposed in parallel between the parallel electrodes 13*a* and 134*b*; outer wall plates 137*a* and 137*b* which are disposed on the outer surfaces of the insulating supporting substrates 133*a* and 133*b*, respectively while being separated from each other in a prescribed gap; and an ink passage 138 composed of an ink feed passage 138*a* as formed among the partition walls 135*a* and 135*b*, the parallel electrodes 134*a* and 134*b* and the insulating supporting substrates 133*a* and 133*b* and ink recovery passages 138*b* and 138*c* as formed between the insulating supporting substrates 133*a* and 133*b* and the outer wall plates 137*a* and 137*b*.

One-sided end surfaces of the insulating supporting substrates 133*a* and 133*b* (end surfaces in the lower side in the drawing) are connected to each other via an insulating supporting substrate 133*c*, and the other end surfaces (end surfaces in the upper side in the drawing) are opened. Accordingly, the one-sided end surface of the ink feed passage 138*a* (end surface in the lower side in the drawing) is plugged by the insulating supporting substrate 133*c*, and a feed opening 138*d* communicating with the external ink circulation passage is disposed in the vicinity of the plugged end. Furthermore, one-sided end surfaces of the outer wall plates 137*a* and 137*b* (end surfaces in the lower side in the drawing) are connected to each other via an outer wall plate 137*c* and plugged; and the other end surfaces (end surfaces in the upper side in the drawing) are opened. Accordingly, the ink recovery passages 138*b* and 138*c* are communicated with each other via an ink recovery passage 138*e* which is formed between the insulating supporting substrate 133*c* and the outer wall plate 137*c*, and the ink recovery passage 138*e* is connected to a recovery opening 138*f* communicating with the external ink circulation passage.

The ink guide 136 divides the ink feed passage 138*a* into two parts and is made of an insulating resin-made flat plate or film having a prescribed thickness, which is provided with a protrusive tip portion 136 protruding from the opened ends of the insulating supporting substrates 133*a* and 133*b*, accordingly the opened ends of the parallel electrodes 134*a* and 134*b*, in other words the opened end of the ink feed passage 138*a*; and the both sides of the ink guide 136 are supported by the partition walls 135*a* and 135*b*, respectively. The tip portion 136*a* of the ink guide 136 is molded in a substantial triangle (or a trapezoid) such that it becomes gradually thin toward the side of a non-illustrated recording medium similar to the tip portion 114*a* of the ink guide 114 as shown in FIG. 5A.

The ink as fed into the ink feed passage 138*a* from the external ink circulation passage via the feed opening 138*d* moves within the ink feed passage 138*a* as divided into two parts by the ink guide 136 toward its opened end due to a capillary phenomenon or the like and rises upward in the drawing along the ink guide 136. A part of the ink which has risen is gathered in the tip portion 136*a* of the ink guide 136, and the remaining ink overflows from the insulating supporting substrates 133*a* and 133*b* and flows into the ink recovery passages 138*b* and 138*c*, respectively. The separated inks join in the ink recovery passage 138*e*, and the joined ink is recovered from the recovery opening 138*f* into the external ink circulation passage.

When a prescribed pulse voltage is applied to the parallel electrodes 134*a* and 134*b*, the ink as fed into the tip portion 136*a* of the ink guide 136 flies as an ink droplet toward a non-illustrated recording medium.

Figure 4B:
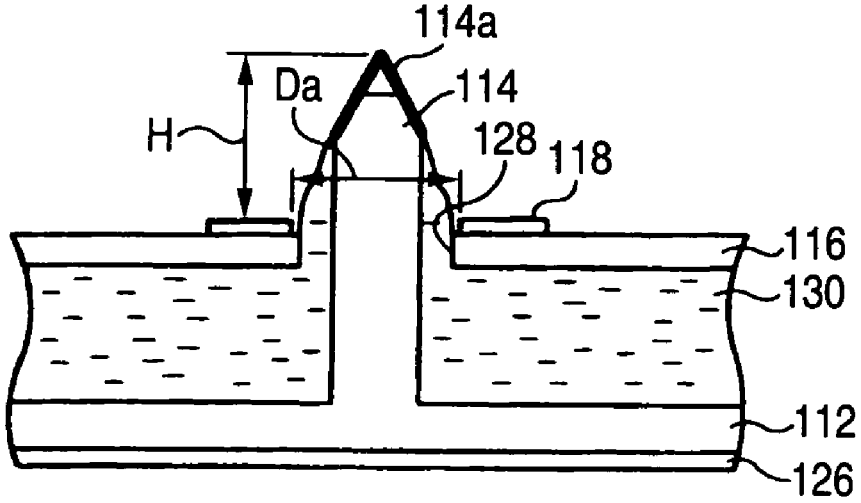
FIG. 4B is a typical cross-sectional view of FIG. 4A.

Now, in the invention, when the discharge electrode 118 is a surrounding electrode represented by the ring-like circular electrode 118*a* as shown in FIG. 4A, as shown in FIG. 4B, a ratio (Da/H) of an inside diameter Da of the surrounding electrode (circular electrode) to a distance from the discharge electrode (surrounding electrode) 118 to the tip of the ink guide 114 as protruded in the side of the recording medium S, namely a distance H from the surface of the circular electrode 118*a* to the tip portion 114*a* of the ink guide 114 must be limited to from 1/0.5 to 1/2. It is preferable that this ratio is limited to from 1/0.7 to 1/1.7. Here, as the inside diameter Da of a surrounding electrode in which the inside diameter thereof is not constant as in substantially circular electrodes or elliptical electrodes, an effective inside diameter which can be considered substantially as an inside diameter, such as a minimum inside diameter or an average inside diameter, may be employed.

Furthermore, in the invention, when the discharge electrode 118 is an electrode in parallel represented by the parallel electrode 118*a* as shown in FIG. 5A or the parallel electrodes 134*a* and 134*b* as shown in FIGS. 5C and 5D, similarly, as shown in FIG. 5B or FIG. 5C, a ratio (Ds/H) of a gap Ds between the parallel electrodes 118 or between the parallel electrodes 134*a* and 134*b* to a distance H from the discharge electrode (surrounding electrode) 118 to the tip of the ink guide 114 as protruded in the side of the recording medium S, namely a distance H from the surface of the parallel electrode 118*b* or the opened end surface of each of the parallel electrodes 134*a* and 134*b* to the tip portion 114*a* of the ink guide 114 must be limited to from 1/0.7 to 1/2.8. It is preferable that this ratio is limited to from 1/1.0 to 1/2.4. Here, as the gap Ds between the electrodes in parallel in which the gap is not constant as in substantially parallel electrodes, an effective gap which can be considered substantially as a gap, such as an average gap, may be employed.

Figure 6:
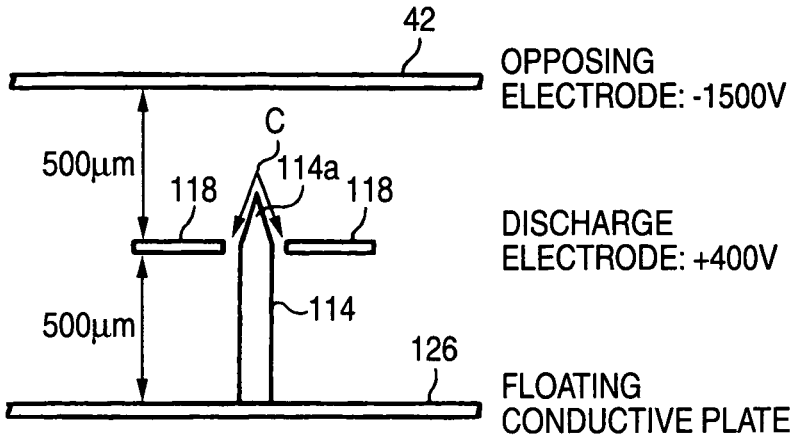
FIG. 6 is a conceptual view that illustrates an actual model of an individual electrode of an individual electrode of an electrostatic ink-jet head according to the invention.

Here, in the invention, by using an actual model in which the discharge electrode 118 is disposed around the periphery of the ink guide 114 as a center and the transporting belt 42 is disposed opposing to the tip portion 114*a* of the ink guide 114 as shown in FIG. 6, the present inventor determined an electric field strength (V/m) of the discharging section, namely the tip portion 114*a* of the ink guide 114 by changing the distance H from the surface of the discharge electrode 118 to the tip portion 114*a* of the ink guide 114, namely the amount of the protruded tip portion 114*a* of the ink guide 114 (hereinafter referred to as "amount of protrusion"). At this time, the gap between the discharge electrode 118 and the transporting belt 42 was set up at 500 μm; a negative high voltage of −1,500 V was applied as a bias voltage to the transporting belt 42; and a discharge voltage of the discharge electrode 118 was set up at +400 V. Furthermore, with respect to the electrode structure of the discharge electrode 118, the circular electrode 118*a* having an inside diameter (Da) of 200 μm was used, and the amount of protrusion was changed from 75 μm to 250 μm. Incidentally, the application of a negative bias high voltage of −1,500 V to the transporting belt 42 is equivalent to electrostatic charge of a negative high voltage of −1,500 V of the recording medium S as electrostatically adsorbed on the transporting belt 42.

Figure 7:
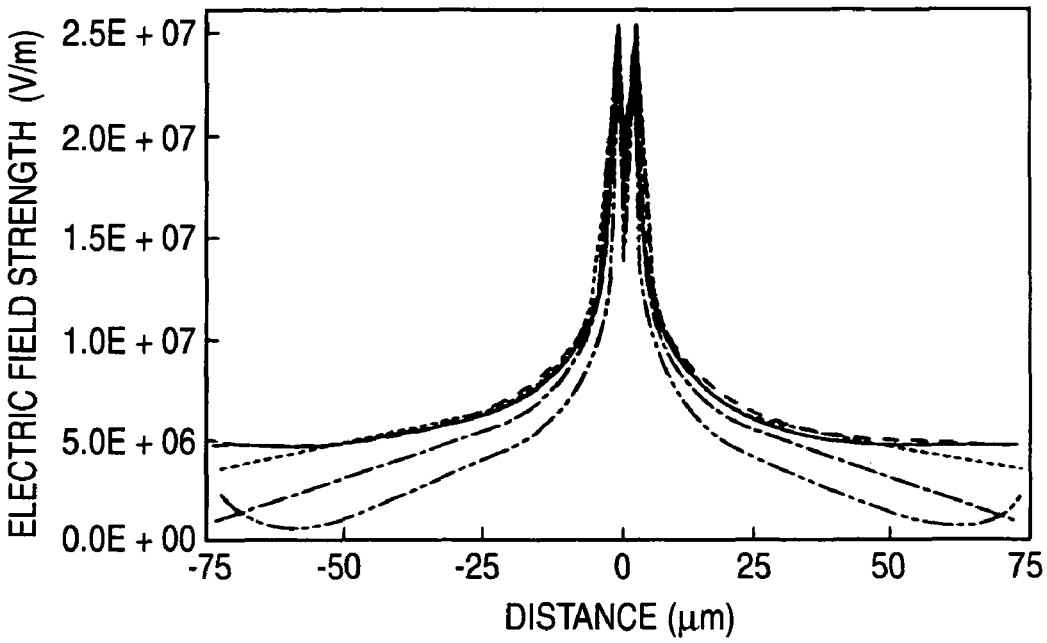
FIG. 7 is a graph that illustrates the relationship between an electric field strength and a distance from the center of the tip of an ink guide in the actual model as illustrated in FIG. 6.

The thus obtained results are shown in FIG. 7.

Here, while not illustrated, the ink guide 114 is constructed of a ceramic (specific dielectric constant ϵ: 20) having a tip angle of 45° and a thickness of 75 μm. The abscissa of FIG. 7 shows a distance along the inclination from the center of the tip portion 114*a* of the ink guide 114 as shown by an arrow C in FIG. 6.

It is noted from FIG. 7 that when the amount of protrusion H of the ink guide 114 is 200 μm, the electric field strength exceeds $2.5\times10^{+7}$ V/m and becomes maximum. That is, it is noted from FIG. 7 that when the inside diameter of the circular electrode 118*a* is constant and the amount of protrusion H is changed, an optimal amount of protrusion H of the ink guide 114 is present. This demonstrates that in the case of the circular electrode 118*a*, when the ratio of the amount of protrusion H to the inside diameter Da is about 1, the electric field strength becomes maximum.

These results demonstrate that in the case of the circular electrode 118*a* as shown in FIG. 6, when an electric field strength at which the ink discharge can be carried out surely and stably is not more than the maximum electric field strength as shown in FIG. 7, it is possible to make the voltage to be applied to the circular electrode 118*a* low.

Then, the present inventor determined a pulse voltage necessary for carrying out the ink discharge surely and stably (lowest discharge voltage) by changing the pulse voltage (discharge voltage) to be applied to the circular electrode 118*a* in a prescribed amount of protrusion H under the same conditions as in the case of FIG. 7, except that in the discharge structure (individual electrode structure) having the construction as shown in FIG. 6, the circular electrode 118*a* having an inside diameter of 150 μm was used as the electrode structure of the discharge electrode 118 and that the amount of protrusion H was changed from 50 μm to 330 μm.

Figure 8A:
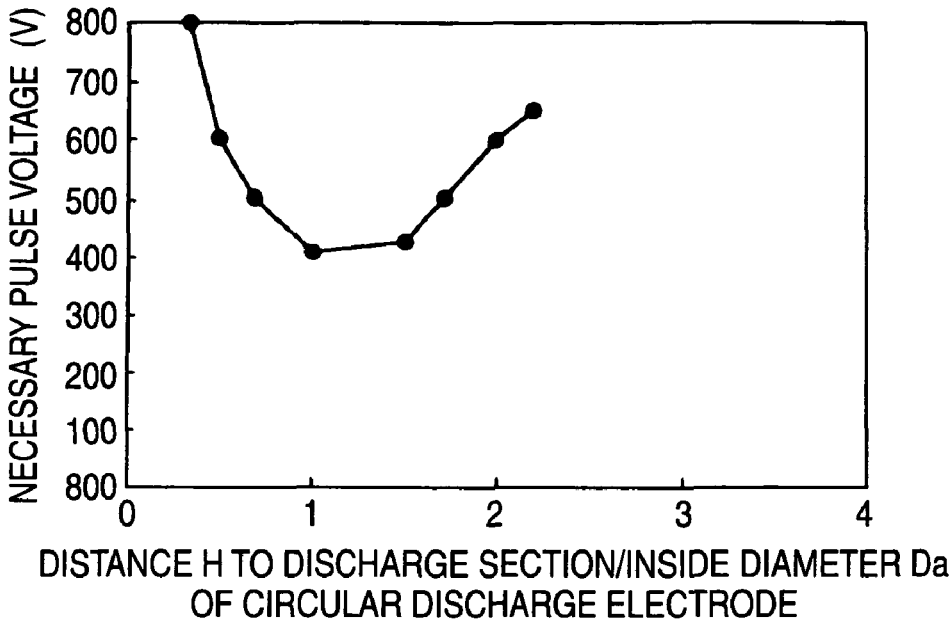
FIG. 8A is a graph that illustrates the relationship between a necessary pulse voltage and a ratio of a distance to a discharge section to an inside diameter of a circular discharge electrode in the actual model as illustrated in FIG. 6.

The results obtained are shown in FIG. 8A.

It is noted from FIG. 8A that in a ratio (H/Da) of the distance (amount of protrusion) H to the discharge section to the inside diameter Da of the circular discharge electrode of 1.0, even when a metal film or the like is not formed in the tip portion 114*a* of the ink guide 114, the necessary pulse voltage becomes minimum as 400 V so that even when this ratio is small or large, the necessary pulse voltage becomes high.

Now, in the invention, the ratio H/Da) of the distance H to the discharge section to the inside diameter Da of the circular discharge electrode is limited to from 0.5 to 2. The reason for this is as follows. That is, this is because in the electrostatic ink-jet head, taking into consideration safety, individual electrode structure, consumed current and so on in view of the resistance to pressure of a semiconductor element or a semiconductor device such as IC which constructs a drive circuit for driving individual electrodes, an upper limit of the pulse voltage which can be applied to the discharge voltage 118 is about 600 V, and therefore, it is noted from FIG. 8A that when this ratio (H/Da) falls outside the foregoing limited range, the necessary pulse voltage exceeds 600 V. Incidentally, the ratio (H/Da) is preferably from 0.7 to 1.7. In this way, it is possible to make the pulse voltage which can be applied to the discharge electrode 118 lower as 500 V.

Figure 8B:
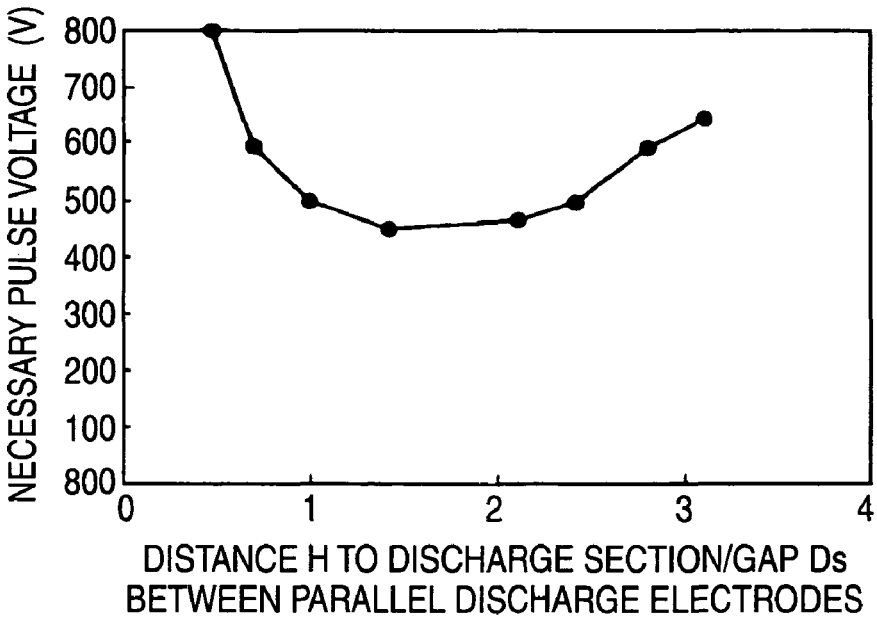
FIG. 8B is a graph that illustrates the relationship between a necessary pulse voltage and a ratio of a distance to a discharge section to a gap between parallel discharge electrodes in the actual model as illustrated in FIG. 6.

Furthermore, the results obtained in the case of changing the discharge electrode 118 from the circular electrode 118*a* to the parallel electrode 118*b* are shown in FIG. 8B.

It is noted from FIG. 8B that in a ratio (H/Ds) of the distance (amount of protrusion) H to the discharge section to the gap Ds between the parallel discharge electrodes of 1.4, even when a metal film or the like is not formed in the tip portion 114*a* of the ink guide 114, the necessary pulse voltage becomes minimum as 450 V so that even when this ratio is small or large, the necessary pulse voltage becomes high.

Now, in the invention, the ratio (H/Da) of the distance H to the discharge section to the gap Ds between the parallel discharge electrodes is limited to from 0.7 to 2.8. The reason for this is as follows. That is, this is because in the electrostatic ink-jet head, taking into consideration safety, individual electrode structure, consumed current and so on in view of the resistance to pressure of a semiconductor element or a semiconductor device such as IC which constructs a drive circuit for driving individual electrodes, an upper limit of the pulse voltage which can be applied to the discharge voltage 118 is about 600 V, and therefore, it is noted from FIG. 8B that when this ratio (H/Ds) falls outside the foregoing limited range, the necessary pulse voltage exceeds 600 V. Incidentally, the ratio (H/Ds) is preferably from 1.0 to 2.4. In this way, it is possible to make the pulse voltage which can be applied to the discharge electrode 118 lower as 500 V.

In the light of the above, in the invention, since the ratio of the distance to the discharge section to the inside diameter of the circular discharge electrode or the gap between the parallel discharge electrodes is made to fall the foregoing proper limited range, it is possible to design to make the discharge voltage low; it is possible to expand choices of the material quality of the ink guide such as use of a low dielectric constant material; and it is possible to expand choices of the tip structure of the ink guide.

The electrostatic ink-jet head according to the invention is basically constructed as described previously. The action of the electrostatic ink-jet head of the invention will be hereunder described while representing the operation of the ink-jet head 110 as shown in FIG. 3.

In the ink-jet head 110 as shown in FIG. 3, at the time of recording, the ink is circulated within the ink passage 130 in a direction as shown by an arrow a in FIG. 3, namely from the right side to the left side by an ink circulation mechanism including a non-illustrated pump and the like. At this time, the recording medium S which is electrostatically adsorbed on the transporting belt 42 is electrostatically charged with a negative high voltage, for example, −1,500 V.

Here, when a pulse voltage is not applied to the discharge electrode 118 or a pulse voltage to be applied is in a low voltage level (0 V), a voltage (potential) between the discharge electrode 118 and the transporting belt 42 (recording medium S) is, for example, 1,500 V, a value of which is corresponding to the bias voltage, an electric field strength in the vicinity of the tip portion 114*a* of the ink guide 114 is low; and the ink does not fly out from the tip portion 114*a* of the ink guide 114, namely it is not discharged as an ink droplet R. However, at this time, due to a capillary phenomenon or the like, a part of the ink within the ink passage 130 passes through the through-hole 128 of the insulating substrate 116, rises in a direction as shown by an arrow b in FIG. 3, namely from the lower side to the upper side of the insulating substrate 116 and is fed into the tip portion 114*a* of the ink guide 114.

On the other hand, when a pulse voltage of a high voltage level (for example, from +400 to 600 V) is applied to the discharge electrode 118, a voltage of from 400 to 600 V, a value of which is corresponding to the pulse voltage, is superposed on a voltage of 1,500 V, a value of which is corresponding to the bias voltage, whereby a voltage (potential) between the discharge electrode 118 and the transporting belt 42 (recording medium S) becomes high as from 1,900 V to 2,100 V. Thus, the electric field strength in the vicinity of the tip portion 114*a* of the ink guide 114 becomes high. At this time, the ink which has risen along the ink guide 114 and reached the tip portion 114*a* in an upper part of the insulating substrate 116 flies out as the ink droplet R from the tip portion 114*a* of the ink guide 114 due to an electrostatic force and is attracted by the transporting belt 42 (recording medium S) as biased with, for example, −1,500 V to attach onto the recording medium S.

Here, in the invention, since with respect to the ratio (H/Da or H/Ds) of the amount of protrusion H of the tip portion 114*a* of the ink guide 114 to the inside diameter Da (circular electrode 118*a*) or the gap Ds (parallel electrode 118*b*) of the discharge electrode 118, H/Da and H/Ds fall within the proper ranges of from 0.5 to 2 and from 0.7 to 2.8, respectively, even when the pulse voltage to be applied to the discharge electrode 118 is not more than about 600 V, it is possible to realize sure and stable discharge of the ink.

In this way, by forming and recording dots on the recording medium S by discharging the ink corresponding to an image data while relatively moving the ink-jet head 110 and the recording medium S as supported on the transporting belt 42, an image corresponding to the image data can be recorded on the recording medium S.

Incidentally, in the foregoing electrostatic ink-jet head 110, the discharge electrode 118 having a single-layered electrode structure such as the circular electrode 118*a* or the parallel electrode 118*b* is disposed on the upper surface of the insulating substrate 116 in the drawing. However, it should not be construed that the invention is limited thereto. The discharge electrode 118 may be disposed on the lower surface of the insulating substrate 116 or may be constructed of a double-layered electrode structure in which the discharge electrode 118 is disposed on the both the upper and lower surfaces of the insulating substrate 116.

Figure 9A:
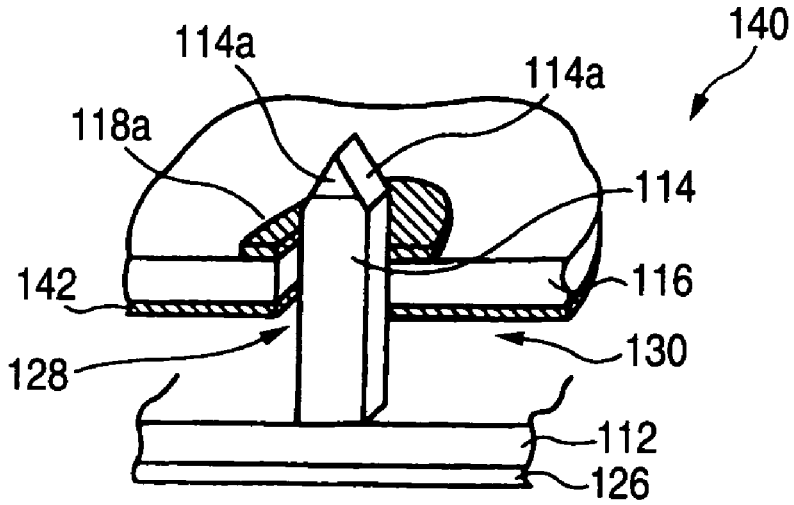
FIG. 9A is a typical oblique view that illustrates a schematic construction of other example of an individual electrode of an electrostatic ink-jet head according to the invention.

FIG. 9A is a schematic view of an electrostatic ink-jet head 140 having a discharge electrode of a double-layered electrode structure of another embodiment of the invention.

The ink-jet head 140 as shown in FIG. 9A has a construction the same as the ink-jet head 110 as shown in FIG. 4A, except that a second drive electrode 142 is provided on the lower surface of the insulating substrate 116 in the drawing. Thus, the same constructive elements are given the same reference symbols, their descriptions are omitted, and differences are mainly described.

In the ink-jet head 140 as shown in FIG. 9A, the discharge electrode 118 is constructed so as to interpose the insulating substrate 116 by a double-layered electrode structure composed of the circular electrode 118*a* to be disposed on the upper surface in the drawing as a first drive electrode (hereinafter referred to as "first drive electrode") and a second drive electrode 142 to be disposed on the lower surface in the drawing. Here, the first drive electrode 118*a* is provided in a ring-like form on the upper surface of the insulating substrate 116 for every individual electrode so as to surround the periphery of the through-hole 128 as bored on the insulating substrate 116. Furthermore, the second drive electrode 142 is provided in a sheet-like form on the lower surface of the insulating substrate 116 common among all of the individual electrodes exclusive of the portion of the through-hole 128 as bored on the insulating substrate 116 and is always biased with a high voltage at the time of recording.

Figure 9B:
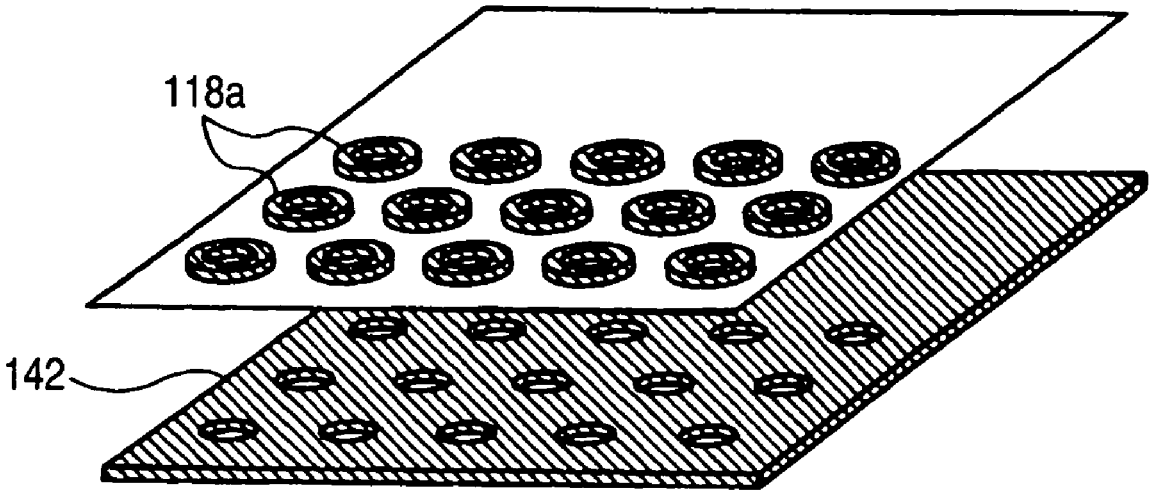
FIG. 9B is a typical oblique view of one example that illustrates the disposition of first and second drive electrodes which are used in the individual electrode as illustrated in FIG. 9A.

For example, as shown in FIG. 9B, in the case where the ink-jet head 140 is provided with fifteen individual electrodes, the ink-jet head 140 is constructed in such a manner that five individual electrodes are arranged per line and that three lines are disposed. In the ink-jet head 140, discharge or non-discharge of the ink is controlled by the first drive electrode 118*a* and the second drive electrodes 142. Incidentally, in the ink-jet head 140 of this embodiment, though a double-layered electrode structure composed of the first drive electrode 118*a* and the second drive electrode 142 is employed, it should not be construed that the invention is limited thereto. A drive electrode structure composed of more than two layers may be employed.

The disposition of the first drive electrode 118*a* and the second drive electrode 142 will be hereunder described. The first drive electrode 118*a* must be disposed in the side of the insulating substrate 116 than the ink passage 130. Furthermore, the second drive electrode 142 must be disposed in the side of the head substrate 112 than the first drive electrode 118*a*. For example, in the case where the first drive electrode 118 is disposed on the upper surface of the insulating substrate 116 in the drawing, the second drive electrode 142 may be disposed on the lower surface of the insulating substrate 116 in the drawing or may be disposed inside the heat substrate 112.

In the ink-jet head 140 of this embodiment having the discharge electrode 118 of such a double-layered electrode structure, for example, it is possible to control discharge or non-discharge of the ink (ink droplet R) by always biasing the second drive electrode 142 with a prescribed positive voltage, for example, +600 V and switching the first drive electrode 118*a* to a grounded state or a high impedance state corresponding to an image data. That is, in the ink-jet head 140, when the first drive electrode 118*a* is in a grounded state, the electric field strength in the vicinity of the tip portion 114*a* of the ink guide 114 is low, and the ink does not fly out from the tip portion 114*a* of the ink guide 114. On the other hand, when the first drive electrode 118*a* is in a high impedance state, the electric field strength in the vicinity of the tip portion 114*a* of the ink guide 114 becomes high, and the ink as fed into the tip portion 114*a* of the ink guide 114 flies out from the tip portion 114*a* due to an electrostatic force.

In this case, since the ratio of the amount of protrusion (H) of the ink guide 114 to the inside diameter (Da) of the first drive electrode 118*a* is made to fall within the proper limited range of the invention, even when the bias voltage to be applied to the second drive electrode 142 is not more than about 600 V, it is also possible to realize sure and stable ink discharge. Incidentally, the ratio of the amount of protrusion (H) of the ink guide 114 to the inside diameter of the though-hole of the second drive electrode 142 may be made to fall within the proper limited range of the invention, too.

According to this embodiment, by such a construction, switching of a high voltage is not performed at the time of recording an image so that a large electric power is not consumed for switching. Thus, even in an ink-jet head which is required to have high definition and high speed, the consumed electric power can be largely reduced. In addition, even in the case where individual electrodes and drive circuits are mounted in a physically extremely high density, there are brought advantages that danger of an electric discharge is scarcely presented and that both high-density mounting and high voltage can be realized safely.

Incidentally, though in the foregoing electrostatic ink-jet head 140, the second drive electrode 142 in a sheet-like form common among all of the individual electrodes is used, it should not be construed that the invention is limited thereto. A circular electrode may be used as the second drive electrode for every individual electrode.

In addition, as a control method in the case where the first drive electrode and the second drive electrode each uses a circular electrode for every individual electrode, the pulse voltage to be applied to the first drive electrode may be commonly applied to the second drive electrode. In this case, as compared with a single-layered drive electrode, since a line of electric force from the first drive electrode and a line of electric force from the second drive electrode are added so that the electric field strength in the tip proportion of the ink guide becomes high, it is possible to make a pulse voltage value to be applied to each of the drive electrodes low.

Figure 10A:
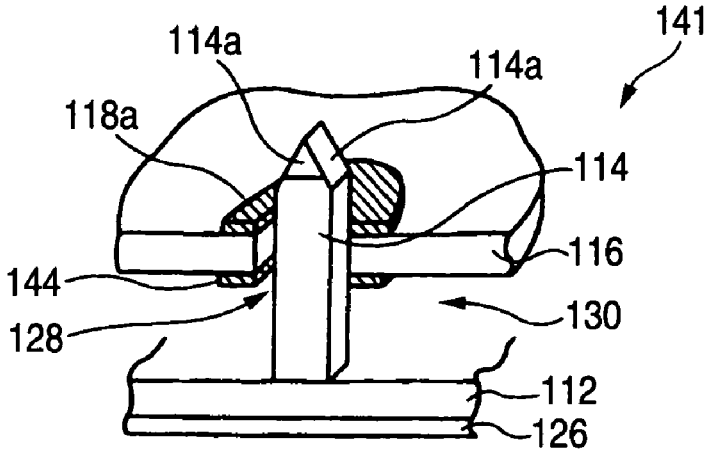
FIG. 10A is a typical oblique view that illustrates a schematic construction of other example of an individual electrode of an electrostatic ink-jet head according to the invention.

FIG. 10A is a schematic view of an electrostatic ink-jet head 141 having a discharge electrode of a double-layered electrode structure of a still other embodiment of the invention.

The ink-jet head 141 as shown in FIG. 10A has a construction the same as the ink-jet head 140 as shown in FIG. 9A, except that a second drive electrode 144 composed of a circular electrode for every individual electrode is provided on the lower surface of the insulating substrate 116 in the drawing in place of the second drive electrode 142 in a sheet-like form which is common among all of the individual electrodes. Thus, the same constructive elements are given the same reference symbols, their descriptions are omitted, and differences are mainly described.

Figure 10B:
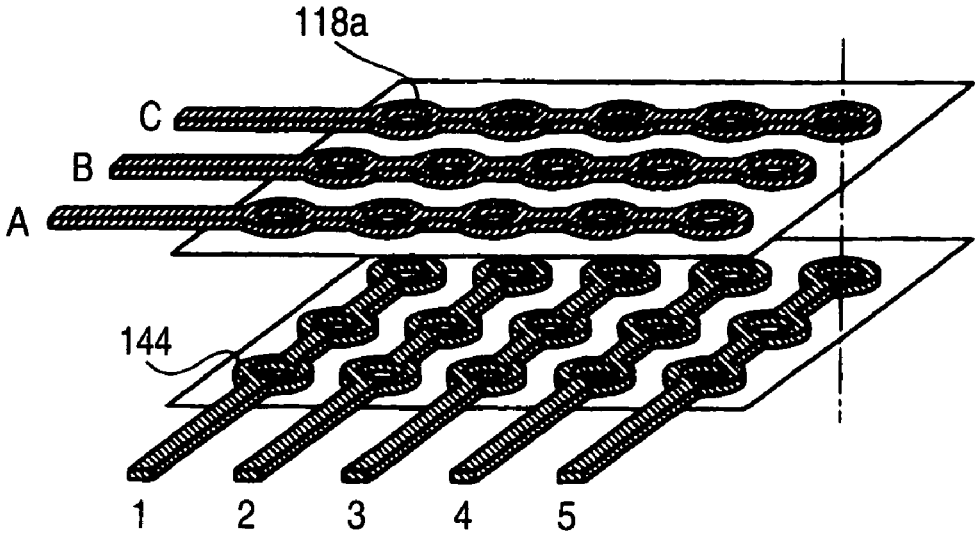
FIG. 10B is a typical oblique view of one example that illustrates the disposition of first and second drive electrodes which are used in the individual electrode as illustrated in FIG. 10A.

In the ink-jet head 141 as shown in FIG. 10A, the discharge electrode 118 is constructed so as to interpose the insulating substrate 116 by a double-layered electrode structure in which the first drive electrode 118*a* composed of a circular electrode to be disposed on the upper surface in the drawing and the second drive electrode 144 composed of a circular electrode to be disposed on the lower surface in the drawing are provided. Here, the first drive electrode 118*a* is provided in a ring-like form for every individual electrode so as to surround the though-hole 128 of the insulating substrate 116. Then, as shown in FIG. 10B, the plural first drive electrodes 118*a* as disposed in a line direction (major transporting direction) are connected to each other. On the other hand, the second drive electrode 144 is provided in a ring-like form for every individual electrode so as to surround the though-hole 128 of the insulating substrate 116. Then, as shown in FIG. 10B, the plural second drive electrodes 144 as disposed in a row direction (subsidiary transporting direction) are connected to each other.

In the case of this embodiment, at the time of recording, only one first drive electrode 118*a* is driven in a high voltage level or a high impedance state ("ON" state), and all of the remaining first drive electrodes 118*a* are driven in a grounded level (grounded state: "OFF" state). Furthermore, all of the second drive electrodes 144 are driven in a high voltage level or a grounded level corresponding to an image data. Incidentally, as another embodiment, the first drive electrode 118*a* and the second drive electrode 144 may be driven in a reverse state, respectively.

As described previously, the first drive electrode 118*a* and the second drive electrode 144 are constructed so as to have a double-layered electrode structure and disposed in a matrix state. By the first drive electrode 118*a* and the second drive electrode 144, discharge or non-discharge of the ink in each individual electrode is controlled. That is, in the case where the first drive electrode 118*a* is in a high voltage level or in a floating state and the second drive electrode 144 is in a high voltage level, when either one of the first drive electrode 118*a* or the second drive electrode 144 is in a grounded state, the ink is not discharged.

FIG. 10B is a conceptual view of one example to express the disposition of the first drive electrode 118*a* and the second drive electrode 144. As shown in the FIG. 10B, in the case where the ink-jet head 141 is provided with fifteen individual electrodes, the fifteen individual electrodes are disposed in such a manner that five (1, 2, 3, 4 and 5) individual electrodes are arranged per line in the major transporting direction and that three lines (A, B and C) are disposed in the subsidiary transporting direction. At the time of recording, the five first drive electrodes 118*a* as disposed in the same line are driven simultaneously and in the same voltage level. Similarly, the three second drive electrodes 144 as disposed in the same row are driven simultaneously and in the same voltage level.

Accordingly, in the electrostatic ink-jet head 141 of this embodiment, plural individual electrodes can be two-dimensionally disposed in the line direction and the row direction.

For example, in the case of the ink-jet head as shown in FIG. 10B, the five individual electrodes in the line A of the first drive electrode 118*a* are disposed while being separated from each other in a prescribed gap in the line direction. The same is applicable with respect to the lines B and C. Furthermore, the five individual electrodes in the line B are disposed while being separated from each other in a prescribed gap in the row direction against the line A and between the five individual electrodes in the line A and the five individual electrodes in the line C against the line direction, respectively. Similarly, the five individual electrodes in the line C are disposed while being separated from each other in a prescribed gap in the row direction against the line B and between the five drive electrodes in the line B and the five drive electrodes in the line A against the line direction, respectively.

In this way, by disposing the individual electrodes to be contained in the respective lines of the first drive electrode 118*a* while being deviated into the line direction, one line which is recorded in the recording medium S is divided into three parts in the line direction.

That is, one line as recorded on the recording medium S is divided into plural groups corresponding to the line number of the first drive electrode 118*a* in the line direction and successively recorded in a time sharing manner. For example, in the case of the example as shown in FIG. 10B, by successively recording the lines A, B and C of the first drive electrode 118*a*, an image for one line is recorded on the recording medium S. In this case, as described previously, the one line as recorded on the recording medium S is divided into three parts in the line direction and successively recorded in a time sharing manner.

Accordingly, in a matrix drive system which is employed in this embodiment, since the recording is carried out in a divided manner in the line direction, the recording speed is lowered depending upon the line number of the first drive electrode 118*a*. However, there are advantages that the number of driver of the drive circuit can be reduced and that its mounting area can be reduced. Furthermore, in this embodiment, the recording speed and the number of driver can be properly determined, if desired. Accordingly, there is an advantage such that an optimal recording speed and an optimal mounting area of the drive circuit can be obtained depending upon the system.

Incidentally, in the ink-jet head 141 of this embodiment, though a double-layered electrode structure composed of the first drive electrode 118*a* and the second drive electrode 144 is employed, it should not be construed that the invention is limited thereto. A drive electrode structure composed of more than two layers may be employed.

In the ink-jet head 141 of this embodiment having the discharge electrode of such a double-layered electrode structure, for example, it is possible to control discharge or non-discharge of the ink (ink droplet R) by always biasing the second drive electrode 144 with a prescribed voltage, for example, 600 V and switching the first drive electrode 118*a* to a grounded state or a high impedance state corresponding to an image data. That is, in the ink-jet head 141, when the first drive electrode 118*a* is in a grounded state, the electric field strength in the vicinity of the tip portion 114*a* of the ink guide 114 is low, and the ink does not fly out from the tip portion

114*a* of the ink guide 114. On the other hand, when the first drive electrode 118*a* is in a high impedance state, the electric field strength in the vicinity of the tip portion 114*a* of the ink guide 114 becomes high, and the ink as fed into the tip portion 114*a* of the ink guide 114 flies out from the tip portion 114*a* due to an electrostatic force.

Incidentally, in the case of switching the first drive electrode 118*a* between a grounded level and a high voltage level corresponding to an image data, the operation is substantially identical. As already mentioned, in the ink-jet head 141 of this embodiment, in the case where either one of the first drive electrode 118*a* or the second drive electrode 144 is in a grounded level, the ink is not discharged. On the other hand, only in the case where not only the first drive electrode 118*a* is in a high impedance state or a high voltage level, but also the second drive electrode 144 is in a high voltage level the ink is discharged.

That is, in the ink-jet head 141 of this embodiment, it is important that at the discharge time and non-discharge time of the ink, two states having a distinctly different electric field strength from each other are obtained. Accordingly, related parameters such as the disposition (positional relation) of the first drive electrode 118*a* and the second drive electrode 144, the high voltage level to be applied to each of the first drive electrode 118*a* and the second drive electrode 144, the bias voltage of the transporting belt 142 (or the charge voltage of the recording medium), the thickness of the insulating substrate 116, and the shape of the ink guide 114 may be properly determined.

In this case, since the ratio of the amount of protrusion (H) of the ink guide 114 to the inside diameter (Da) of the first drive electrode 118*a* is made to fall within the proper limited range of the invention, too, even when the bias voltage to be applied to the second drive electrode 144 is not more than about 600 V, it is also possible to realize sure and stable ink discharge. Incidentally, the ratio of the amount of protrusion (H) of the ink guide 114 to the inside diameter of the second drive electrode 144 may be made to fall within the proper limited range of the invention, too.

According to this embodiment, by such a construction, since the first drive electrode can be switched between a high impedance state and a grounded level, a large electric power is not consumed for switching. Thus, according to this embodiment, even in an ink-jet head which is required to have high definition and high speed, the consumed electric power can be largely reduced.

Furthermore, according to this embodiment, since the individual electrodes are two-dimensionally disposed and subjected to matrix driving, it is possible to largely reduce the number of line driver for driving the plural individual electrodes in the line direction and the number of row driver for driving the plural individual electrodes in the row direction. Accordingly, according to this embodiment, it is possible to largely reduce the mounting area and the consumed electric power of the drive circuits of the individual electrodes to be two-dimensionally aligned. Furthermore, according to this embodiment, since the individual electrodes can be disposed in relatively surplus gaps, danger of an electric discharge among the respective individual electrodes can be extremely lowered, and both high-density mounting and high voltage can be safely made compatible with each other.

Incidentally, in the case where the discharge electrode having a double-layered electrode structure composed of the first drive electrode 118*a* and the second drive electrode 142 or 144 as in the foregoing electrostatic ink-jet heads 140 and 141 is used, when the individual electrodes are disposed in a high density, there is some possibility that electric field interference is caused between the adjacent individual electrodes. For that reason, in order to shield a line of electric force into the adjacent ink guide 114, it is preferred to provide a guard electrode between the adjacent first drive electrodes of individual electrodes. The guard electrode is effective for not only the double-layered electrode structure but also the foregoing single-layered electrode structure.

Figure 11:
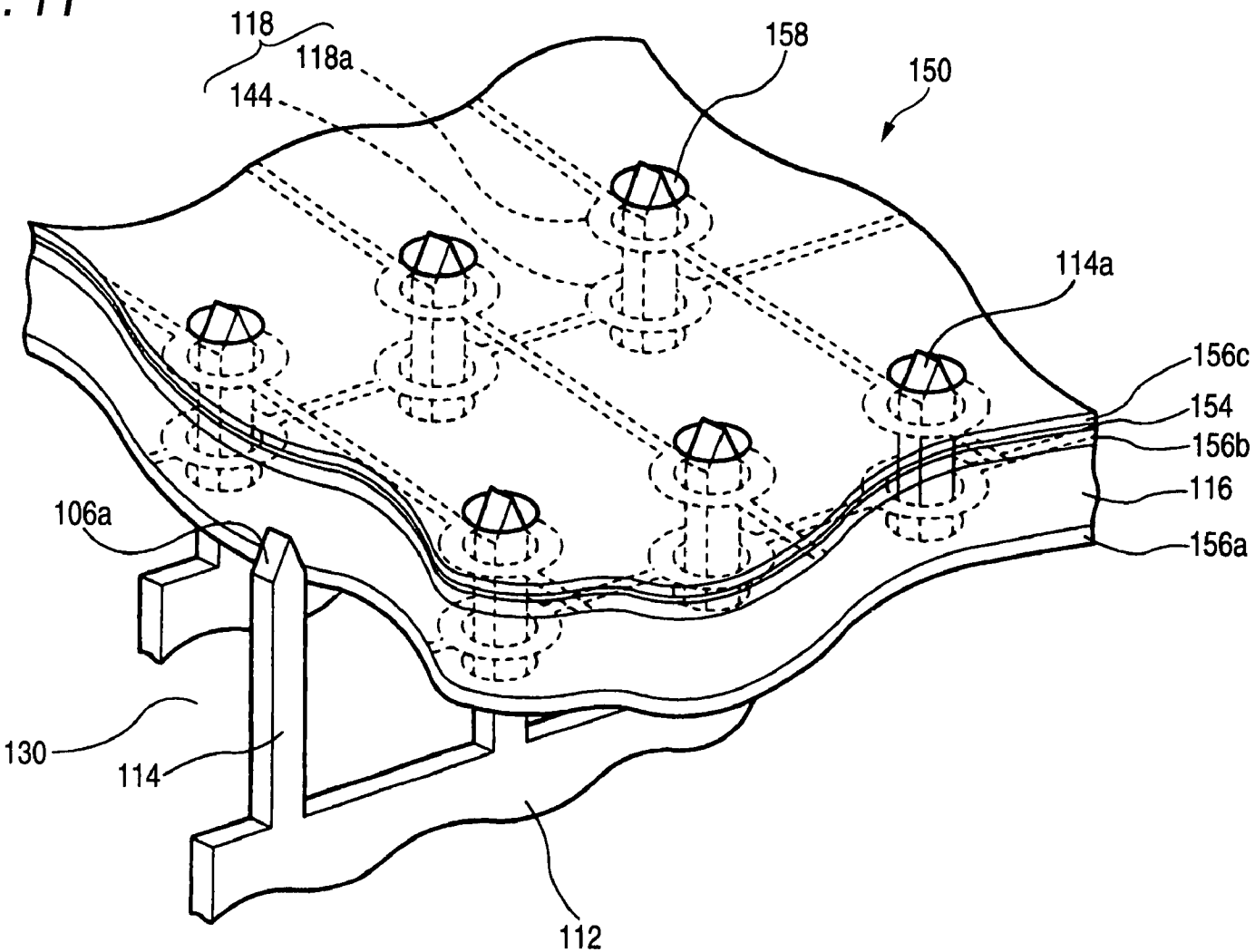
FIG. 11 is a typical oblique view that illustrates a schematic construction of other example of an electrostatic ink-jet head according to the invention.
Figure 12A:
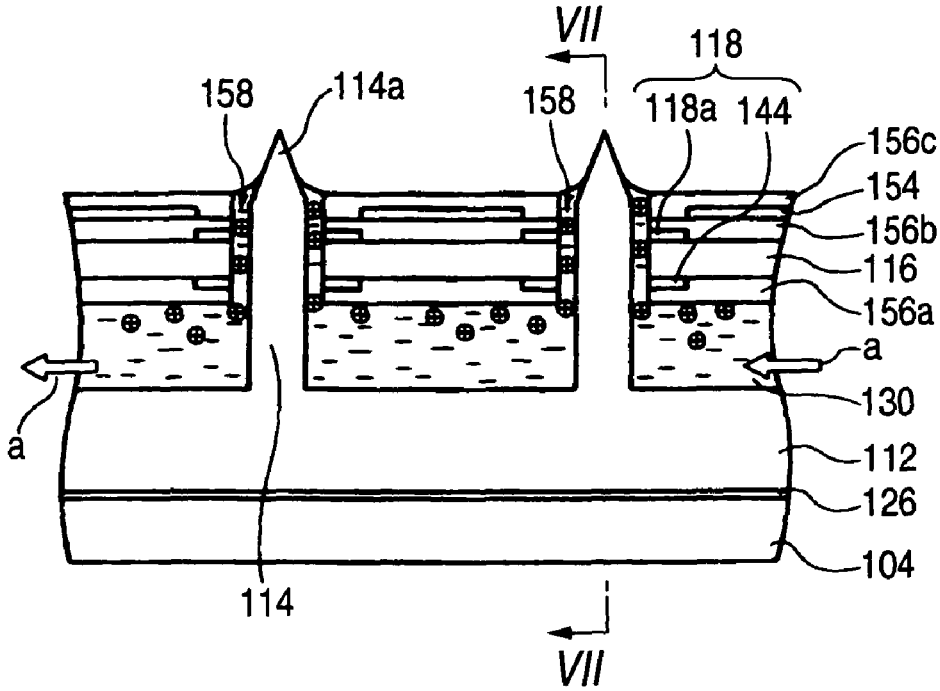
FIG. 12A is a typical cross-sectional view that illustrates a schematic construction of the ink-jet head as illustrated in FIG. 12A.
Figure 12B:
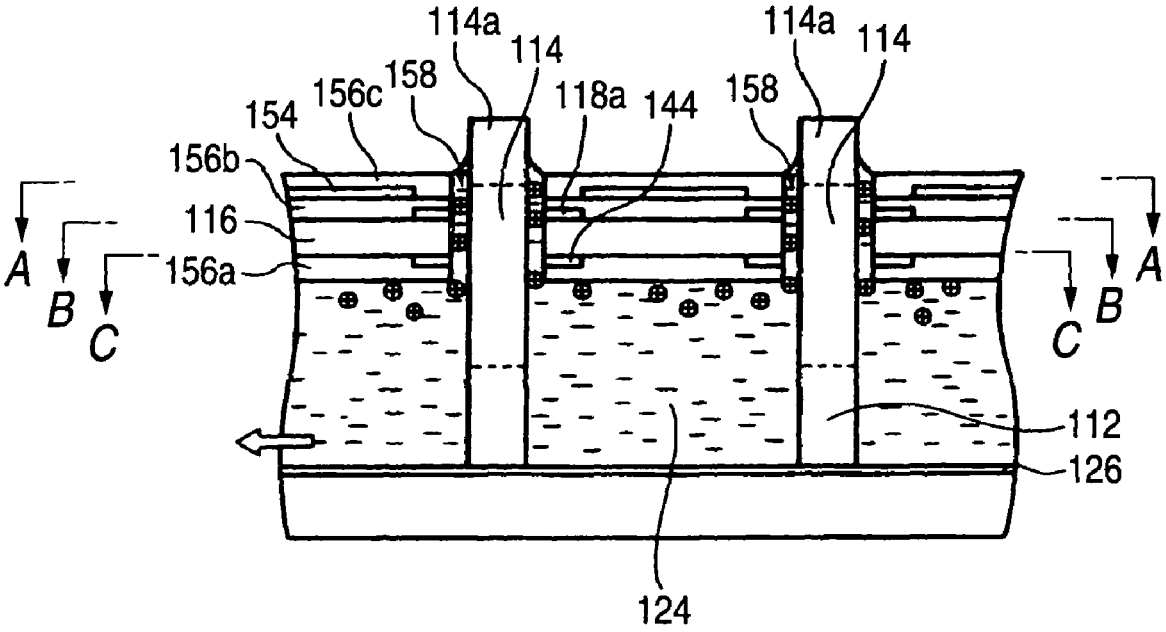
FIG. 12B is a cross-sectional view on VII-VII line of FIG. 12A.

FIG. 11 and FIGS. 12A and 12B each shows a schematic construction of an electrostatic ink-jet head 150 having a discharge electrode of a double-layered electrode structure provided with the foregoing guard electrode according to a still other embodiment of the invention. FIG. 11 is a typical oblique view of one example of an ink-jet head of this embodiment; FIG. 12A is a typical cross-sectional view of the ink-jet head as shown in FIG. 11; and FIG. 1213 is a view on VII-VII arrow of FIG. 12A.

The ink-jet head 150 as shown in FIG. 11 and FIGS. 12A and 12B has a construction the same as the ink-jet head 141 as shown in FIG. 10A, except that an insulating layer 156*a* in a lower part of the second drive electrode 144 on the lower surface of the insulating substrate 116 in the drawing, an insulating layer 156*b* in an upper part of the first drive electrode 118*a* on the upper surface of the insulating substrate 116 in the drawing, a guard electrode 154 and an insulating layer 156*c* are provided. Thus, the same constructive elements are given the same reference symbols, their descriptions are omitted, and differences are mainly described.

The ink-jet head 150 as shown in FIG. 11 and FIGS. 12A and 12B is provided with in addition to the discharge electrode 118 having a double-layered electrode structure in which the first drive electrode 118*a* composed of a circular electrode as provided in a ring-like form for every individual electrode which is disposed on the upper surface in the drawing so as to surround a through-hole 158 as bored on the insulating substrate 116 and the second drive electrode 144 composed of a circulate electrode as provided in a ring-like form for every individual electrode which is disposed on the lower surface in the drawing so as to surround the through-hole 158 of the insulating substrate 116 are provided, the insulating layer 156*a* for covering a lower part (lower surface) of the second drive electrode 144; the guard electrode 154 in a sheet-like form which is disposed in an upper part of the first drive electrode 118*a* via the insulating layer 156*b*; and the insulating layer 156*c* for covering the upper surface of the guard electrode 154. Here, the plural first drive electrodes 118*a* as disposed in a line direction (major transporting direction) are connected to each other; and the plural second drive electrodes 144 as disposed in a row direction (subsidiary transporting direction) are connected to each other.

Furthermore, the through-hole 158 is bored so as to penetrate through the insulating layer 156*a* in a lower part of the insulating substrate 116 and also through the insulating layers 156*b* and 156*c* in an upper part of the insulating substrate 116. That is, the through-hole 158 penetrates through a laminate of the insulating layer 156*a*, the insulating substrate 116 and the insulating layers 156*b* and 156*c*. The ink guide 114 is inserted into this through-hole 158 from the side of the insulating layer 156*a*, and the tip portion 114*a* of the ink guide 114 is protruded from the insulating layer 156*c*. Incidentally, in the illustrated example, though an ink guide groove is not formed in the tip portion 114*a* of the ink guide 114, it may be formed for the purpose of promoting the feed of the ink into the tip portion 114*a*.

Here, a ratio of the amount of protrusion (amount of protrusion) H of the tip portion 114*a* of the ink guide 114 from the first drive electrode 118*a* to the inside diameter (Da) of the first drive electrode 118*a* facing on the through-hole 158 is from 0.5 to 2, and preferably from 0.7 to 1.7. Incidentally, with respect to a ratio of the amount of protrusion H of the ink guide 114 to the inside diameter (Da) of the second drive electrode 144, one which is satisfied with the foregoing conditions is preferable.

Figure 13A:
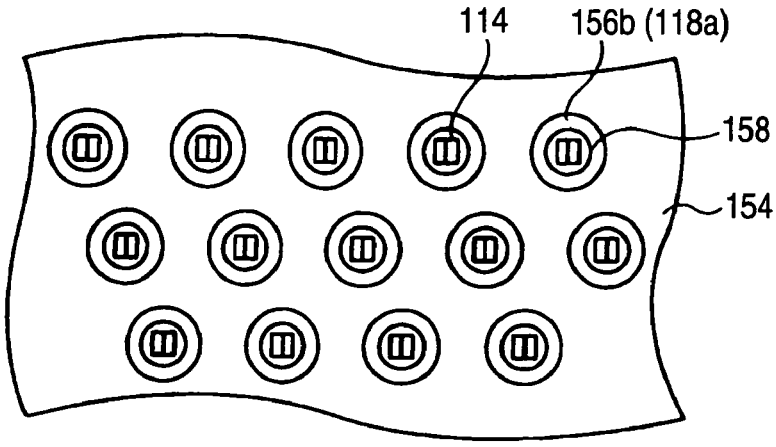
FIGS. 13A, 13B and 13C are a view on A-A arrow, a view on B-B arrow and a view on C-C arrow of FIG. 10B, respectively.

In this embodiment, the guard electrode 154 is disposed between the adjacent first drive electrodes 118*a* of individual electrodes and controls electric field interference as generated between the ink guides 114 as a discharge section of the adjacent individual electrodes. As shown in FIG. 13A, the guard electrode 154 is an electrode in a sheet-like form which is common among the respective individual electrodes such as metal plates, and a portion corresponding to the first drive electrode 118*a* as formed on the periphery of the through-hole 158 for every two-dimensionally aligned individual electrode is bored (see FIGS. 12A and 12B). Incidentally, in this embodiment, the reason why the guard electrode 154 is provided is as follows. That is, this is because there is some possibility that when the individual electrodes are disposed in a high density, an electric field which the individual electrodes generate by themselves is influenced by the state of an electric field of the adjacent individual electrodes and the dot size and the drawing position of dots fall into disorder, thereby adversely affecting the recording quality.

Now, the upper side of the guard electrode 154 in the drawing is covered by the insulating layer 156*c* exclusive of the through-holes 158, and the insulating layer 156*b* is mediated between the guard electrode 154 and the first drive electrode 118*a*, thereby insulating the both electrodes 154 and 118*a* from each other. That is, the guard electrode 154 is disposed between the insulating layer 156*c* and the insulating layer 156*b*, and the first drive electrode 118*a* is disposed between the insulating layer 156*b* and the insulating substrate 116.

Figure 13B:
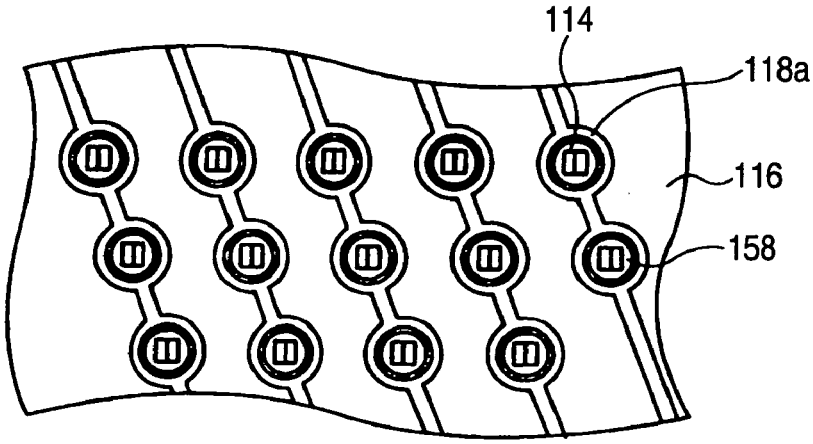

That is, as shown in FIG. 13B, on the upper surface of the insulating substrate 116, accordingly between the insulating layer 156*b* and the insulating substrate 116 (see FIG. 12), the first drive electrodes 118*a* as formed on the periphery of the through-hole 158 for every individual electrode are two-dimensionally aligned, and the plural first drive electrodes 118*a* in the row direction are connected to each other.

Figure 13C:
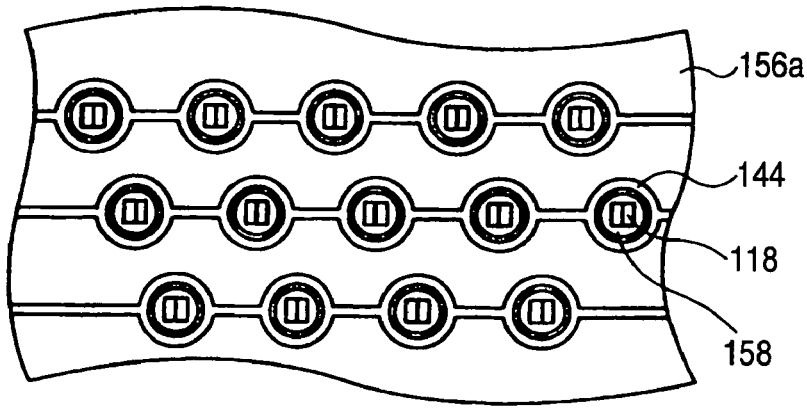

Furthermore, as shown in FIG. 13C, on the upper surface of the insulating layer 156*a*, accordingly on the lower surface of the insulating substrate 116, namely between the insulating layer 156*a* and the insulating substrate 116 (see FIG. 12), the second drive electrodes 144 as formed on the periphery of the through-hole 158 for every individual electrode are two-dimensionally aligned, and the plural second drive electrodes 144 in the line direction are connected to each other.

Furthermore, in this embodiment, for the purpose of shielding a repulsive electric field from the discharge electrode (drive electrode) 118 of each individual electrode, for example, the first drive electrode 118*a* and the second drive electrode 144, into the direction of the ink passage 130, a shield electrode may be provided in the passage side of the first drive electrode 118*a* and the second drive electrode 144.

Similar to the case of the embodiment as shown in FIG. 10, in the case of this embodiment, at the tome of recording, only one first drive electrode 118*a* is driven in a high voltage level or a high impedance state ("ON" state), and all of the remaining first drive electrodes 118*a* are driven in a grounded level (grounded state: "OFF" state), too. Furthermore, all of the second drive electrodes 144 are driven in a high voltage level or a grounded level corresponding to an image data. Incidentally, as another embodiment, the first drive electrode 118*a* and the second drive electrode 144 may be driven in a reverse state, respectively.

As described previously, the first drive electrodes 118*a* and the second drive electrodes 144 are constructed so as to have a double-layered structure and disposed in a matrix state. By the first drive electrodes 118*a* and the second drive electrodes 144, discharge or non-discharge of the ink in each individual electrode is controlled. That is, in the case where the first drive electrode 118*a* is in a high voltage level or in a floating state and the second drive electrode 144 is in a high voltage level, the ink is discharged, whereas in the case where either one of the first drive electrode 118*a* or the second drive electrode 144 is in a grounded state, the ink is not discharged.

Incidentally, in this embodiment, when a pulse voltage is applied to the first drive electrode 118*a* and the second discharge electrode 144 corresponding to an image signal and the both electrodes reach a high voltage level, the ink discharge may be carried out.

Figure 14:
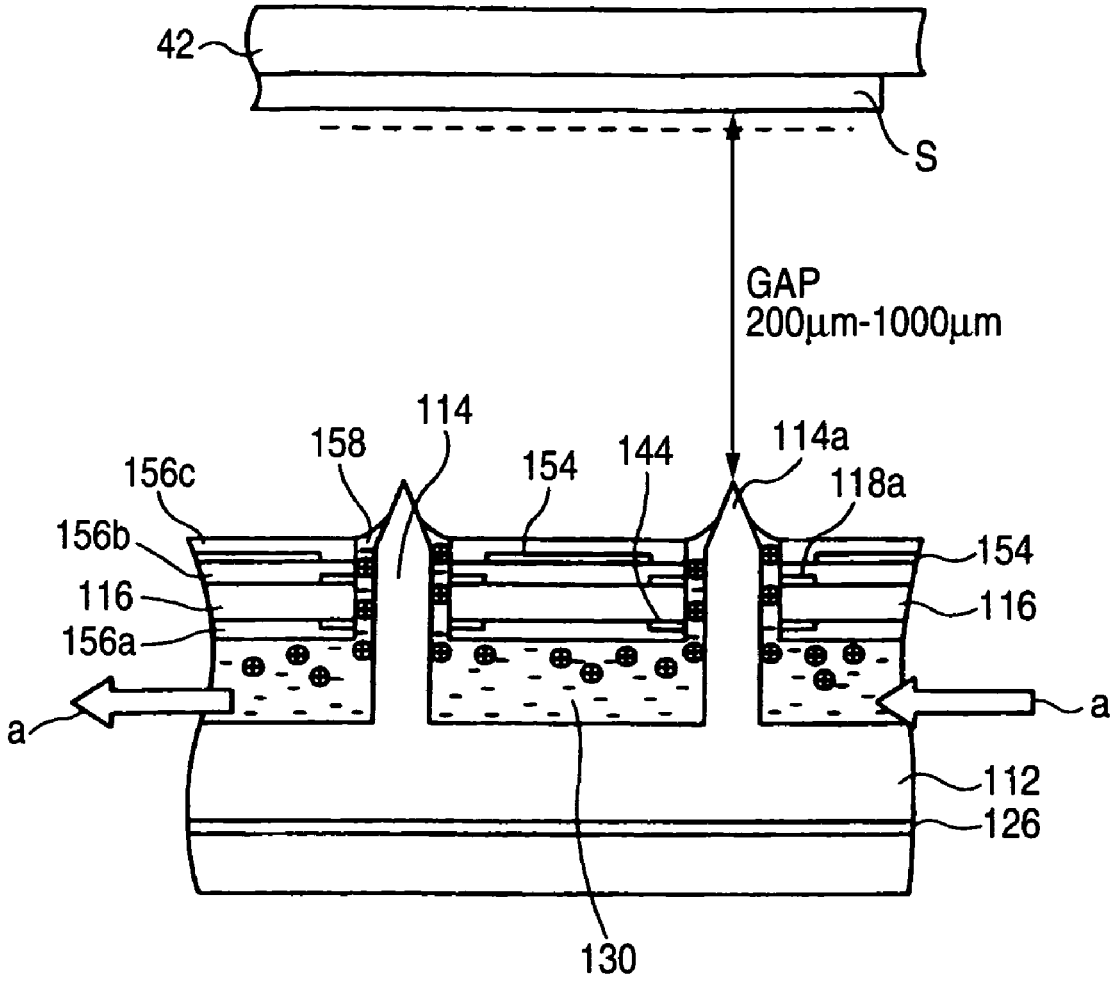
FIG. 14 is a conceptual view for explaining the action of the ink-jet head as illustrated in FIG. 9.

For example, in the ink-jet head 150 as shown in FIG. 14, an electric field such that the ink is circulated in a direction of an arrow a within the ink passage 130 and that the ink (ink droplet) as discharged from the tip portion 114*a* of the ink guide 114 of the individual electrode is attracted to the recording medium S, namely a flying electric field is formed between the first drive electrode 118*a* and the second drive electrode 144 and the recording medium S. For example, a gap between the tip portion 114*a* of the ink guide 114 and the recording medium S is from 200 to 1,000 μm, and when the gap is 500 μm, a potential of from 1 kV to 2.5 kV is provided, thereby forming a flying electrode field.

For example, in the ink-jet head as shown in FIG. 14, the recording medium S is electrostatically charged with a negative high voltage (or the opposing electrode constructed by the transporting belt 42 for transporting the recording medium S is biased with −1.5 kV), thereby regulating both the first drive electrode 118*a* and the second drive electrode 144 at 0 V (in a grounded state) to form a flying electric field, and the guard electrode 154 is regulated at 0 V (in a grounded state).

At this time, the ink rises between the through-hole 158 and the ink guide 114 from the ink passage 130 and is gathered in the tip portion 114*a*.

Figure 15:
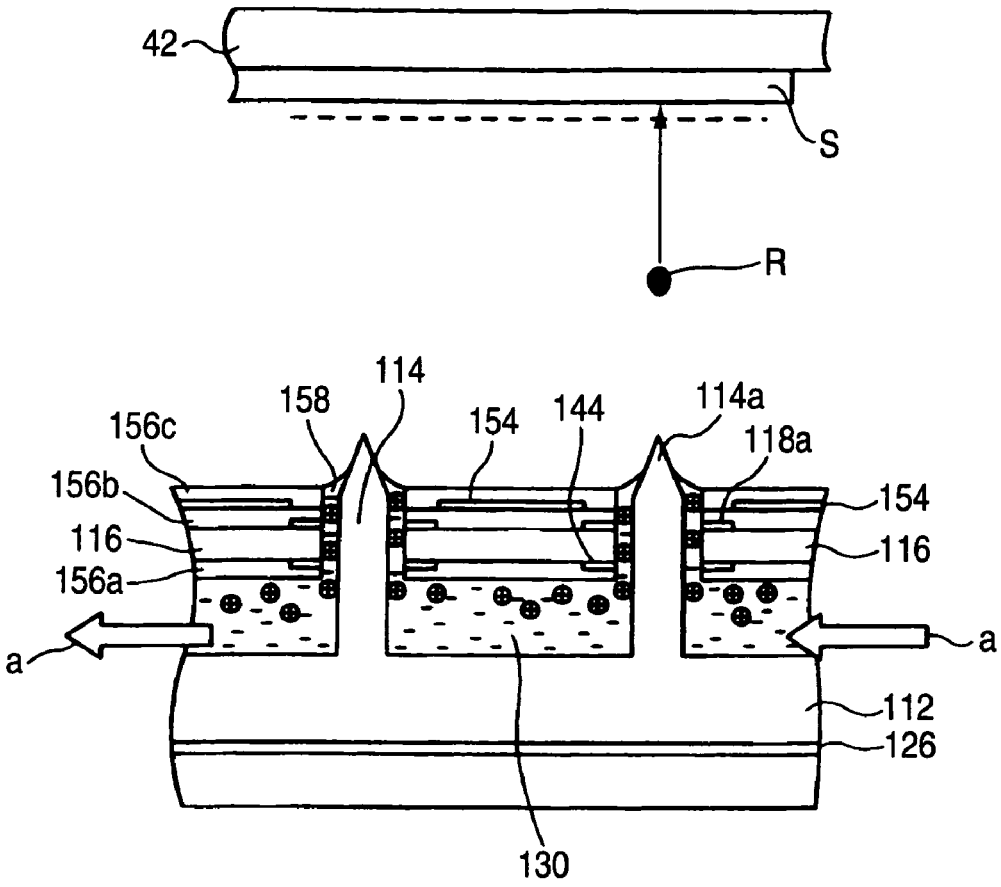
FIG. 15 is a conceptual view for explaining the recording operation of the ink-jet head as illustrated in FIG. 9.

Next, as shown in FIG. 15, a pulse voltage, for example, from +400 to 600 V is applied to each of the first drive electrode 118*a* and the second drive electrode 144 correspond to an image signal, and the ink droplet R is discharged from the tip portion 114*a* of the ink guide 114. Incidentally, though the pulse width of the pulse voltage is not particularly limited, it can be regulated at, for example, several tens μs to several hundreds μs. Furthermore, since the size of the dots to be recorded on the recording medium S relies upon the size or the application time of the pulse voltage, the dot size can be adjusted by adjusting them.

At this time, even in this embodiment, since a ratio the amount of protrusion of the tip portion 114*a* of the ink guide 114 to the inside diameter of the first drive electrode 118*a* is made to fall within a proper limited range, the flying electric field between the first drive electrode 118*a* and the second drive electrode 144 and the recording medium S can be properly adjusted, and only in the case where a proper pulse voltage is applied to the first drive electrode 118 and the second drive electrode 144, the ink discharge can be caused surely and stably. Furthermore, in the illustrated example, it is possible to reduce the number of driver by the matrix driving of the first drive electrode 118*a* and the second drive electrode 144.

That is, in the state that the discharge of ink droplets does not occur, an attracting electric field toward the recording medium is preferably set up so as to fall within the range of not more than $1.5\times10^7$ V/m, and more preferably not more than $1.0\times10^7$ V/m; and in the state that the discharge occurs, an attracting electric field toward the recording medium is preferably set up so as to fall within the range of $2.0\times10^7$ V/m or more, and more preferably $2.5\times10^7$ V/m or more.

Incidentally, in the ink-jet head of this embodiment, though whether or not discharge or non-discharge is controlled in either or both the first drive electrode 118*a* and the second drive electrode 144 is controlled is not particularly limited, it is desirable that in the case where either one of the first drive electrode 118*a* or the second drive electrode 144 is in a grounded level, the ink is not discharged, whereas in the case where the first drive electrode 118 is a high impedance state or a high voltage level and the second drive electrode 144 is in a high voltage level, the ink is discharged.

Now, in the ink-jet head of this embodiment, the guard electrode 154 is provided between the adjacent first drive electrodes 118*a* as in the illustrated example, but it should not be construed that the invention is limited thereto. In the case where the first drive electrode 118*a* and the second drive electrode 144 are subjected to matrix driving, for example, when the lower second drive electrodes 144 are successively driven for every row and the upper first drive electrodes 118 are driven corresponding to an image data, the guard electrode may be provided only between the respective lines of the first drive electrodes 118*a*. In such case, at the time of recording, by biasing the guard electrode with a prescribed guard potential, for example, in a grounded level, it is possible to exclude influences of the adjacent individual electrodes.

Furthermore, in this embodiment, at the time of driving the discharge electrode 118 of the individual electrode in the same manner as in the embodiment as shown in FIGS. 10A and 10B, in the case where the lines of the upper first drive electrodes 118*a* are successively turned on and the lower second drive electrodes 144 are turned on or off corresponding to an image date, namely in the case where the arrangement of the line is reversed, the second drive electrodes 144 are driven corresponding to the image data. Thus, centering the respectively individual electrode in the line direction, the individual electrodes on the both sides thereof are frequently changed in a high voltage level or a grounded level.

However, in the line direction, every one line of the first drive electrodes 118 is driven, and centering the respective individual electrode, the first drive electrodes 118*a* on the both sides thereof are always in a grounded level. Thus, the lines of the individual electrodes on the both sides play a role as a guard electrode. In this way, in the case where the respectively lines are successively turned on by the upper first drive electrodes 118*a* and the lower second drive electrodes 144 are driven corresponding to an image data, even when a guard electrode is not provided, influences of the adjacent individual electrodes can be excluded, thereby improving the recording quality.

Needless to say, in all of the embodiments, of course, it is possible to exclude influences of the adjacent individual electrodes by providing a guard electrode.

Incidentally, in each of the examples of the electrostatic ink-jet head having the foregoing discharge electrode of a double-layered electrode structure, there may be employed a method in which when the opposing electrode (recording medium S) is electrostatically charged with, for example, −1.6 kV and either or both of the first drive electrode and the second drive electrode are in a negative high voltage (for example, −600 V), the ink is not discharged, whereas only when both the first drive electrode and the second drive electrode are in a grounded level (0 V), the ink is discharged.

Next, other constructions of the ink-jet recording device of the invention will be described with reference to the accompanying drawings.

Figure 16:
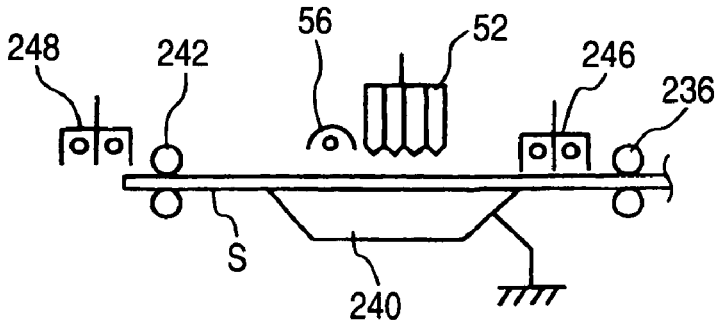
FIG. 16 is a partial schematic view that illustrates other construction of a transporting and supporting section with respect to the device of FIG. 1.

FIG. 16 is a partial schematic view to show other construction of the transporting and supporting section with respect to the device of FIG. 1.

In FIG. 16, elements having the same construction and the same action as in those in FIG. 1 are given the same reference symbols. A plate-like conductive platen 240 supports the recording medium S, and a transporting roll pair 236 moves the recording medium S on the platen 240 in place of the transporting roll pair 36 of FIG. 1. An electrostatic charger 246 is provided in an upper part of the upstream end of the conductive platen 240, and the platen 240 and the recording medium S are brought into intimate contact with each other by electrostatic charge. The conductive platen 240 is earthed.

This electrostatic charger 246 has a construction the same as in FIG. 1, and a voltage in an amount of from 3 to 12 kV in terms of an absolute value can be applied to the electrostatic charger. When the voltage is less than 3 kV, the effect by the adsorption is hardly obtained, whereas when it exceeds 12 kV, abnormal electric discharge possibly occurs. The voltage to be applied is preferably from approximately 5 to 8 kV.

The recording medium S moves in an intimate contact state on the conductive platen 240 by the transporting roll pair 236 and receives image recording by the ink discharge over the entire width of the recording material from the head ink 52 and irradiation with actinic energy by the ultraviolet ray irradiating section 56, whereby the ink which forms an image is cured. Thereafter, a transporting roll pair 242 interposes the tip of the recording medium S and transports it, is statically eliminated by a static eliminator 248 as provided in the downstream side thereof, and is then sent out onto the tray 90 of the actinic energy curing type ink-jet recording device.

Figure 17:
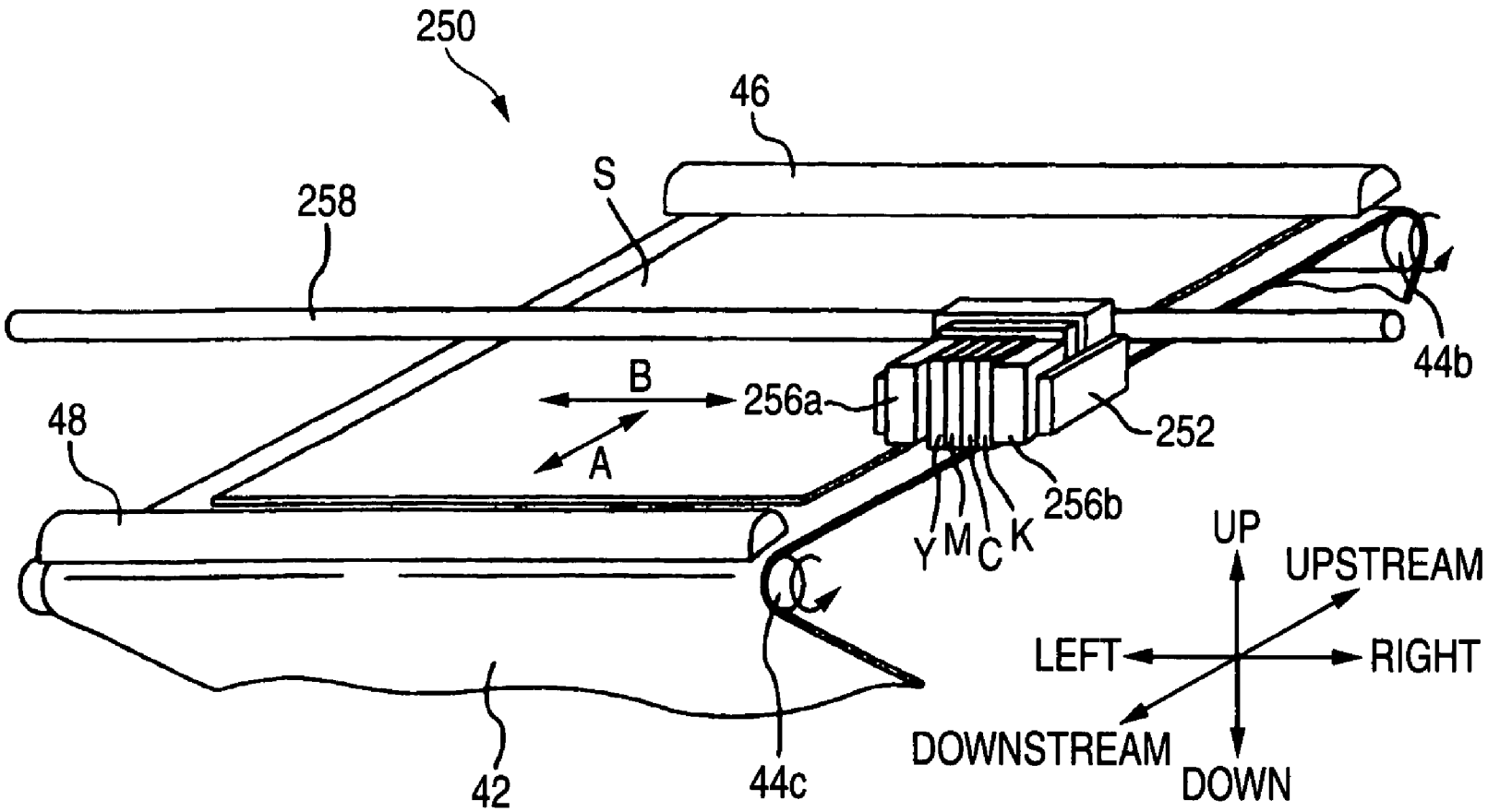
FIG. 17 is a partial schematic view that illustrates other construction of an image recording section with respect to the device of FIG. 1.

FIG. 17 is a partial schematic view to show other construction of the image recording section with respect to the device of FIG. 1.

Though in the recording device 10 as shown in FIGS. 1 and 16, the head 52 is a line type ink-jet head having ink discharge nozzles in the entire widthwise direction of the recording medium S, a head 252 as shown in FIG. 17 is of a multi-channel type and scans and moves even in the widthwise direction of the recording medium S. The construction will be hereunder described. Incidentally, in FIG. 17, elements having the same construction and the same action as in those in FIG. 1 are given the same reference symbols.

First of all, similar to FIG. 1, the transporting belt 42 is tensioned and driven by three belt rolls 44*a* (not shown), 44*b* and 44*c*. The transporting belt 42 is driven in a direction from the upstream belt roll 44*b* to the downstream belt roll 44*c*; and a recording medium S is placed on the transporting belt 42 between the upstream belt roll 44*b* and the downstream belt roll 44*c* and transported along a transporting direction A.

As a construction of an image recording section 250, it is composed of a guide member 258 extending in an orthogonal direction (scanning direction B) to the transporting direction A in the upper position of the recording medium S which is transported between the upstream belt roll 44*b* and the downstream belt roll 44*c* and a head unit 252 which is suspended and supported by this guide member 258. This head unit 252 is set up in a freely reciprocally movable manner along the scanning direction B. Here, the head unit 252 is provided with a group of four nozzles from which respective actinic energy curable inks of four colors (yellow Y, magenta M, cyan C, and black K) are each injected towards the recording surface of the recording medium S.

An ultraviolet ray irradiating section 256 is disposed in both sides of the head unit 252 in the longitudinal direction of the guide member 258. In both right and left sides of the head unit 252 in the drawing, two ultraviolet ray irradiating sections 256*a* and 256*b* for achieving irradiation with ultraviolet rays are mounted, respectively. The ultraviolet ray irradiating sections 256*a* and 256*b* are movable together by reciprocating movement of the head unit 252. An ultraviolet ray curable ink which has been discharged from each of the nozzles and impacted onto the recording medium S is irradiated with ultraviolet rays by one of the ultraviolet ray irradiating ray sections 256*a* and 256*b* passing thereon immediately thereafter.

Furthermore, in the upper position of the recording medium S, as shown in FIG. 1, the electrostatic charger 46 is provided at the position of the upstream belt roll 44*b* with which the tip of the recording medium S first comes into contact on the transporting belt 42 and disposed to a degree that it does not come into contact with the recording medium S on the transporting belt 42 and in close vicinity to the transporting belt 42, thereby enhancing adhesion between the transporting belt 42 and the recording medium S. In addition, at the position of the downstream belt roll 44*c* at which the recording medium S is separated from the transporting belt 42, the static eliminator 48 is provided and disposed to a degree that it does not come into contact with the recording medium S on the transporting belt 42 and in close vicinity to the transporting belt 42.

A potential of from 3 to 12 kV in terms of an absolute value can be applied to the electrostatic charger 46. When the potential is less than 3 kV, the effect by the adsorption is hardly obtained, whereas when it exceeds 12 kV, abnormal electric discharge possibly occurs. The potential to be applied is preferably from approximately 5 to 8 kV.

Figure 18:
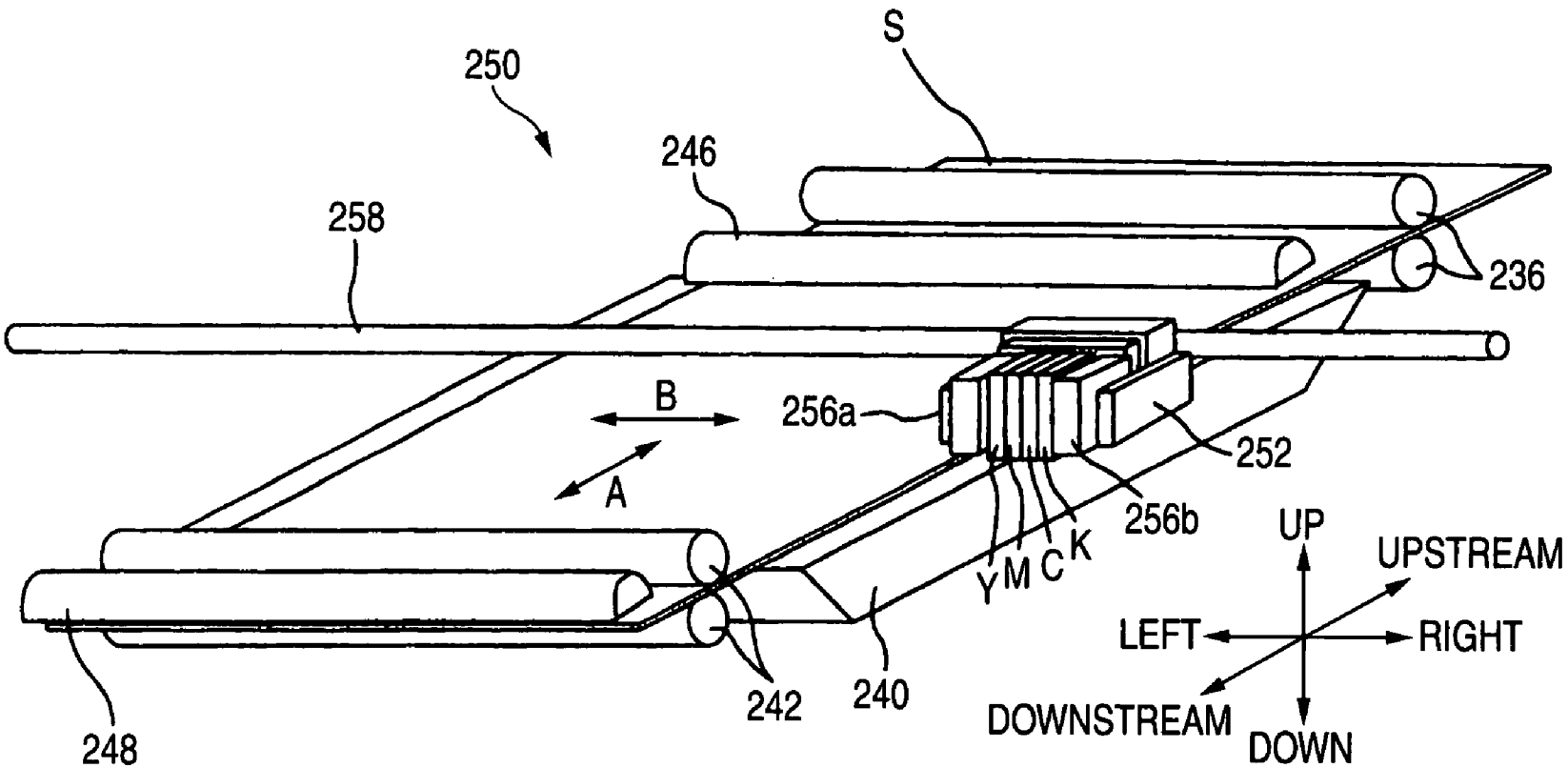
FIG. 18 is a partial schematic view that illustrates a still other construction of an image recording section with respect to the device of FIG. 1.

FIG. 18 is a schematic view to show a still other construction of the image recording section with respect to the device of FIG. 1 and is a schematic oblique view to show a construction for carrying out image recording by the transporting and supporting section using the head 252 of a multi-channel type as shown in FIG. 17 and the fixed platen 240 as shown in FIG. 16.

In FIG. 18, first of all, similar to FIG. 16, the plate-like conductive platen 240 supports the recording medium S, and the transporting roll pair 236 moves the recording medium S on the conductive platen 240. In order to bring the conductive platen 240 into intimate contact with the recording medium S, the electrostatic charger 246 is provided, and the conductive platen 240 is earthed.

As in the image recording section as shown in FIG. 17, the head unit 252 for recording an image on the recording surface of the recording medium S is suspended and supported by the guide member 258 extending in an orthogonal direction (scanning direction B) to a transporting direction A above the platen 240. The ultraviolet ray irradiating sections 256*a* and 256*b* are movable together in the direction B by the reciprocating movement of the head unit 252. An ultraviolet ray curable ink which has been discharged from each of the nozzles and impacted onto the recording medium S is irradiated with ultraviolet rays by one of the ultraviolet ray irradiating sections 256*a* and 256*b* passing thereon immediately thereafter.

In an upper part of the upstream end of the conductive platen 240, the electrostatic charger 246 is provided by the disposition in the close vicinity of the recording medium S, and the platen 240 and the recording medium S are brought into intimate contact with each other by electrostatic charge. The transporting roll pair 246 interposes the tip of the recording medium S and transports it, thereby achieving the static elimination of the recording medium S by the electrostatic charger 246 as provided in the downstream side thereof.

Incidentally, a potential of from 3 to 12 kV in terms of an absolute value can be applied to the corona electrostatic charger 246. When the potential is less than 3 kV, the effect by the adsorption is hardly obtained, whereas when it exceeds 12 kV, abnormal electric discharge possibly occurs. The potential to be applied is preferably from approximately 5 to 8 kV.

Figure 19:
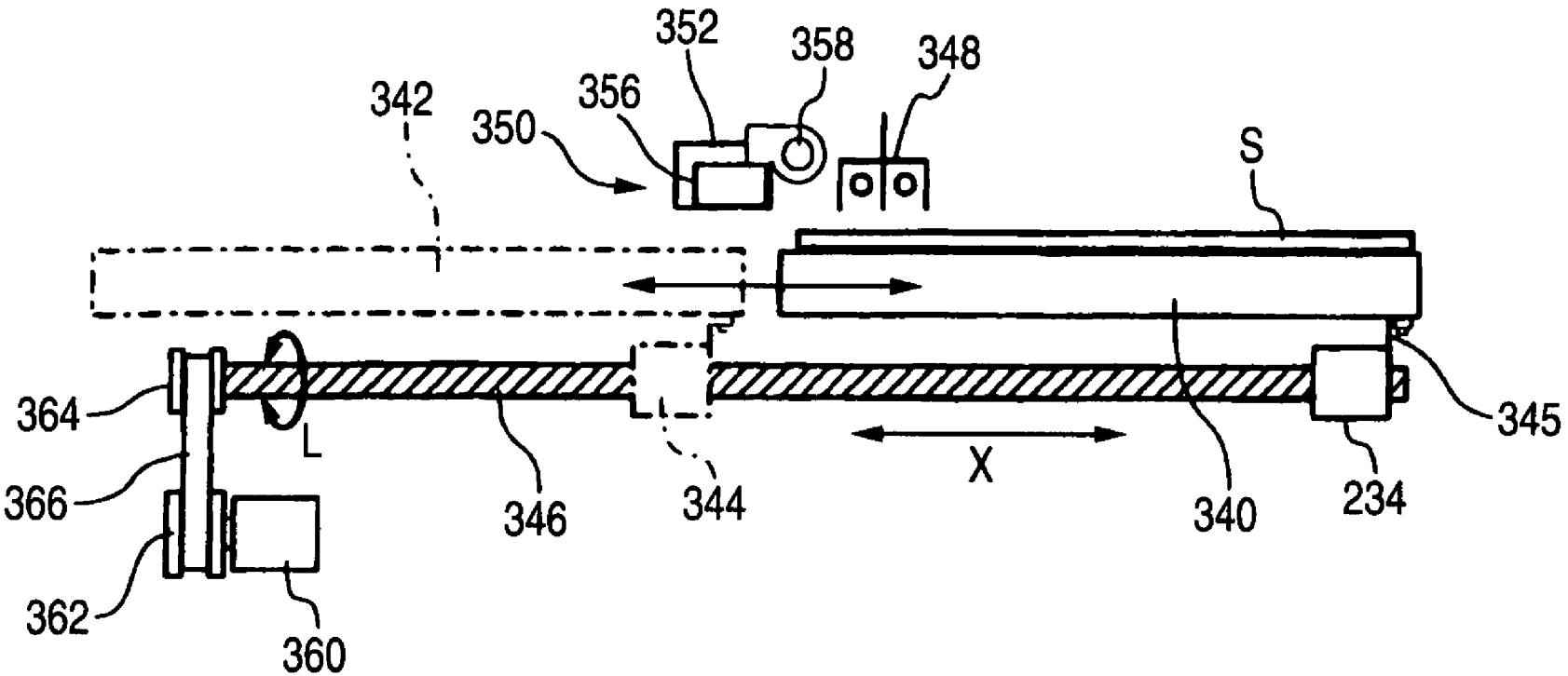
FIG. 19 is a constructive schematic view of an ink-jet recording device according to another embodiment of the invention.

FIG. 19 is a constructive schematic view of an actinic energy curing type ink-jet recording device according to another embodiment of the invention.

In FIG. 19, a movable conductive platen 340 supports the recording medium S at the time of recording and transporting. It is preferable that the movable conductive platen 340 is in a plate-like form and set up so as to have a size slightly larger than a maximum size of the recording medium S, thereby supporting the whole of the recording medium. On the back surface of the movable conductive platen 340 opposing to the supporting surface of the recording material, a ball nut 344 is fixed by a bracket 345. A ball screw shaft 346 which penetrates this ball nut 344 is disposed such that its longitudinal direction is parallel to the transporting direction of the recording medium S. The ball nut 344 is engaged by teeth with the ball screw shaft 346 and regulated to fore and aft movement X of the transporting direction of the recording medium following rotation L of the ball screw shaft 346.

A driven timing pulley 364 is disposed in the downstream end of the transporting direction of the ball screw shaft 346. Furthermore, a drive motor 360 is disposed below the movable conductive platen 340. A timing belt 366 is tensioned between a drive timing pulley 362 to be rotated and driven by this drive motor 360 and the driven timing pulley 364, thereby transmitting rotational drive. The rotation rotates the driven timing pulley 364 and rotates the ball screw shaft 346 by the drive motor 360. This rotation is finally converted into linear movement in the transporting direction of the recording medium by the ball nut 344. Then, the movable conductive platen 340 is constructed such that it reciprocates between an initial position shown by a solid line and the most downstream position as expressed by a dashed line in FIG. 19.

The image recording section 350 is disposed in the vicinity of the middle between the initial position and the downstream position of the movable conductive platen 340 and above the movable conductive platen 340. Ahead unit 352 of a multi-channel type as shown in FIG. 17 or 18 is provided in this image recording section 350. This head unit 352 is suspended and supported by a guide member 358 extending in a scanning direction orthogonal to the fore and aft movement X of the transporting direction of the recording medium. The head unit 352 undergoes reciprocating movement and scanning along the guide member 358. However, the head unit 352 is basically provided with a group of four nozzles from which respective actinic energy curable inks of four colors (yellow Y, magenta M, cyan C, and black K) are each injected towards the recording surface of the recording medium S.

An ultraviolet ray irradiating section 356 is disposed in both sides of the head unit 352 in the longitudinal direction of the guide member 358. The ultraviolet ray irradiating section 356 is movable together by the reciprocating movement of the head unit 352, and ultraviolet rays are irradiated on an ultraviolet ray curable ink which has been discharged from each of the nozzles and impacted onto the recording medium S.

Next, the operation of this embodiment will be described. First of all, in the case of this embodiment, every one sheet of the recording medium S is manually fed into the recording device as the need arises. The recording medium S to be manually fed is placed on the movable conductive platen 340 which is present at the initial position. The movable conductive platen 340 keeps a stopped state until the whole of the recording medium S has been completely placed thereon.

Next, image recording is carried out by an image recording start button (not shown) as provided in the image recording device. At this time, as also described in FIG. 1, a corona electrostatic charger or static eliminator 348 is disposed in an upper part of the movable conductive platen 340 and electrostatically charges the recording medium S, thereby bringing the movable conductive platen 340 into intimate contact with the recording medium S. Furthermore, driving is started due to the movement of the movable conductive plate 340 by the drive motor 360 at this timing.

Here, a rotary power of the drive motor 360 is transmitted into the drive timing pulley 362, the timing belt 366 and the driven timing pulley 364, thereby rotating the ball screw shaft 346. This rotation is converted into linear movement in the downstream direction by the ball nut 344.

First of all, in a first movement stage, the movable conductive platen 340 is moved from the initial position to the most downstream position (expressed by the dashed line). At this time, the entire surface of the recording medium S passes just below the electrostatic charger or static eliminator 348, whereby the entire surface thereof is electrostatically charged.

Next, in a second movement stage, the movable conductive plate 340 is reversely moved from the most downstream position (expressed by the dashed line) to the initial position. At this time, image recording by the image recording section 350 is started. That is, the ball nut 344 is moved at a rate for image recording, and image recording is executed for the recording medium S on the simultaneously moved movable conductive platen 340. Then, after completion of the image recording, the movable conductive platen 340 reaches the original position.

Then, in a third movement stage, the movable conductive platen 340 is again moved from the initial position to the most downstream position (expressed by the dashed line). During this movement, the recording medium S which is in an electrostatically charged state is subjected to a static elimination treatment by the electrostatic charger or static eliminator 348. At the point of time when the movable conductive platen 340 has reached the most downstream position (expressed by the dashed line), the static elimination treatment is completed. The recorded recording medium S is manually recovered from the top of the platen 340 which has been subjected to static elimination.

Incidentally, an electrostatic charge potential of from 3 to 12 kV in terms of an absolute value can be applied to the electrostatic charger or static eliminator 346. When the electrostatic charge potential is less than 3 kV, the effect by the adsorption is hardly obtained, whereas when it exceeds 12 kV, abnormal electric discharge possibly occurs. The electrostatic charge potential to be applied is preferably from approximately 5 to 8 kV.

Finally, after removal of the recording medium S, the movable conductive platen 340 at the most downstream position (expressed by the dashed line) is returned to the original position due td reverse drive of the drive motor 360 and provided for next image recording.

The term "actinic energy" as referred to in the invention is not particularly limited so far as it can impart energy capable of generating an initiation seed in the ink composition by its irradiation and widely includes α-rays, γ-rays, X-rays, ultraviolet rays, visible rays, and electron beams. Above all, from the viewpoints of curing sensitivity and easiness of availability of the device, ultraviolet rays and electron beams are preferable; and ultraviolet rays are especially preferable. Accordingly, it is preferable that the ink composition of the invention is an ink composition which can be cured by irradiation with ultraviolet rays.

In the ink-jet recording device of the invention, though a peak wavelength of the actinic energy varies with absorption characteristics of a sensitizing dye in the ink composition, it is suitable that the peak wavelength is, for example, from 200 to 600 nm, preferably from 300 to 450 nm, and more preferably from 350 to 450 nm. Furthermore, (a) an electron transfer type initiation system of the ink composition of the invention has sufficient sensitivity even to actinic energy with a low output. Accordingly, with respect to an output of the actinic energy, it is suitable that its irradiation energy is, for example, not more than 2,000 mJ/cm$^2$, preferably from 10 to 2,000 mJ/cm$^2$, more preferably from 20 to 1,000 mJ/cm$^2$, and further preferably from 50 to 800 mJ/cm$^2$. Furthermore, it is suitable that the actinic energy is irradiated at a luminance on the exposed surface (maximum luminance on the surface of a medium to be recorded) of, for example, from 10 to 2,000 mW/cm$^2$, and preferably from 20 to 1,000 mW/cm$^2$.

In particular, in the ink-jet recording device of the invention, it is preferable that the irradiation with actinic energy is achieved by irradiation from a light emitting diode capable of emitting ultraviolet rays such that its luminescence wavelength peak is from 390 to 420 nm and that the maximum luminance on the surface of the medium to be recorded is from 10 to 1,000 mW/cm$^2$.

Furthermore, in the ink-jet recording device of the invention, it is suitable that the actinic energy is irradiated on the ink composition as discharged onto the medium to be recorded for, for example, from 0.01 to 120 seconds, and preferably from 0.1 to 90 seconds.

In addition, in the ink-jet recording device of the invention, it is desired that not only the ink composition is warmed at a fixed temperature, but also the time from impacting of the ink composition against the medium to be recorded until the irradiation with actinic energy is set up at from 0.01 to 0.5 seconds, preferably from 0.01 to 0.3 seconds, and more preferably from 0.01 to 0.15 seconds. By controlling the time from impacting of the ink composition against the medium to be recorded until the irradiation with actinic energy within an extremely short period of time, it becomes possible to prevent oozing prior to curing of the impacted ink composition from occurring.

Incidentally, in order to obtain a color image using the ink-jet recording device of the invention, it is preferred to superimpose inks in order from an ink with low brightness. By such superimposition, the actinic energy is liable to reach even the inks in the lower part, and good curing sensitivity, reduction of residual monomers, reduction of odors and improvement of adhesion can be expected. Furthermore, with respect to the irradiation with actinic energy, though it is possible to achieve exposure by collectively injecting full colors, it is preferable from the viewpoint of promotion of curing that the exposure is carried out for every color.

Furthermore, as described previously, with respect to an actinic energy curing type ink such as the ink composition of the invention, it is desired that the ink composition to be discharged is set up at a fixed temperature. Thus, it is preferable that from an ink feed tank to an ink-jet head portion are subjected to temperature control by heat insulation and warming. Moreover, it is preferable that the head unit for achieving heating is thermally shielded or heat insulated such that the device main body is not affected by the temperature from the outside air. In order to shorten the rise time of a printer which is required to be heated or to reduce a loss of the heat energy, it is preferable that not only heat insulation from other sites is achieved, but also a heat capacity of the whole of the heating unit is made small.

Furthermore, as an actinic energy source, a mercury vapor lamp, gas or solid lasers, and so on are mainly utilized. For the ultraviolet ray curing type ink-jetting, a mercury vapor lamp and a metal halide lamp are broadly known. Moreover, replacement for a GaN based semiconductor ultraviolet ray emitting device is very useful industrially and environmentally. In addition, LED (UV-LED) and LD (UV-LD) are small in size, long in life, high in efficiency and low in costs and are expected as a radiation source for actinic energy curing type ink-jetting.

Furthermore, as described previously, it is possible to use, as the actinic energy source, a light emitting diode (LED) and a laser diode (LD). In particular, in the case where an ultraviolet ray source is required, ultraviolet LED and ultraviolet LD can be used. For example, Nichia Corporation markets a violet LED a major emission spectrum of which has a wavelength between 365 nm and 420 nm. In addition, in the case where a much shorter wavelength is required U.S. Pat. No. 6,084,250 discloses LED capable of emitting actinic energy as centralized between 300 nm and 370 nm. Also, other ultraviolet LEDs are available, and radiations having a different ultraviolet ray band can be irradiated. In particular, the actinic energy source which is preferable in the invention is UV-LED, and UV-LED having a peak wavelength of from 350 to 420 nm is especially preferable.

(Medium to be Recorded)

The medium to be recorded to which the ink composition of the invention is applicable is not particularly limited, and useful examples thereof include papers such as usual non-coated papers and coated papers and various non-absorbing resin materials which are used for so-called flexible packaging or resin films resulting from molding such a resin material into a film Examples of various plastic films which can be used include PET films, OPS films, OPP films, ONy films, PVC films, PE films, and TAC films. Besides, examples of plastics which can be used as the medium to be recorded include polycarbonates, acrylic resins, ABS, polyacetals, PVA, and rubbers. Metals and glasses can also be used as the medium to be recorded.

In the ink composition of the invention, in the case where a material which is low in heat shrinkage at the time of curing is selected, it is excellent in adhesion between the cured ink composition and the medium to be recorded. Thus, there is an advantage that a high-definition image can be formed even by using a film which is liable to cause curling or deformation due to curing and shrinkage of the ink or the heat generation at the time of curing reaction, such as PET films, OPS films, OPP films, ONy films, and PVC films, all of which are shrinkable by heat.

The respective constitutional components to be used in the ink composition which can be used in the invention will be hereunder described in order.

(Ink Composition)

The ink composition which is used in the invention is an ink composition which is curable by irradiation with actinic energy, and examples thereof include a cationic polymerization based ink composition, a radical polymerization based ink composition, and an aqueous ink composition. These compositions will be hereunder described in detail.

(Cationic Polymerization Based Ink Composition)

The cationic polymerization based ink composition contains (a) a cationic polymerizable compound and (b) a compound capable of generating an acid by irradiation with actinic energy. If desired, the cationic polymerization based ink composition may further contain (d) an organic acidic component having a pk value of from 2 to 6, (e) a coloring agent, and the like.

The respective constitutional components which are used in the cationic polymerization based ink composition will be hereunder described in order.

(a) Cationic Polymerizable Compound

The cationic polymerizable compound (a) which is used in the invention is not particularly limited so far as it is a compound which causes a polymerization reaction due to an acid as generated from (b) a compound capable of generating an acid by irradiation with actinic energy as described later and is then cured, and various known cationic polymerizable monomers which are known as a photo cationic polymerizable monomer can be used. Examples of the cationic polymerizable monomer include epoxy compounds, vinyl ether compounds, and oxetane compounds as described in, for example, JP-A-6-9714, JP-A-2001-31892, JP-A-2001-40068, JP-A-2001-55507, JP-A-2001-310938, JP-A-2001-310937, and JP-A-2001-220526.

Examples of the epoxy compound include aromatic epoxides, alicyclic epoxides, and aliphatic epoxides.

As the aromatic epoxide, there are enumerated di- or polyglycidyl ethers resulting from a reaction of a polyhydric phenol having at least one aromatic nucleus or an alkylene oxide adduct thereof with epichlorohydrin. Examples thereof include di- or polyglycidyl ethers of bisphenol A or an alkylene oxide adduct thereof di- or polyglycidyl ethers of hydrogenated bisphenol A or an alkylene oxide adduct, and novolak type epoxy resins. Here, examples of the alkylene oxide include ethylene oxide and propylene oxide.

As the alicyclic epoxide, there are preferably enumerated cyclohexene oxide-containing or cyclopentene oxide-containing compounds which are obtained by epoxidizing a compound having at least one cycloalkene ring such as a cyclohexene ring and a cyclopentene ring with a suitable oxidizing agent such as hydrogen peroxide and peracids.

As the aliphatic epoxide, there are enumerated di- or polyglycidyl ethers of an aliphatic polyhydric alcohol or an alkylene oxide adduct thereof. Representative examples thereof include diglycidyl ethers of an alkylene glycol such as diglycidyl ether of ethylene oxide, diglycidyl ether of propylene glycol, and diglycidyl ether of 1,6-hexanediol; polyglycidyl ethers of a polyhydric alcohol such as di- or triglycidyl ethers of glycerin or an alkylene oxide adduct thereof, and diglycidyl ethers of a polyalkylene glycol represented by diglycidyl ethers of polyethylene glycol or an alkylene oxide adduct thereof and diglycidyl ethers of polypropylene glycol or an alkylene oxide adduct thereof. Here, examples of the alkylene oxide include ethylene oxide and propylene oxide.

The epoxy compound may be monofunctional or polyfunctional.

Examples of the monofunctional epoxy compound which can be used in the invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide, and 3-vinylcyclohexene oxide.

Furthermore, examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resins, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxycyclohexyl-5,5-spiro-3,4-epoxy)cyclohexane-m-dioxane, bis(3,4-epoxycyclohexylmethyl) adipate, vinylcyclohexene oxide, 4-vinylepoxycyclohexane, bis(3,4-epoxy-6-methylcyclohexylmethyl)adipate, 3,4-epoxy-6-methylcyclohexyl-3',4'-epoxy-6'-methylcyclohexane carboxylate, methylenebis(3,4-epoxycyclohexane), dicyclopentadiene diepoxide, di(3,4-epoxycyclohexylmethyl) ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane, and 1,2,5,6-diepoxycyclooctane.

Of these epoxy compounds, from the viewpoint of excellent curing rate, aromatic epoxides and alicyclic epoxides are preferable; and alicyclic epoxides are especially preferable.

Examples of the vinyl ether compound include di- or trivinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether, and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether, and octadecyl vinyl ether.

The vinyl ether compound may be monofunctional or polyfunctional.

Concretely, examples of the monofunctional vinyl ether include methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxypolyethylene glycol vinyl ether.

Furthermore, examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ethers, and bisphenol F alkylene oxide divinyl ethers; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether, and propylene oxide-added dipentaerythritol hexavinyl ether.

As the vinyl ether compound, from the viewpoints of curing properties, adhesion to the medium to be recorded and surface hardness of the formed image, di- or trivinyl ether compounds are preferable; and divinyl ether compounds are especially preferable.

The oxetane compound as referred to in the invention means a compound having an oxetane ring and can be arbitrarily selected and used among known oxetane compounds as described in JP-A-2001-220526, JP-A-2001-310937, and JP-A-2003-341217.

As the compound having an oxetane ring which can be used in the ink composition of the invention, compounds having from one to four oxetane rings in the structure thereof are preferable. By using such a compound, it becomes easy to keep the ink composition so as to make a viscosity fall within the range suitable for handling properties. Furthermore, it is possible to obtain high adhesion between the ink composition and the medium to be recorded after curing.

Such a compound having an oxetane ring is described in detail in paragraphs [0021] to [0084] of JP-A-2003-341217, and compounds as described in this patent document can also be suitably used in the invention.

Of the oxetane compounds which are used in the invention, it is preferred to use a compound having one oxetane ring from the viewpoints of viscosity and adhesiveness of the ink composition.

In the ink composition of the invention, such a cationic polymerizable compound may be used singly or in combination of two or more kinds thereof. However, from the viewpoint of the matter that shrinkage at the time of curing of the ink is effectively controlled, it is preferred to use a combination of at least one compound selected from oxetane compounds and epoxy compounds with a vinyl ether compound.

The content of the cationic polymerizable compound (a) in the ink composition is suitably in the range of from 10 to 95% by weight, preferably from 30 to 90% by weight, and more preferably from 50 to 85% by weight with respect to the whole of solids of the composition.

(b) Compound Capable of Generating an Acid by Irradiation with Actinic Energy

The ink composition of the invention contains a compound capable of generating an acid by irradiation with actinic energy (hereinafter properly referred to as "photo acid generating agent").

As the photo acid generating agent which can be used in the invention, compounds capable of generating an acid by irradiation of rays (for example, ultraviolet rays and far ultraviolet rays having a wavelength of from 400 to 200 nm; especially preferably g-rays, h-rays, i-rays, and KrF excimer lasers), ArF excimer lasers, electron beams, X-rays, molecular rays, or ion beams, which are used in photo cationic polymerization photoinitiators, photo radical polymerization photoinitiators, photo decolorizing agents of dyes, photo discoloring agents, or micro resists, can be properly selected and used.

Examples of such a photo acid generating agent include compounds which are decomposed by irradiation with actinic energy to generate an acid such as onium salts (for example, diazonium salts, ammonium salts, phosphonium salts, iodonium salts, sulfonium salts, selenonium salts, and arsonium salts), organic halogen compounds, organic metals or organic halides, photo acid generating agents having an o-nitrobenzyl type protective group, compounds which are photo decomposed to generate sulfonic acid, represented by imino sulfonate, disulfone compounds, diazo keto sulfone, and diazo disulfone compounds.

Also, oxazole derivatives and s-triazine derivatives as described in paragraphs [0029] to [0030] of JP-A-2002-122994 can be suitably used as the photo acid generating agent. In addition, onium salt compounds and sulfonate based compounds as enumerated in paragraphs [0037] to [0063] of JP-A-2002-122994 can be suitably used as the photo acid generating agent in the invention.

The photo acid generating agent (b) can be used singly or in combination with two or more kinds thereof.

The content of the photo acid generating agent (b) in the ink composition is preferably from 0.1 to 20% by weight, more preferably from 0.5 to 10% by weight, and further preferably from 1 to 7% by weight with respect to the whole of solids of the ink composition.

In addition to the foregoing essential components, various additives can be used jointly in the ink composition of the invention depending upon the purpose. These arbitrary components will be hereunder described.

(d) Organic Acidic Component Having a pk Value of from 2 to 6

In the ink composition of the invention, (d) an organic acidic component exhibiting a pKa of from 2 to 6 (hereinafter sometimes simply referred to as "organic acidic component") can be added. The organic acidic component (d) having a pK value of from 2 to 6 which is used in the invention is corresponding to a qualitatively weakly acidic organic compound. In the case where the pKa of the organic acidic component is larger than 6, when added in the ink composition of the invention, the sensitivity is lowered, whereas in the case where the pKa is smaller than 6, deterioration in stability with time of the ink composition is caused. Therefore, in the invention, it is preferred to apply a substance exhibiting a pKa value of from 2 to 6 as the organic acidic component.

As a specific compound of the organic acidic components exhibiting a pKa value of from 2 to 6, carboxylic acids are especially enumerated. Examples of the carboxyl acid include aliphatic or aromatic monocarboxylic acids, dicarboxylic acids or tricarboxylic acids having from 1 to 20 carbon atoms, such as acetic acid, phenylacetic acid, phenoxyacetic acid, methoxypropionic acid, lactic acid, hexanoic acid, heptanoic acid, octanoic acid, palmitic acid, stearic acid, oleic acid, linoleic acid, cyclopropylcarboxylic acid, cyclobutanecarboxylic acid, cyclopentanecarboxylic acid, cyclohexanecarboxylic acid, 1-adamantanecarboxylic acid, 1,3-adamantanedicarboxylic acid, norbornene-2,3-dicarboxylic acid, abietic acid, trans-retinoic acid, cyclohexylacetic acid, dicyclohexylacetic acid, adamantaneacetic acid, malonic acid, monomethyl malonate, fumaric acid, maleic acid, monomethyl maleate, itaconic acid, crotonic acid, succinic acid, adipic acid, sebacic acid, glycolic acid, diglycolic acid, mandelic acid, tartaric acid, malic acid, alginic acid, cinnamic acid, methoxycinnamic acid, 3,5-dimethoxycinnamic acid, benzoic acid, salicylic acid, 4-hydroxybenzoic acid, gallic acid, 3-nitrobenzoic acid, 3-chlorobenzoic acid, 4-vinylbenzoic acid, t-butylbenzoic acid, 1-naphthoic acid, 1-hydroxy-2-naphthoic acid, fluorenone-2-carboxylic acid, 9-anthracenecarboxylic acid, 2-anthraquinonecarboxylic acid, phthalic acid, monomethyl phthalate, isophthalic acid, terephthalic acid, trimellitic acid, and monomethyl trimellitate. However, it should not be construed that the invention is limited thereto.

(e) Coloring Agent

In the ink composition of the invention, by adding a coloring agent, it is possible to form a visible image. For example, in the case of forming an image area region of a lithographic printing plate, though it is not always required to add a coloring agent, it is preferred to use a coloring agent from the viewpoint of plate inspection properties of the resulting lithographic printing plate.

The coloring agent which can be used herein is not particularly limited but can be properly selected and used among various known coloring materials (for example, pigments and dyes) depending upon the utilization. For example, in the case of forming an image having excellent weather resistance, a pigment is preferable. As the dye, though any of water-soluble dyes and oil-soluble dyes can be used, oil-soluble dyes are preferable.

(Pigment)

The pigment which is preferably used in the invention will be hereunder described.

The pigment is not particularly limited. For example, all organic pigments and inorganic pigments which are generally commercially available, substances resulting from dispersing a pigment in, as a dispersion medium, an insoluble resin, etc., and substances resulting from grafting a resin on the surface of a pigment can be used. Substances resulting from dyeing a resin particle with a dye can also be used.

Examples of such a pigment include pigments as described in *Ganryo No Jiten* (Pigment Dictionary), edited by Seishiro ITO (published in 2000), W. Herbst and K. Hunger, *Industrial Organic Pigments*, JP-A-2002-12607, JP-A-2002-188025, JP-A-2003-26978, and JP-A-2003-342503.

Specific examples of the organic pigment and the inorganic pigment which can be used in the invention are as follows. That is, examples of pigments which exhibit a yellow color include monoazo pigments such as C.I. Pigment Yellow 1 (for example, Fast Yellow G) and C.I. Pigment Yellow 74; disazo pigments such as C.I. Pigment Yellow 12 (for example, Disazo Yellow AAA) and C.I. Pigment Yellow 17; non-benzidine based azo pigments such as C.I. Pigment Yellow 180; azo lake pigments such as C.I. Pigment Yellow 100 (for example, Tartrazine Yellow Lake); condensed azo pigments such as C.I. Pigment Yellow 95 (for example, Condensed Azo Yellow GR); acid dye lake pigments such as C.I. Pigment Yellow 115 (for example, Quinoline Yellow Lake); basic dye lake pigments such as C.I. Pigment Yellow 18 (for example, Thioflavine Lake); anthraquinone based pigments such as Flavanthrone Yellow (Y-24); isoindolinone pigments such as Isoindolinone Yellow 3RLT (Y-110); quinophthalone pigments such as Quinophthalone Yellow (Y-138); isoindoline pigments such as Isoindoline Yellow (Y-139); nitroso pigments such as C.I. Pigment Yellow 153 (for example, Nickel Nitroso Yellow); and metal complex salt azomethine pigments such as C.I. Pigment Yellow 117 (for example, Copper Azomethine Yellow).

Examples of pigments which exhibit a red or magenta color include monoazo based pigments such as C.I. Pigment Red 3 (for example, Toluidine Red); disazo pigments such as C.I. Pigment Red 38 (for example, Pyrazolone Red B); azo lake pigments such as C.I. Pigment Red 53:1 (for example, Lake Red C) and C.I. Pigment Red 57:1 (for example, Brilliant Carmine 6B); condensed azo pigments such as C.I. Pigment Red 144 (for example, Condensed Azo Lake BR); acid dye lake pigments such as C.I. Pigment Red 174 (for example, Phloxine B Lake); basic dye lake pigments such as C.I. Pigment Red 81 (for example, Rhodamine 6G' Lake); anthraquinone based pigments such as C.I. Pigment Red 177 (for example Dianthraquinonyl Red), thioindigo pigments such as C.I. Pigment Red 88 (for example, Thioindigo Bordeaux); perinone pigments such as C.I. Pigment Red 194 (for example, Perinone Red); perylene pigments such as C.I. Pigment Red 149 (for example, Perylene Scarlet); quinacridone pigments such as C.I. Pigment Violet 19 (for example, unsubstituted quinacridone) and C.I. Pigment Red 122 (for example, Quinacridone Magenta); isoindolinone pigments such as C.I. Pigment Red 180 (for example, Isoindolinone Red 2BLT); and alizarine lake pigments such as C.I. Pigment Red 83 (for example, Madder Lake).

Examples of pigments which exhibit a blue or cyan color include disazo based pigments such as C.I. Pigment Blue 25 (for example, Dianisidine Blue); phthalocyanine pigments such as C.I. Pigment Blue 15 (for example, Phthalocyanine Blue); acid dye lake pigments such as C.I. Pigment Blue 24 (for example, Peacock Blue Lake); basic dye lake pigments such as C.I. Pigment Blue 1 (for example, Victoria Pure Blue BO Lake); anthraquinone based pigments such as C.I. Pigment Blue 60 (for example, Indanthrone Blue); and alkali blue pigments such as C.I. Pigment Blue 18 (for example, Alkali Blue V-5:1).

Examples of pigments which exhibit a green color include phthalocyanine pigments such as C.I. Pigment Green 7 (Phthalocyanine Green) and C.I. Pigment Green 36 (Phthalocyanine Green); and azo metal complex pigments such as C.I. Pigment Green 8 (Nitroso Green).

Examples of pigments which exhibit an orange color include isoindoline based pigments such as C.I. Pigment Orange 66 (Isoindoline Orange); and anthraquinone based pigments such as C.I. Pigment Orange 51 (Dichloropyranthrone Orange).

Examples of pigments which exhibit a black color include carbon black, titanium black, and aniline black.

Specific examples of white pigments which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments. Thus, the titanium oxide has large covering power and coloring power as a pigment and has excellent durability against acids, alkalis and other environments. Accordingly, it is preferred to use titanium oxide as the white pigment. As a matter of course, other white pigments (other white pigments than those as enumerated previously may also be used) may be used as the need arises.

For dispersing the pigment, dispersing units such as a ball mill, a sand mill, an attritor, a roll mill, a jet mill, a homogenizer, a paint shaker, a kneader, an agitator, a Henschel mixer, a colloid mill, an ultrasonic homogenizer, a pearl mill, and a wet jet mill can be employed.

In dispersing the pigment, it is also possible to add a dispersant. Examples of the dispersant include hydroxyl group-containing carboxylic acid esters, salts between a long chain polyaminoamide and a high molecular acid ester, salts of a high molecular polycarboxylic acid, high molecular unsaturated acid esters, high molecular copolymers, modified polyacrylates, aliphatic polyhydric carboxylic acids, naphthalenesulfonic acid formalin condensates, polyoxyethylene alkylphosphoric esters, and pigment derivatives. It is also preferred to use a commercially available high molecular dispersant such as Zeneca's SOLSPERSE Series.

Furthermore, it is possible to use, as a dispersing agent, a synergist adaptive to a pigment of every kind. It is preferable that such a dispersant or dispersing agent is added in an amount of from 1 to 50 parts by weight based on 100 parts by weight of the pigment.

In the ink composition, a solvent may be added as a dispersion medium for various components inclusive of the pigment. Also, the foregoing cationic polymerizable compound (a) which is a low molecular component may be used as the dispersion medium in the absence of a solvent. However, since the ink composition of the invention is an actinic energy curing type ink and after applying on the medium to be recorded, the ink is cured, it is preferred that the ink composition is free from a solvent. This is because when the solvent remains in the cured ink image, the solvent resistance is deteriorated or the residual solvent causes a problem of VOC (volatile organic compound). In view of the foregoing, what the cationic polymerizable compound (a) is used as the dispersion medium, especially a cationic polymerizable monomer having the lowest viscosity is selected is preferable from the viewpoints of dispersing adaptability and improvement of handling properties of the ink composition.

An average particle size of the pigment is preferably in the range of from 0.02 to 4 μm, more preferably from 0.02 to 2, and further preferably from 0.02 to 1.0 μm.

In order to make the average particle size of the pigment particle fall within the foregoing preferred range, the pigment, the dispersant and the dispersion medium are selected, and the dispersing condition and the filtration condition are set up. By managing the particle size, it is possible to control plugging of a head nozzle and to keep the storage stability of the ink and the transparency and curing sensitivity of the ink.

(Dye)

As the dye which is used in the invention, an oil-soluble dye is preferable. Concretely, the oil-soluble dye is a dye having a solubility in water at 25° C. (weight of the dye which is dissolved in 100 g of water) of not more than 1 g, preferably not more than 0.5 g, and more preferably not more than 0.1 g. Accordingly, a so-called water-insoluble and oil-soluble dye is preferably used.

In the dye which is used in the invention, it is also preferred to introduce an oil-solubilizing group into the mother nucleus of the foregoing dye for the purpose of dissolving a necessary amount of the dye in the ink composition.

Examples of the oil-solubilizing group include a long chain or branched alkyl group, a long chain or branched alkoxy group, a long chain or branched alkylthio group, a long chain or branched alkylsulfonyl group, a long chain or branched acyloxy group, a long chain or branched alkoxycarbonyl group, a long chain or branched acyl group, a long chain or branched acylamino group, a long chain or branched alkylsulfonylamino group, and a long chain or branched alkylaminosulfonyl group; and an aryl group, an aryloxy group, an aryloxycarbonyl group, an arylcarbonyloxy group, an arylaminocarbonyl group, an arylaminosulfonyl group, and an arylsulfonylamino group each containing the foregoing long chain or branched substituent.

Furthermore, with respect to the water-soluble dye having a carboxyl acid or a sulfonic acid, a dye may be obtained by converting it into an oil-solubilizing group including an alkoxycarbonyl group, an aryloxycarbonyl group, an alkylaminosulfonyl group, and an arylaminosulfonyl group using a long chain or branched alcohol, amine, phenol or aniline derivative.

The oil-soluble dye, is preferably an oil-soluble dye having a melting point of not higher than 200° C., more preferably an oil-soluble dye having a melting point of not higher than 150° C., and further preferably an oil-soluble dye having a melting point of not higher than 100° C. By using an oil-soluble dye having a low melting point, deposition of a crystal of the dye in the ink composition is controlled, and the storage stability of the ink composition is improved.

Furthermore, for the purpose of improving fading, especially resistance to oxidizers such as ozone and curing characteristics, it is preferable that the oxidation potential is noble (high). For that reason, an oil-soluble dye having an oxidation potential of 1.0 V (vs SCE) or more is preferably used as the oil-soluble dye to be used in the invention. It is preferable that the oxidation potential is higher. The oxidation potential is more preferably 1.1 V (vs SCE) or more, and especially preferably 1.15 V (vs SCE) or more.

As a dye having a yellow color, compounds having a structure represented by the general formula (Y-I) as described in JP-A-2004-250483 are preferable.

Dyes represented by the general formulae (Y-II) to (Y-IV) as described in paragraph [0034] of JP-A-2004-250483 are especially preferable. Specific examples thereof include compounds as described in paragraphs [0060] to [0071] of JP-A-2004-250483. Incidentally, the oil-soluble dyes of the general formula (Y-I) as described in the subject patent document may be used for inks of any colors including not only yellow inks but also black inks and red inks.

As a dye having a magenta color, compounds having a structure represented by the general formulae (3) and (4) as described in JP-A-2002-114930 are preferable. Specific examples thereof include compounds as described in paragraphs [0054] to [0073] of JP-A-2002-114930.

Azo dyes represented by the general formulae (M-1) to (M-2) as described in paragraphs [0084] to [0122] of JP-A-2002-121414 are especially preferable. Specific examples thereof include compounds as described in paragraphs [0123] to [0132] of JP-A-2002-121414. Incidentally, the oil-soluble dyes of the general formulae (3), (4) and (M-1) to (M-2) as described in the subject patent document may be used for inks of any colors including not only magenta inks but also black inks and red inks.

As a dye having a cyan color, dyes represented by the general formulae (I) to (IV) as described in JP-A-2001-181547 and dyes represented by the general formulae (IV-1) to (IV-4) as described in paragraphs [0063] to [0078] of JP-A-2002-121414 are preferable. Specific examples thereof include compounds as described in paragraphs [0052] to [0066] of JP-A-2001-181547 and compounds as described in paragraphs [0079] to [0081] of JP-A-2002-121414.

Phthalocyanine dyes represented by the general formulae (C-I) and (C-II) as described in paragraphs [0133] to [0196] of JP-A-2002-121414 are especially preferable, with phthalocyanine dues represented by the general formula (C-II) being further preferable. Specific examples thereof include compounds as described in paragraphs [0198] to [0201] of JP-A-2002-121414. Incidentally, the oil-soluble dyes of the foregoing general formulae (I) to (IV), (IV-1) to (IV-4), (C-I) and (C-II) may be used for inks of any colors including not only cyan inks but also black inks and green inks.

Such a coloring agent is preferably added in an amount of from 1 to 20% by weight, and more preferably from 2 to 10% by weight with respect to the whole of solids in the ink composition.

(Other Components)

Various additives which are used depending upon the situation will be hereunder described.

(Ultraviolet Ray Absorber)

In the invention, an ultraviolet ray absorber can be used from the viewpoints of improving the weather resistance and preventing the fading on the resulting image.

Examples of the ultraviolet ray absorber include benzotriazole based compounds described in JP-A-58-185677, JP-A-61-190537, JP-A-2-782, JP-A-5-197075, and JP-A-9-34057; benzophenone based compounds as described in JP-A-46-2784, JP-A-5-194483, and U.S. Pat. No. 3,214,463; cinnamic acid based compounds as described in JP-B-48-303492, JP-B-56-21141, and JP-A-10-88106; triazine based compounds as described in JP-A-4-298503, JP-A-8-53427, JP-A-8-239368, JP-A-10-182621, and JP-T-8-501291; compounds as described in *Research Disclosure*, No. 24239; compounds capable of absorbing ultraviolet rays to emit fluorescence, as represented by stilbene based compounds and benzoxazole based compounds; and so-called fluorescent brighteners.

Though the amount of addition of the ultraviolet ray absorber is properly selected depending upon the purpose, it is generally from about 0.5 to 15% by weight as calculated as solids.

(Sensitizer)

For the purposes of improving the acid generation efficiency of the photo acid generating agent and shifting the light-sensitive wavelength into a long wavelength side, a sensitizer may be added in the ink composition of the invention as the need arises. The sensitizer may be any sensitizer so far as it is able to sensitize the photo acid generating agent through an electron transfer mechanism or an energy transfer mechanism. Preferred examples thereof include aromatic polyfused compounds such as anthracene, 9,10-dialkoxyanthracenes, pyrene, and perylene; aromatic ketone compounds such as acetophenone, benzophenone, thioxanthone, and Michler's ketone; and heterocyclic compounds such as phenothiazine and N-aryloxazolidinones. Though the amount of addition of the sensitizer is properly selected depending upon the purpose, it is generally from 0.01 to 1% by mole, and preferably from 0.1 to 0.5% by mole with respect to the photo acid generating agent.

(Antioxidant)

For the purpose of improving the stability of the ink composition, an antioxidant can be added. Examples of the antioxidant include antioxidants as described in EP-A-223739, EP-A-309401, EP-A-309402, EP-A-310551, EP-A-310552, EP-A-459416, DE-A-3435443, JP-A-5448535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,980,275.

Though the amount of addition of the antioxidant is properly selected depending upon the purpose, it is generally from about 0.1 to 8% by weight as calculated as solids.

(Anti-Fading Agent)

In the ink composition of the invention, various organic or metal complex based anti-fading agents can be used. Examples of the organic anti-fading agent include hydroquinones, alkoxyphenols, dialkoxyphenols, phenols, anilines, amines, indanes, chromans, alkoxyanilines, and heterocyclic compounds. Examples of the metal complex based anti-fading agent include nickel complexes and zinc complexes. Concretely, compounds described in patents as cited in *Research Disclosure*, No. 17643, No. VII, Items I to J, ibid, No. 15162, ibid., No. 18716, page 650, left-hand column, ibid., No. 36544, page 527, ibid, No. 307105, page 872, and ibid., No. 15162; and compounds included in the general formulae of representative compounds and compound examples as describe on pages 127 to 137 of JP-A-62-215272 can be used.

Though the amount of addition of the anti-fading agent is properly selected depending upon the purpose, it is generally from about 0.1 to 8% by weight as calculated as solids.

(Conductive Salt)

For the purpose of controlling injection physical properties, conductive salts such as potassium thiocyanate, lithium nitrate, ammonium thiocyanate, and dimethylamine hydrochloride can be added in the ink composition of the invention.

(Solvent)

In the ink composition of the invention, for the purpose of improving adhesion to the medium to be recorded, it is also effective to add an extremely trace amount of an organic solvent.

Examples of the solvent include ketone based solvents such as acetone, methyl ethyl ketone, and diethyl ketone; alcohol based solvents such as methanol, ethanol, 2-propanol, 1-propanol, 1-butanol, and tert-butanol, chlorine based solvents such as chloroform and methylene chloride; aromatic solvents such as benzene and toluene; ester based solvents such as ethyl acetate, butyl acetate, and isopropyl acetate; ether based solvents such as diethyl ether, tetrahydrofuran, and dioxane; and glycol ether based solvents such as ethylene glycol monomethyl ether and ethylene glycol dimethyl ether.

In this case, it is effective to add the solvent in an amount within the range where problems in solvent resistance and VOC are not caused. Its amount is preferably in the range of from 0.1 to 5% by weight, and more preferably from 0.1 to 3% by weight with respect to the whole of the ink composition.

(High Molecular Compound)

For the purpose of adjusting film physical properties, various high molecular compounds can be added in the ink composition of the invention. Examples of the high molecular compound which can be used include acrylic polymers, polyvinyl butyral resins, polyurethane resins, polyamide resins, polyester resins, epoxy resins, phenol resins, polycarbonate resins, polyvinyl butyral resins, polyvinyl formal resins, shellac, vinyl based resins, acrylic resins, rubber based resins, waxes, and other natural resins. Such a high molecular compound may be used in combination with two or more kinds thereof. Of these, vinyl based copolymers obtainable from copolymerization of an acrylic monomer are preferable. In addition, with respect to the copolymerization composition of a high molecular binding material, copolymers containing, as a structural unit, a "carboxyl group containing monomer", an "alkyl methacrylate" or an "alkyl acrylate" are also preferably used.

(Surfactant)

A surfactant may also be added in the ink composition of the invention.

As the surfactant, there are enumerated surfactants as described in JP-A-62-173463 and JP-A-62-183457 Examples thereof include anionic surfactants such as dialkylsulfosuccinic acid salts, alkylnaphthalenesulfonic acid salts, and fatty acid salts; nonionic surfactants such as polyoxyethylene alkyl ethers, polyoxyethylene alkylaryl ethers, acetylene glycols, and polyoxyethylene-polyoxypropylene block copolymers; and cationic surfactants such as alkylamine salts and quaternary ammonium salts. Incidentally, organic fluoro compounds may be used in place of the foregoing surfactants. It is preferable that the organic fluoro compound is hydrophobic Examples of the organic fluoro compound include fluorine based surfactants, oily fluorine based compounds (for example, fluorine oils), and solid fluorine compound resins (for example, tetrafluoroethylene resins). Also, there are enumerated organic fluoro compounds as described in JP-B-57-9053 (columns 8 to 17) and JP-A-62-135826.

Besides, it is possible to contain, for example, a leveling additive, a matting agent, a wax for adjusting film physical properties, and a tackifier for improving adhesion to a medium to be recorded such as polyolefins and PET, which does not hinder the polymerization, as the need arises.

Concretely, the tackifier includes high molecular adhesive polymers as described on pages 5 to 6 of JP-A-2001-49200 (for example, copolymers made of an ester between (meth) acrylic acid and an alcohol containing an alkyl group having from 1 to 20 carbon atoms, an ester between (meth)acrylic acid and an alicyclic alcohol having from 3 to 14 carbon atoms, or an ester between (meth)acrylic acid and an aromatic alcohol having from 6 to 14 carbon atoms); and low molecular tackiness-imparting resins containing a polymerizable unsaturated bond.

(Preferred Physical Properties of Ink Composition)

Taking into account the injection properties, an ink viscosity of the ink composition of the invention is preferably not more than 20 mPa·s, and more preferably not more than 10 mPa·s at the temperature at the time of injection. Furthermore, it is preferable that a composition ratio is properly adjusted and determined such that the ink viscosity falls within the foregoing range.

A surface tension of the ink composition of the invention is preferably from 20 to 30 mN/n, and more preferably from 23 to 28 mN/m. In the case of achieving recording on various media to be recorded such as polyolefins, PET, coated papers, and non-coated papers, the surface tension of the ink composition of the invention is preferably 20 mN/m or more from the viewpoints of oozing and penetration, and it is preferably not more than 30 mN/m in view of wetting properties.

The thus adjusted ink composition of the invention is suitably used as an ink for ink-jet recording. In the case of using the ink composition of the invention as an ink for ink-jet recording, the ink composition is injected onto a medium to be recorded by an ink-jet printer, and thereafter, the injected ink composition is irradiated with actinic energy and cured, thereby achieving recording.

Since a printed matter as obtained from this ink has an image area which has been cured by irradiation with actinic energy such as ultraviolet rays and has excellent strength, it can be used for various utilities such as the formation of an ink receiving layer (image area) of a lithographic printing plate other than the formation of an image by the ink.

(Radical Polymerization Based Ink Composition)

The radical polymerization based ink composition contains a radical polymerizable compound and a polymerization initiator. If desired, the radical polymerization based ink composition may further contain a sensitizing dye, a coloring material, and so on.

The respective constitutional components to be used in the radical polymerization based ink composition which can be used will be hereunder described in order.

(Radical Polymerizable Compound)

The radical polymerizable compound includes, for example, a compound containing an addition polymerizable ethylenically unsaturated bond as enumerated below.

(Compound Containing an Addition Polymerizable Ethylenically Unsaturated Bond)

Examples of the compound containing an addition polymerizable ethylenically unsaturated bond which can be used in the ink composition of the invention include esters between an unsaturated carboxylic acid (for example, acrylic acid, methacrylic acid, itaconic acid, crotonic acid, isocrotonic acid, and maleic acid) and an aliphatic polyhydric alcohol compound and amides between the foregoing unsaturated carboxylic acid an aliphatic polyhydric amine compound.

Specific examples of monomers of an ester between an aliphatic polyhydric alcohol compound and an unsaturated carboxylic acid are as follows. That is, examples of acrylic esters include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl) ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl) isocyanurate, and polyester acrylate oligomers.

Examples of methacrylic esters include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy) phenyl]dimethylmethane, and bis[p-(acryloxyethoxy)phenyl]dimethylmethane. Examples of itaconic esters include ethylene glycol diitaconate; propylene glycol diitaconate, 1,3-butanediol diitaconate, 1,4-butanediol diitaconate, tetramethylene glycol diitaconate, pentaerythritol diitaconate, and sorbitol tetraitaconate.

Examples of crotonic esters include ethylene glycol dicrotonate, tetramethylene glycol dicrotonate, pentaerythritol dicrotonate, and sorbitol tetradicrotonate. Examples of isocrotonic esters include ethylene glycol diisocrotonate, pentaerythritol diisocrotonate, and sorbitol tetraisocrotonate. Examples of maleic esters include ethylene glycol dimaleate, triethylene glycol dimaleate, pentaerythritol dimaleate, and sorbitol tetramaleate. In addition, mixtures of the foregoing ester monomers can be enumerated. Also, specific examples of monomers between an aliphatic polyhydric amine compound and an unsaturated carboxylic acid include methylene bisacrylamide, methylene bismethacrylamide, 1,6-hexamethylene bisacrylamide, 1,6-hexamethylene bismethacrylamide, diethylene triamine trisacrylamide, xylylene bisacrylamide, and xylylene bismethacrylamide.

As other examples, there are enumerated vinyl urethane compounds containing two or more polymerizable vinyl groups in one molecule thereof in which a hydroxyl group-containing vinyl monomer represented by the general formula (A): $CH_2{=}C(R)COOCH_2CH(R')OH$ (wherein R and R' each represents H or $CH_3$) is added to a polyisocyanate compound containing two or more isocyanate groups in one molecule thereof, as described in JP-B-48-41708.

Furthermore, there can be enumerated functional acrylates and methacrylates such as urethane acrylates as described in JP-A-51-37193; polyester acrylates as described in JP-A-48-64183, JP-B-4943191, and JP-B-52-30490; and epoxy acrylates resulting from a reaction between an epoxy resin and (meth)acrylic acid. In addition, compounds presented as photo curable monomers and oligomers in *Journal of the Adhesion Society of Japan*, Vol. 20, No. 7, pp. 300-308 (1984) can be used. In the invention, these monomers can be used in a chemical morphology such as prepolymers, namely dimers and trimers, oligomers, and mixtures or copolymers thereof.

The amount of use of the radical polymerizable compound is usually from 1 to 99.99%, preferably from 5 to 90.0%, and more preferably from 10 to 70% (the term "%" means % by weight) with respect to the whole of components of the ink composition.

(Photopolymerization Initiator)

Next, the photopolymerization initiator which is used in the radical polymerization based ink composition of the invention will be hereunder described.

The photopolymerization initiator in the invention is a compound capable of generating a chemical change via an action of light or a mutual action with an electron excited state of a sensitizing dye to form at least one of radicals, acids and bases.

Preferred examples of the photopolymerization initiator include (a) aromatic ketones, (b) aromatic onium salt compounds, (c) organic peroxides, (d) hexaacryl biimidazole compounds, (e) keto oxime ester compounds, (f) borate compounds, (g) azinium compounds, (h) metallocene compounds, (i) active ester compounds, and (j) compounds containing a carbon-halogen bond.

(Sensitizing Dye)

In the invention, for the purpose of improving the sensitivity of the photopolymerization initiator, a sensitizing dye may be added. As the preferred sensitizing dye, there can be enumerated the following compounds which have an absorption wavelength in a region of from 350 nm to 450 nm.

That is, examples of the sensitizing dye include polynuclear aromatic compounds (for example, pyrene, perylene, and triphenylene), xanthenes (for example, Fluororescein, Bosine, Erythrocin, Rhodamine B, and Rose Bengale), cyanines (for example, Thiacarbocyanine and Oxacarbocyanine), merocyanines (for example, merocyanine and carbomerocyanine), thiazines (for example, Thionine, Methylene Blue, and Toluidine Blue), acridines (for example Acridine Orange, chloroflavin, and acriflavin), anthraquinones (for example, anthraquinone), squaryliums (for example, squarylium), and coumarins (for example, 7-diethylamino-4-methylcoumarin).

(Cosensitizer)

In addition, known compounds having actions such as an action to further improve the sensitivity and an action to control the polymerization inhibition due to oxygen may be added as a cosensitizer in the ink of the invention.

Examples of such a cosensitizer include compounds as described in M. R. Sander, et al., *Journal of Polymer Society*, Vol. 10, p. 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline, and p-methylthiodimethylaniline.

As other examples, there are enumerated thiols and sulfides, for example, thiol compounds as described in JP-A-53-702, JP-B-55-500806, and JP-A-5-142772 and disulfide compounds as described in JP-A-56-75643. Specific examples thereof include 2-methylmercaptobenzothiazole, 2-mercaptobenzoxazole, 2-methylmercaptobenzimidazole, 2-mercapto-4(3H)-quinazoline, and β-mercaptonaphthalene.

As other examples, there are enumerated amino acid compounds (for example, N-phenylglycine), organometallic compounds as described in JP-B-48-42965 (for example, tributyl tin acetate), hydrogen donators as described in JP-B-55-34414, sulfur compounds as described in JP-A-6-308727 (for example, triathiane), phosphorus compounds as described in JP-A-6-250387 (for example, diethyl phosphite), and Si—H and Ge—H compounds as described in Japanese Patent Application No. 6-191605.

Furthermore, from the viewpoint of enhancing the preservability, it is preferred to add a polymerization inhibitor in an amount of from 200 to 20,000 ppm. It is preferable that the ink for ink-jet recording of the invention is made to have a low viscosity by heating at a temperature in the range of from 40 to 80° C. and then injected. For the purpose of preventing head plugging by thermal polymerization from occurring, it is preferred to add a polymerization inhibitor. Examples of the polymerization inhibitor include hydroquinone, benzoquinone, p-methoxyphenol, TEMPO, TEMPOL, and cupferron Al.

(Others)

Besides, known compounds can be used as the need arises. For example, surfactants, leveling additives, matting agents, and polyester based resins, polyurethane based resins, vinyl based resins, acrylic resins, rubber based resins, and waxes for the purpose of adjusting film physical properties can be properly selected and used. Furthermore, for the purpose of improving adhesion to a medium to be recorded such as polyolefins and PET, it is also preferred to contain a tackifier which does not inhibit the polymerization. Concretely, the tackifier includes high molecular adhesive polymers as described on pages 5 to 6 of JP-A-2001-49200 (for example, copolymers made of an ester between (meth)acrylic acid and an alcohol containing an alkyl group having from 1 to 20 carbon atoms, an ester between (meth)acrylic acid and an alicyclic alcohol having from 3 to 14 carbon atoms, or an ester between (meth)acrylic acid and an aromatic alcohol having from 6 to 14 carbon atoms); and low molecular tackiness-imparting resins containing a polymerizable unsaturated bond.

Furthermore, for the purpose of improving adhesion to the medium to be recorded, it is also effective to add an extremely trace amount of an organic solvent. In this case, it is effective to add the organic solvent in an amount within the range where problems in solvent resistance and VOC are not caused. Its amount is preferably in the range of from 0.1 to 5% by weight, and more preferably from 0.1 to 3% by weight with respect to the whole of the ink composition.

Furthermore, as a measure for preventing a lowering of the sensitivity due to a light shielding effect of the ink coloring material, it is also one of the preferred embodiments to form a radical/cation hybrid type curing ink by combining a cationic polymerizable monomer having a long life as a polymerization initiator and a polymerization initiator (Aqueous Ink Composition)

An aqueous ink composition contains a polymerizable compound and a water-soluble photopolymerization initiator capable of generating a radical by the action of actinic energy. If desired, the aqueous ink composition may further contain a coloring material and the like.

(Polymerizable Compound)

As the polymerizable compound which is contained in the aqueous ink composition of the invention, polymerizable compounds which are contained in known aqueous ink compositions can be used.

In order to optimize a formulation while taking into account end user characteristics such as curing rate, adhesion and flexibility, a reactive material can be added in the aqueous ink composition. As such a reactive material, for example, (meth)acrylate (namely, acrylate and/or methacrylate) monomers and oligomers, epoxides, and oxetanes are useful.

Examples of the acrylate monomer include phenoxyethyl acrylate, octyldecyl acrylate, tetrahydrofurfuryl acrylate, isobornyl acrylate, hexanediol diacrylate, trimethylolpropane triacrylate, pentaerythritol triacrylate, polyethylene glycol diacrylates (for example, tetraethylene glycol diacrylate), dipropylene glycol diacrylate, tri(propylene glycol) triacrylate, neopentyl glycol diacrylate, bis(pentaerythritol) hexaacrylate, acrylates of an ethoxylated or propoxylated glycol and a polyol (for example, propoxylated neopentyl glycol diacrylate and ethoxylated trimethylolpropane triacrylate), and mixtures thereof.

Examples of the acrylate oligomer include ethoxylated polyethylene glycol, ethoxylated trimethylolpropane acrylate, polyether acrylate and ethoxylated products thereof, and urethane acrylate oligomers.

Examples of the methacrylate include hexanediol dimethacrylate, trimethylolpropane trimethacrylate, triethylene glycol dimethacrylate, diethylene glycol dimethacrylate, ethylene glycol dimethacrylate, 1,4-butanediol dimethacrylate, and mixtures thereof.

The amount of addition of the oligomer is preferably from 1 to 80% by weight, and more preferably from 1 to 10% by weight with respect to the whole weight of the ink composition.

(Water-Soluble Photopolymerization Initiator Capable of Generating a Radical by the Action of Actinic Energy)

The polymerization initiator which can be used in the ink composition of the invention will be hereunder described. As one example, there are enumerated photopolymerization initiators having a wavelength of up to approximately 400 nm. Examples of such a photopolymerization initiator include photopolymerization initiators represented by the following general formulae, which are a substance having functionality in a long wavelength region, namely sensitivity so as to generate a radical by irradiation with ultraviolet rays (hereinafter abbreviated as "TX base"). In the invention, it is especially preferred to properly select and use a compound among these polymerization initiators.

TX-1

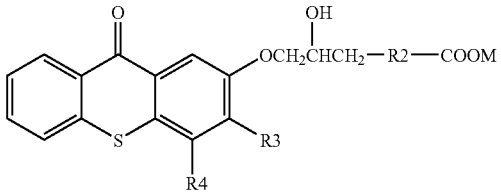

-continued

TX-2

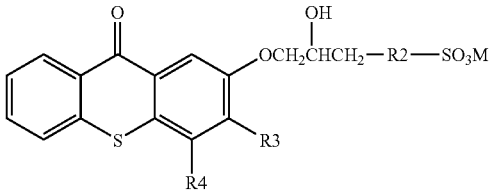

TX-3

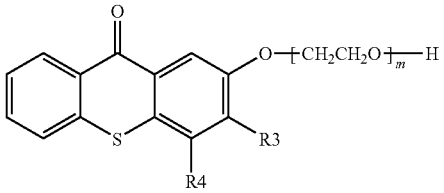

In the foregoing general formulae TX-1 to TX-3, R2 represents —$(CH_2)_x$— (wherein x represents 0 or 1), —O—$(CH_2)_y$— (wherein y represents 1 or 2), or a substituted or unsubstituted phenylene group. Furthermore, when R2 represents a phenylene group, at least one of hydrogen atoms in the benzene ring may be substituted with one or two or more groups or atoms selected from, for example, a carboxyl group or a salt thereof, a sulfonic acid or a salt thereof, a linear or branched alkyl group having from 1 to 4 carbon atoms, a halogen atom (for example, fluorine, chlorine, and bromine), an alkoxyl group having from 1 to 4 carbon atoms, and an aryloxy group such as phenoxy group. M represents a hydrogen atom or an alkali metal (for example, Li, Na, and K). In addition, R3 and R4 each independently represents a hydrogen atom or a substituted or unsubstituted alkyl group. Here, examples of the alkyl group include linear or branched alkyl groups having from approximately 1 to 10 carbon atoms, and especially from approximately 1 to 3 carbon atoms. Furthermore, examples of the substituent of the alkyl group include a halogen atom (for example, a fluorine atom, a chlorine atom, and a bromine atom), a hydroxyl group, and an alkoxyl group (for example, alkoxyl groups having from approximately 1 to 3 carbon atoms). Moreover, m represents an integer of from 1 to 10.

In addition, in the invention, water-soluble derivatives of a photopolymerization initiator, IRGACURE 2959 (a trade name, manufactured by Ciba Specialty Chemicals) represented by the following general formulae can be used. Concretely a photopolymerization initiator composed of the following formulae IC-1 to IC-3 can be used.

Formula

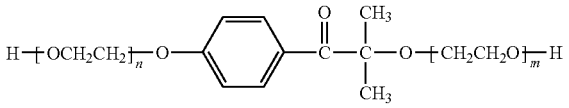

(n = 2~5, m = 0~5)

IC-1

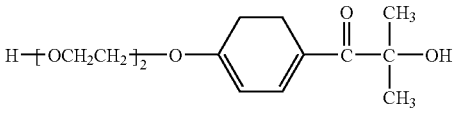

-continued

IC-2

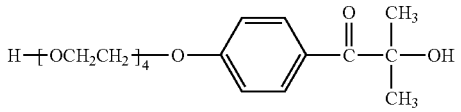

IC-3

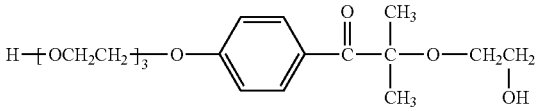

(Formulation for Clear Ink)

By forming the foregoing water-soluble polymerizable compound into a transparent aqueous ink without containing the foregoing coloring material therein, it is possible to prepare clear ink. In particular, by preparing the ink so as to have ink-jet recording characteristics, a water-soluble curing type clear ink for ink-jet recording is obtained. When such an ink is used, since it does not contain a coloring material therein, a clear film can be obtained. Examples of the utilization of the coloring material-free clear ink include use for undercoating for the purpose of imparting adaptability to image printing to a material to be recorded and use for overcoating for the purposes of surface protection of an image as formed by a usual ink and decoration and gloss impartation. In response to these uses, it is also possible to disperse a colorless pigment or a fine particle not for the purpose of coloration, and the like. By adding such substances, it is possible to improve various characteristics such as image quality, fastness and processability (for example, handling properties) of a printed matter.

With respect to the formulation condition in applying such a clear ink, it is preferred to prepare the ink so as to contain from 10 to 85% of the water-soluble polymerizable compound as the major component of the ink and from 1 to 10 parts by weight, based on 100 parts by weight of the water-soluble polymerizable compound, of the photopolymerization initiator (for example, an ultraviolet ray polymerization catalyst), with the photopolymerization initiator being contained in an amount of at least 0.5 parts based on 100 parts of the ink.

(Material Construction in Coloring Material-Containing Ink).

In the case of using the foregoing water-soluble polymerizable compound for a coloring material-containing ink, it is preferred to adjust the concentrations of the polymerization initiator and the polymerizable substance in the ink adaptive to the absorption characteristics of the coloring material which has been contained. As described previously, with respect to the blending amount, the amount of water or the solvent is made to fall within the range of from 40% to 90%, and preferably from 60% to 75% on the weight basis. In addition, the content of the polymerizable compound in the ink is in the range of from 1% to 30%, and preferably from 5% to 20% on the weight basis with respect to the whole amount of the ink. The amount of the polymerization initiator relies upon the content of the polymerizable compound and is generally in the range of from 0.1 to 7%, and preferably from 0.3 to 5% on the weight basis with respect to the whole amount of the ink.

In the case where a pigment is used as the coloring material of the ink, the concentration of the pure pigment fraction in the ink is generally in the range of from 0.3% by weight to 10% by weight with respect to the whole amount of the ink.

The coloring power of the pigment relies upon the dispersed state of the pigment particle. The range of from about 0.3 to 1% is the range where the ink is used as an ink of a pale color. When the concentration exceeds this range, a concentration at which the ink is used for general coloration of colors is given.

Incidentally, in the ink composition which is used in the invention, such as an cationic polymerization based ink composition, a radical polymerization based ink composition, and an aqueous ink composition, it is preferred to control conductivity from the viewpoint of electrostatic discharge. The conductivity of the ink is preferably from $10^{-9}$ S/cm to $10^{-2}$ S/m, and more preferably from $10^{-8}$ S/cm to $10^{-3}$ S/m. By making the conductivity of the ink fall within this range, it is possible to prevent interference between the adjacent channels or electric discharge while keeping the discharge frequency high. In adjusting the conductivity, it is also possible to preferably add the foregoing conductive salts or known conducting agents or charge controlling agents (as described in, for example, "Development and practical implementation of recent electrophotographic development systems and toner materials", pages 139 to 148, "Foundations and applications of electrophotographic technology" edited by The Society of Electrophotography of Japan, pages 497 to 505 (published by Corona Publishing Co., Ltd., 1988), Yuji Harazaki, *Denshi Shashin* (Electrophotography), Vol. 16 (No. 2), page 44 (1977), U.K. Patent Nos. 893,429 and 934,038, U.S. Pat. Nos. 3,900,412 and 4,606,989, JP-A-60-179751, JP-A-60-185963, and JP-A-2-13965).

Specific examples thereof include metal salts of an organic carboxylic acid such as zirconium naphthenate and zirconium octenate; ammonium salts of an organic carboxylic acid such as tetramethylammonium stearate; metal salts of an organic sulfonic acid such as sodium doedecylbenzenesulfonate and magnesium dioctylsulfosuccinate; ammonium salts of an organic sulfonic acid such as tetrabutylammonium toluenesulfonate; polymers containing a carboxyl group in the side chain thereof such as a carboxyl group-containing polymer resulting from modification of a copolymer of styrene and maleic anhydride with an amine; polymers containing a carboxylic acid anion group in the side chain thereof such as a copolymer of stearyl methacrylate and a tetramethylammonium salt of methacrylic acid; polymers containing a nitrogen atom in the side chain thereof such as a copolymer of styrene and vinylpyridine; and polymers containing an ammonium group in the side chain thereof such a copolymer of butyl methacrylate and N-(2-methacryloyloxyethyl)-N,N,N-trimethylammonium citrate. A charge which is imparted to the particle may be a positive charge or a negative charge.

Furthermore, metallic soaps as described in JP-A-11-109681 can also be preferably used as the charge adjusting agent.

In addition, the following can be used as the charge adjusting agent.

(1) Charge adjusting agents containing an alcohol amine resulting from binding a hydroxyl group to a carbon atom of an amine molecule.

(2) Charge adjusting agents containing an amine-containing resin and/or a substance containing a carboxyl group or a hydroxyl group.

(3) Charge adjusting agents containing an alkylamine carboxylic acid salt represented by the general formula: $R_1N^+H_2.R_2COO^-$ (wherein $R^1$ represents an alkyl group having from 1 to 18 carbon atoms, and $R_2$ represents a hydrogen atom or an alkyl group having from 1 to 18 carbon atoms, provided that at least one of $R_1$ and $R_2$ represents an alkyl group having from 8 to 18 carbon atoms).

(4) Charge adjusting agents containing polyaminopolybutenyl succinic imide.

(5) Charge adjusting agents containing at least one kind of the following (C1) to (C6):

(C1) a salt of an amino group-containing triarylmethane compound and a dispersion medium-soluble acidic compound, (C2) a salt of an amino group-containing dye and a dispersion medium-soluble acidic compound, (C3) a salt of an amino group-containing dye and a fatty acid having 5 or more carbon atoms, (C4) an amino group-containing nitrogen-containing heterocyclic compound, (C5) a salt of a basic nitrogen atom-containing compound and a dispersion medium-soluble high molecular carboxylic acid, and (C6) a combination of an amino group-containing nitrogen-containing heterocyclic compound and a polyoxyethylene group-containing ether compound.

(6) Charge adjusting agents containing a titanium compound having a specific structure.

(7) Charge adjusting agents containing an aprotic liquid-soluble ionic or zwitter-ionic charge controlling compound and a β-diketo metal salt.

(8) Charge adjusting agents containing a mixture of the following components (A) and (B) in a weight ratio of the component (B) to the component (A) of from 10/3 to 40/3.

(A) A salt mixture constructed of from 1 to 10 parts by weight of each of (i) a chromium salt of an alkylsalicyclic acid having from 14 to 18 carbon atoms; (ii) calcium didecyl sulfosuccinate; (iii) a copolymer of lauryl methacrylate, stearyl methacrylate and 2-methyl-5-vinylpyridine, the copolymer having a vinylpyridine content of from 20 to 30% by weight and having an average molecular weight of from 15,000 to 250,000, with at least 50% of the basic nitrogen groups being a salt of didecyl sulfosuccinate.

(B) A salt-free copolymer of (i) lauryl methacrylate and (ii) a monomer selected from the group consisting of 2- or 4-vinylpyridine, styrene and N,N-dimethylaminoethyl methacrylate, the copolymer having a molecular weight of from 15,000 to 100,000 and having a weight ratio of the monomer, B(i) to the monomer B(ii) of from 4/1 to 50/1.

(9) Charge adjusting agents containing the following copolymer particle.

Copolymer particle containing a thermoplastic resinous core which is substantially insoluble in the foregoing dispersion medium; and a copolymer steric stabilizer which is chemically fixed to the core, is soluble in the foregoing dispersion medium and has a chemically bound segment containing an organic acid having a pKa of less than 4.5, with a metallic soap compound as derived from an organic acid having a pKa exceeding 4.5 being chemically bound to the organic acid.

(10) Charge adjusting agents containing a charge generating agent composition which is obtained by mixing a charge generating agent, a solvent and a polar monomer species and polymerizing the mixture.

(11) Charge adjusting agents containing a hydroxybenzoic acid salt compound.

(12) Charge adjusting agents containing a copolymer particle containing (A) a thermoplastic resinous core which is insoluble or substantially insoluble in the foregoing dispersion medium; (B) a copolymer steric stabilizer which is chemically fixed to the core, is soluble in the foregoing dispersion medium and has a segment of a coordinating compound through a covalent bond; and (C) at least one metallic soap compound derived from metals capable of forming a coordinate bond with the segment of a coordinating compound.

(13) Charge adjusting agents containing a metal salt in which a charge particle has an ion exchange site capable of forming a complex with the metal salt.

(14) Charge adjusting agents containing a steric stabilizer and a charge generating component in which the charge generating component contains a coordinating associated body bound with a monovalent alkali metal cation or ammonium cation.

(15) Charge adjusting agents containing an alkyl phosphate having a specific structure.

(16) Charge adjusting agents containing a phosphoric ester of glycerin having a specific structure.

(17) Charge adjusting agents containing an organic compound containing any one of divalent to tetravalent metals,

(18) Charge adjusting agents containing an amino group-containing organopolysiloxane having a viscosity at 25° C. of not more than 30 centipoises.

(19) Charge adjusting agents containing a charge director and cyclodextrin or a derivative thereof.

(20) Charge adjusting agents containing an isocyanurate compound having a tertiary amino group in the molecular terminal end thereof and a high molecular chain having excellent affinity with the coated polymer.

(21) Charge adjusting agents containing a metal salt of octylic acid and/or a metal salt of naphthenic acid and a phosphoric eater based surfactant.

(22) Charge adjusting agents containing an aluminum-containing organometal compound.

The content of the charge adjusting agent against the whole of the ink composition is preferably in the range of from 0.0001 to 10% by weight, and more preferably from 0.001 to 5% by weight. Incidentally, it is preferable that the ink composition of the invention has an electric conductivity of from 10 nS/m to 300 nS/m and that the charge particle has an electric conductivity of 50% or more of the electric conductivity of the ink composition. Such conditions can be easily adjusted by increasing or decreasing the content of the charge adjusting agent.

In the light of the above, in the actinic energy curing type ink-jet recording device of the invention, since the foregoing UV ink is used and the ink is cured by irradiation with actinic energy immediately after the image formation by ink discharge, a fixing step by heating which when using other inks, was required becomes unnecessary. Accordingly, a situation that the ink is volatilized by heat does not take place so that it becomes gentle against the set-up environment; and the recording medium is in a completely dry state even before and after recording so that its handling is easy. Also, it becomes possible to realize high-speed ink-jet recording with high definition by electrostatic ink-jetting.

The present application claims foreign priority based on Japanese Patent Application (JP 2005-190061) filed Jun. 29, 2005, the contents of which is incorporated herein by reference.

What is claimed is:

1. An ink-jet recording device, which comprises:

a storing section that stores the ink curable by irradiation with an actinic energy ray to form an image on a recording medium;

an image recording section that comprises an ink-jet head and is discharged the ink as a droplet, the ink being fed from the storing section, onto the recording medium by an electrostatic force generated between the ink jet head and the recording medium;

a transporting and supporting section that comprises a placing surface, the transporting and supporting section transporting the recording medium and supporting the recording medium at a discharge position of the ink on the placing surface;

an irradiating section, which is an ultraviolet region LED, disposed at a position that can irradiate the recording medium with the actinic energy ray immediately after the ink is impacted on the recording medium; wherein the image recording section comprises:

an insulating substrate that has discharge nozzles;

an ink guide that is disposed so that a tip of the ink guide is protruded toward a side of the recording medium from each of the discharge nozzles;

a discharge electrode that is disposed surrounding the periphery of the ink guide at each of the discharge nozzles, each of the discharge nozzles being separated from one another; and wherein a ratio of an effective inside diameter of the discharge electrode to a distance in a protrusion direction of the ink guide between the tip of the ink guide and the discharge electrode is 1:0.5 to 1:2.

2. The ink jet recording device according to claim 1, which comprises:

an electrostatic charge section disposed at a side of the upstream in a transporting direction of the recording medium with respect to the discharge position of the ink and electrostatically charges the recording medium on the placing surface of the transporting and supporting section; and a static eliminating section that carries out a static elimination after the actinic energy ray is irradiated by the irradiating section, wherein the ink contains a charge adjusting agent.

3. The ink-jet recording device according to claim 1, wherein the image recording section further comprises:

an ink passage that is a gap between a head substrate for fixing and holding the ink guide and the insulating substrate; and a guard electrode that blocks an electric field between the discharge electrodes adjacent one another so that the guard electrode is electrically insulated from the discharge electrode between the discharge nozzles adjacent one another.

4. The ink-jet recording device according to claim 1, wherein the transporting and supporting section comprises:

a transporting belt that supports and transports the recording medium; and rolls that tense and drive the transporting belt.

5. The ink-jet recording device according to claim 1, wherein the transporting and supporting section comprises:

a platen that supports the recording medium at least in the vicinity of front and rear of the discharge position of the ink; and transporting rolls that gives a transporting power to the recording medium at least in a side of the upstream of the platen.

* * * * *